US007185735B2

(12) United States Patent
Sahyoun

(10) Patent No.: US 7,185,735 B2
(45) Date of Patent: Mar. 6, 2007

(54) AUDIO SPEAKER WITH WOBBLE FREE VOICE COIL MOVEMENT

(76) Inventor: Joseph Yaacoub Sahyoun, 3031 Hopkins Ave., Redwood City, CA (US) 94062

( * ) Notice: Subject to any disclaimer, the term of this patent is extended or adjusted under 35 U.S.C. 154(b) by 178 days.

(21) Appl. No.: 10/784,013

(22) Filed: Feb. 19, 2004

(65) Prior Publication Data

US 2004/0195039 A1 Oct. 7, 2004

Related U.S. Application Data

(63) Continuation-in-part of application No. 10/778,777, filed on Feb. 12, 2004, which is a continuation-in-part of application No. 10/753,278, filed on Jan. 8, 2004, which is a continuation-in-part of application No. 10/058,868, filed on Jan. 28, 2002, now Pat. No. 6,675,931, which is a continuation-in-part of application No. 09/542,155, filed on Apr. 4, 2000, now Pat. No. 6,460,651, which is a continuation-in-part of application No. 09/201,398, filed on Nov. 30, 1998, now Pat. No. 6,044,925.

(51) Int. Cl.

| | |
|---|---|
| ***H04R 7/12*** | (2006.01) |
| ***H04R 7/22*** | (2006.01) |
| ***H04R 9/04*** | (2006.01) |
| ***H04R 9/06*** | (2006.01) |
| *G10K 13/00* | (2006.01) |
| *H04R 9/02* | (2006.01) |

(52) U.S. Cl. ..... 181/157; 181/163; 181/171; 181/172; 181/147; 381/335; 381/398

(58) Field of Classification Search ..... 181/157, 181/161, 163, 165, 171, 172, 147, 164, 162; 381/335, 398
See application file for complete search history.

(56) References Cited

U.S. PATENT DOCUMENTS

| | | | | |
|---|---|---|---|---|
| 2,231,479 | A * | 2/1941 | Perry | 281/186 |
| 2,234,007 | A * | 3/1941 | Olson et al. | 181/172 |
| 2,269,284 | A * | 1/1942 | Olson | 381/342 |
| 3,684,052 | A * | 8/1972 | Sotome | 381/398 |
| 4,207,963 | A | 6/1980 | Klasco | 181/147 |
| 4,228,327 | A * | 10/1980 | Sawafuji | 381/398 |
| 4,477,699 | A * | 10/1984 | Wada et al. | 381/184 |

(Continued)

FOREIGN PATENT DOCUMENTS

| | | |
|---|---|---|
| DE | 30 20 146 | 12/1981 |

(Continued)

*Primary Examiner*—Edgardo San Martin
(74) *Attorney, Agent, or Firm*—Allston L. Jones

(57) ABSTRACT

A speaker that is designed to substantially eliminate wobble of the voice coil during operation, and thus remove that source of distortion and early failure of the speaker. This is accomplished with the creation of triangular ring that extends upward from the top edge of the voice coil bobbin with that ring mating with a flat diaphragm at a right angle directly above the top edge of the bobbin. The outer edge of the diaphragm connects to the inner edge of the surround at the point where a sloping side of the "triangle" is also connected and slopes down to the top edge of the bobbin where the opposite end is connected. The outer portion of the diaphragm provides the third side of the triangle.

6 Claims, 65 Drawing Sheets

U.S. PATENT DOCUMENTS

| | | | | |
|---|---|---|---|---|
| 4,517,416 | A * | 5/1985 | Goossens | 381/431 |
| 4,567,327 | A * | 1/1986 | Goossens et al. | 381/185 |
| 5,143,169 | A * | 9/1992 | Ziegenberg et al. | 181/144 |
| 5,748,759 | A * | 5/1998 | Croft et al. | 381/398 |
| 5,883,967 | A * | 3/1999 | House | 381/398 |
| 5,933,512 | A * | 8/1999 | Tamura | 381/424 |
| 6,160,898 | A * | 12/2000 | Bachmann et al. | 381/425 |
| 6,259,800 | B1 * | 7/2001 | Tagami | 381/412 |
| 6,445,803 | B1 * | 9/2002 | Boon et al. | 381/184 |
| 6,496,590 | B2 * | 12/2002 | Proni | 381/423 |
| 6,658,129 | B2 * | 12/2003 | D'Hoogh | 381/349 |
| 6,672,423 | B2 * | 1/2004 | Kato | 181/161 |
| 2004/0228500 | A1 * | 11/2004 | Stiles | 381/398 |

FOREIGN PATENT DOCUMENTS

| | | |
|---|---|---|
| DE | 39 23 189 | 1/1991 |
| WO | WO 97/46047 | 12/1997 |

* cited by examiner

AUDIO SPEAKER WITH WOBBLE FREE VOICE COIL MOVEMENT

RELATED U.S. APPLICATIONS

This application has the same title and is a Continuation-In-Part of application Ser. No. 10/788,777 filed Feb. 12, 2004 which is a Continuation-In-Part of application Ser. No. 10/753,278, filed Jan. 8, 2004, which is a Continuation-In-Part of application Ser. No. 10/058,868, filed Jan. 28, 2002, (now U.S. Pat. No. 6,675,931, issued Jan. 13, 2004), which is a Continuation-In-Part application Ser. No. 09/542,155, filed Apr. 4, 2000 (now U.S. Pat. No. 6,460,651, issued Oct. 8, 2002), which is a Continuation-In-Part application of application Ser. No. 09/201,398, filed Nov. 30, 1998 (now U.S. Pat. No. 6,044,925 issued Apr. 4, 2000).

BACKGROUND OF THE INVENTION

1. Field of the Invention

This invention relates to loud speakers and in particular to the construction of audio speakers that have virtually no wobble of the voice coil bobbin during operation.

2. Description of the Related Art

A goal of sound reproduction equipment is to provide a life-like sound quality to the listener. Life-like sound quality is understood to be best achieved when a sound system including the speakers have a flat frequency response curve throughout the range of sound frequencies audible to the human ear, generally 20 to 20,000 Hz. A normal speaker cabinet has an electro magnetically driven speaker cone sealed to an opening in the wall of a sealed cabinet. This arrangement provides a drooping frequency response curve (e.g., 22 in the graph 20 of FIG. 1).

The graph 20 of FIG. 1 represents a comparison of sound level verses frequency (i.e., frequency response). The plot 22 shows the drooping response for a closed cabinet system. Over the years, in an effort to improve sound quality low, mid, and high range speakers have been placed in separate cabinets or compartments. Each of those separate cabinets or compartments could then be tuned by creating ports, with or without tubes, in the cabinet to improve the frequency response. At low frequencies, the use of open ports, or open ports and tubes, in the speaker cabinet becomes unmanageable because of the large air mass that needs to be moved to provide adequate tuning. As an example, an ideal cabinet size to hear low frequencies might be larger than the room in which the listener was sitting.

In an effort to offset the effects of a rigid sealed cabinet and avoid the spatial requirements necessary when attempting to create ports or tube ports with speakers low frequencies, passive radiators (generally configured like speakers, but without the electro mechanical driver) have been placed in a secondary opening of the walls of the speaker cavity to reduce the drop-off of the loudness at low frequencies. An example of the improvement in the frequency response when such a passive radiator is installed is shown as plot 24 in FIG. 1. An example of the improvement in the frequency response attributable to the installation of a prior art passive radiator can be understood by reviewing plot 26 in FIG. 2. Note that the drop in the frequency response curve at lower frequencies in plot 26 is very severe before the range of inaudible frequencies 28 is reached. In this configuration, AREA2, the area under the curve to the right of the peak above a minimum loudness level, is larger than AREA1 which is the area under the curve to the left of the peak. This imbalance is indicative of the relative distortion that can be heard as the loudness of the passive radiator nosedives and falls below an audible loudness. The low frequency loudness and energy are not balanced with the high frequency loudness and energy. The area under the curves provide a measure of the imbalance.

Recent trends in the audio systems market have been leaning towards enhancing the bass or sub-woofer response of the audio reproduction systems, so that even if a sound is below the low limit of the range of audible sound, the sound level is high enough so that the listener, although he or she cannot "hear" the sound with ears, they can "feel" the sound as parts of their body are hit by the low frequency waves. At low frequencies, a limitation of passive radiators has been that the low frequencies require large displacements of the moveable radiator elements. Such large displacements can exceed the available range of motion of moveable radiator elements. For example, in FIGS. 4, 5 and 6, a speaker spider 62 at its perimeter is attached to the back end of a speaker basket 50 while the spider's center edge (or core) it is attached to the back end of a speaker cone 58 or a diaphragm 68 to spider 72 connection element 74. In each pictured radiator, a central moveable element is suspended by a speaker "surround" (52, 70, 84) which acts as the flexible element between the stationary front of the speaker basket (50, 66, 80) and the speaker moveable element. Because the range of travel available from each spider (62, 72, 88) is less than the range of travel available from the surround (52, 70, 84), as the spider (62, 72, 88) reaches the limit of its travel and stops. The sudden stop in the movement of the spider, due to its full extensions, causes distortions in adjacent components as well as in the pressure gradients in the speaker chamber. These distortions can be heard as static and/or unnatural discontinuities in the sound. The ratio of the speaker basket back opening "B" (which supports the spider) to the speaker basket front opening "A" (which supports the surround) is approximately 0.5 (or 50%).

In the instance when a passive radiator constructed solely of a speaker cone is connected only as its peripheral rim to an annular support surface in the wall of a speaker, for example, as shown in the Klasco, U.S. Pat. No. 4,207,963, a larger range of travel is available to accommodate large movable element displacements experienced at high volume and low frequencies. However, the use of a surround around the perimeter of the top of the cone and the cone shape produces cone wobble which also distorts the sound. The object of the Klasco patent was to arrange active elements to reduce the wobble in the passive radiator.

In the instance where a lone speaker cone suspended in a cavity opening is used, the response of the passive radiator during low frequency cycles as the cone is forced outward and pulled inward can be non-linear as the flexible member (surround) holding the cone tends to have different non-linear force to displacement characteristics when being stretched outwardly as compared to when it is being stretched inwardly.

The limitations on travel as shown in the prior art described in FIGS. 4, 5 and 6 and the wobble of a passive radiator as discussed in the Klasco patent and such a configuration's non-linearity, highlight the shortcomings of the prior art passive radiators.

The spatial requirement of the prior art passive radiators is also a drawback. The prior art passive radiators are quite large and bulky and extend a large distance into any sealed cavity. This spatial requirement must be taken into account when designing features and companion speakers to fit into the sealed cavity.

Recently there has been an increasing demand for loudspeakers for use in a very compact/shallow space. This demand was born by consumer appetite for louder sound grew couple with the desire for less obtrusive speakers. Recently, home audio consumers have begun a major shift from larger, conventional loudspeakers housed in cabinets that stand alone in the room—to smaller piston speakers that mount within the wall of a house. The available depth in in-wall locations is dictated by the use of 2×4 studs during construction thus creating a space that is less than 4" deep.

This need for shallow, low profile speakers are not limited to meeting the home audio demand. Such low profile speakers also have application in cars, boats, airplanes and other locations that will benefit from the depth reduction without taxing the sound pressure level. In cars for example, the available mounting depth behind the door panel is much less than the minimum height of conventional speakers. In order to use conventional speakers in such locations, it is nearly always necessary to use a raised grill cover over the speaker since it necessary to have a portion of the speaker heigh extend above the surface of the door panel into the passenger compartment.

For the most part, subwoofer construction has followed conventional technology—the use of an oscillating diaphragm that responds to a varying magnetic field developed by an applied audio signal. That varying magnetic field causes the diaphragm to be attracted and repelled to and from the intermediate position where the diaphragm rests when no audio signal is applied to the speaker. For the most part, current speaker technology uses a loudspeaker made of a rigid diaphragm, or "cone", suspended within a speaker frame, or "basket" around the outer edge with a flexible membrane, or "surround". This membrane allows the cone to move inward and outward when driven by a varying magnetic field resulting from the application of an audio, or "music", signal applied to the speaker.

Over the years speakers have been designed with a conventional structure—a cone connected to the outer part to a speaker frame, or basket, through a flexible membrane (surround). To develop a back-pressure wave and to control axial movement of the cone, designer installed a secondary part called a "spider" that also connects the inner part of the cone to the speaker frame. Almost all spider materials used are made of cloth that has been treated and pressed in a heated die to form the shape of the spider that was sought. Conventional speakers require a huge mounting depth that render them useless in shallow spaces where consumers now wish to place speakers. For example, a conventional 10" diameter speaker, with an excursion of +/−1" requires a mounting depth of at least 7". Moreover 12" diameter conventional speakers requires a mounting depth of at least 7" to 8". Hence conventional speakers clearly will not fit in shallow spaces, such as walls where the mounting depth is limited to about 3.5", or less, unless a smaller diameter conventional speaker is used. Thus, consumer demand has created a need that conventional speakers can not meet and still provide the performance desired by the consumer. Therefore there is a need to develop loudspeakers that have a large piston area with a minimum mounting depth. Low profile speakers designed using the present invention meet that need.

Conventional speakers have many weaknesses that have become much more evident in longer stroke woofers. Since conventional speakers rely upon the glue ring connection of the cone with the voice coil bobbin and spider, that connection is subjected to bending moments that collapse the glue ring during downward (inner stroke movements) and flare outward the glue ring during outward strokes. Additionally, the structure of conventional speakers promotes harmonically related bending of the cone during inward/outward strokes that fatigues the inner portion of the cone and leads into what is known as a neck-cone failure. This typically, partially or completely, breaks the cone into two cones around the neck area. Prior to that type of failure the cone is known to have a cycle per life during which the cone is breaking down and during the slow breakdown of the cone, the conventional promotes increasing distortion that is increasingly unpleasant for the listener. Further conventional speakers have not been designed to maintain the inner suspension (spider) parallel to the outer suspension (surround) as the cone is driven by the voice coil. The spider and surround are each rigidly connected to the inner and outer edges of the cone, respectively, and any misalignment of those connections and/or variations in the material of the spider, surround and cone around the speaker cause the cone to twist in opposite directions as it is driven inward and outward, with the amount of that twisting increasing as the stroke of the voice coil bobbin increases in each direction. This connection configuration can only connection can only compromise such a structure this as the cone bends as it is moves and causes the twisting, or spiraling movement.

Another problem that results in reduced audio performance of conventional speakers is wobble of the voice coil during operation of the speaker. Current speaker design structures suffer from several compromising parts that play a major role in producing a high level of harmonic distortion. As it has been a trend in speaker design to get the most output out of a speaker opening, they resort to increasing the excursion in order to increase the amount air displacement. What previously was a 0.3" high voice coil are now 1.5" and as high as 2" winding heights of the voice coils. These increased height voice coils thus move in excess of 1" each way, inward and outward. Often speakers can be found where the movement is as much as 1.5" each way. During extreme excursions, these woofers are pushed by these long voice coils that weigh three times as much as in previous designs. The motor (voice coil) is connected to the cone and the spider in what is known as the inner suspension.

The cone is the stiff component relative to the suspension and surround, extending outward (generally) and connects the inner suspension to an outer larger diameter suspension. The combination of spider, cone, outer surround, and voice coil bobbin are interconnected to oscillate axially. When an audio signal with a frequency F is sent to the voice coil it develops a variable magnetic field that interacts with the fixed magnetic filed produced by the magnet assembly to produce an oscillating force. During these oscillations, the moving parts are subjected to a uniform internal pressure due to the compressed air in the enclosure and tension developed by the spider and surround. The spider and surround each have some manufacturing offset that tend to be apparent during long strokes as the moving elements will start to wobble. The cone typically is made of processed materials (e.g., pressed paper) thus the cone also possesses a non linear stiffness that leads to another offset. The combination of these offsets leads to wobble of the voice coil bobbin.

That wobble can distort the sound produced in varying degrees as the voice coil travels inward and outward in many ways, e.g., distorting the shape of the cone. Wobble can also reduce the useful life of a speaker by repeatedly over stressing the cone and other components that eventually results in failure of the component, e.g., a crack or a tear in the cone, partial separation of the cone and surround, etc.

Wobble can even result in total failure of the speaker. This can occur if the voice coil is over driven outward with the lower edge of the voice coil bobbin coming completely out of the magnet assembly with the wobble shifting the lower edge of the voice coil bobbin so that it is no longer aligned with the slot in the magnet assembly. The bottom edge of the voice coil bobbin then hangs up on the top of the magnet assembly as the tension in the spider and surround pull the cone and attached voice coil bobbin downward when the lower end of the voice coil bobbin does not reenter the magnet assembly. Once hung up on the top of the magnet assembly the speaker can no longer move regardless of whatever drive signal is applied to the voice coil since the voice coil is no longer in the magnetic field of the magnet assembly so the drive signal does not interact with the magnetic field, i.e., no signal when applied to the voice coil will be able to move the voice coil bobbin.

SUMMARY OF THE INVENTION

An aspect of the present invention provides an embodiment that provides a symmetrically loaded, shallow suspension speaker. In the speaker embodiments of the present invention, the symmetrically loaded, shallow suspension supports a substantially stiff diaphragm that functions similarly to the "cone" of the prior art. In the present invention the diaphragm, or cone, is made of a material such as honeycomb, thin aluminum, and other composite and non-composite light-weight materials; conventional cone materials will not work in this application since the diaphragm is substantially flat and light-weight. This flat diaphragm is suspended by the outermost edge with a suspension system that is entirely outside the diameter of the magnet, thus allowing the suspension to extend to nearly the bottom of the speaker basket on the maximum inward excursion of the voice coil and diaphragm. Thus, the suspension operational depth is not the limiting factor of the speaker basket design and the actual mounting depth of the speaker. Note that mounting depth and cone wobble control are interrelated in the speakers of the present invention; the closer the outer portion of the suspension is to an inner one, the chance of wobble increases as the the mounting depth of the speaker becomes shallower. As will be seen below in the detailed description of the various embodiments of the present invention, the elements of the suspension system of the present invention have been designed maximize the spacing between the inner and outer portions of the suspension system, thus minimizing the possibility of wobble in the low profile speakers of the present invention.

The various embodiments of the present invention permit the designer to maximize air movement in a given mounting depth with a configuration that optimizes the operation of the moving parts (i.e., diaphragm, suspension and voice coil) in the electromagnetic environment that complements the fixed mechanical structural configuration of the non-moving parts. In one embodiment, this invention allows the designer to have an over excursion (outward/inward limiter) that is optimized with the available mounting depth. For example, the present invention allows the designer to have a 15" diameter speaker that fits in a mounting depth of as little as 3.5" with a diaphragm excursion of approximately ±1", while a conventional speaker with the same size working piston requires a mounting depth of 6" to 7".

The present invention also includes several embodiments that allow the user of the speaker to replace the voice coil, or the voice coil and the cone or diaphragm, should they becomes damaged. This would be an attractive option for performers that have a speaker fail during a performance when a speaker is over-driven or dropped.

Yet another embodiment of the present invention provides a speaker that is designed to substantially eliminate wobble of the voice coil during operation, and thus remove that source of distortion and early failure of the speaker. This is accomplished with the creation of triangular ring that extends upward from the top edge of the voice coil bobbin with that ring mating with a flat diaphragm at a right angle directly above the top edge of the bobbin. The outer edge of the diaphragm connects to the inner edge of the surround at the point where a sloping side of the "triangle" is also connected and slopes down to the top edge of the bobbin where the opposite end is connected. The outer portion of the diaphragm provides the third side of the triangle.

BRIEF DESCRIPTION OF THE DRAWINGS

FIG. 25A shows a cross sectional view of one elastic membrane of a set of two which support a mass from a frame for a passive speaker, the design includes two examples of using one large roll to span a large gap to provide a large stroke for the vibrating mass;

FIG. 25B shows across sectional view of one elastic membrane of a set of two which support a mass from a frame for a low profile passive speaker, the design includes three surround rolls having substantially equal roll diameter;

FIG. 25C shows a cross sectional view of one elastic membrane of a set of two which support a mass from a frame for a low profile passive speaker, the design includes three surround rolls utilizing progressively smaller surround roll diameters as the elastic membrane moves from the perimeter frame to the center mass;

DETAILED DESCRIPTION

Figure 7:
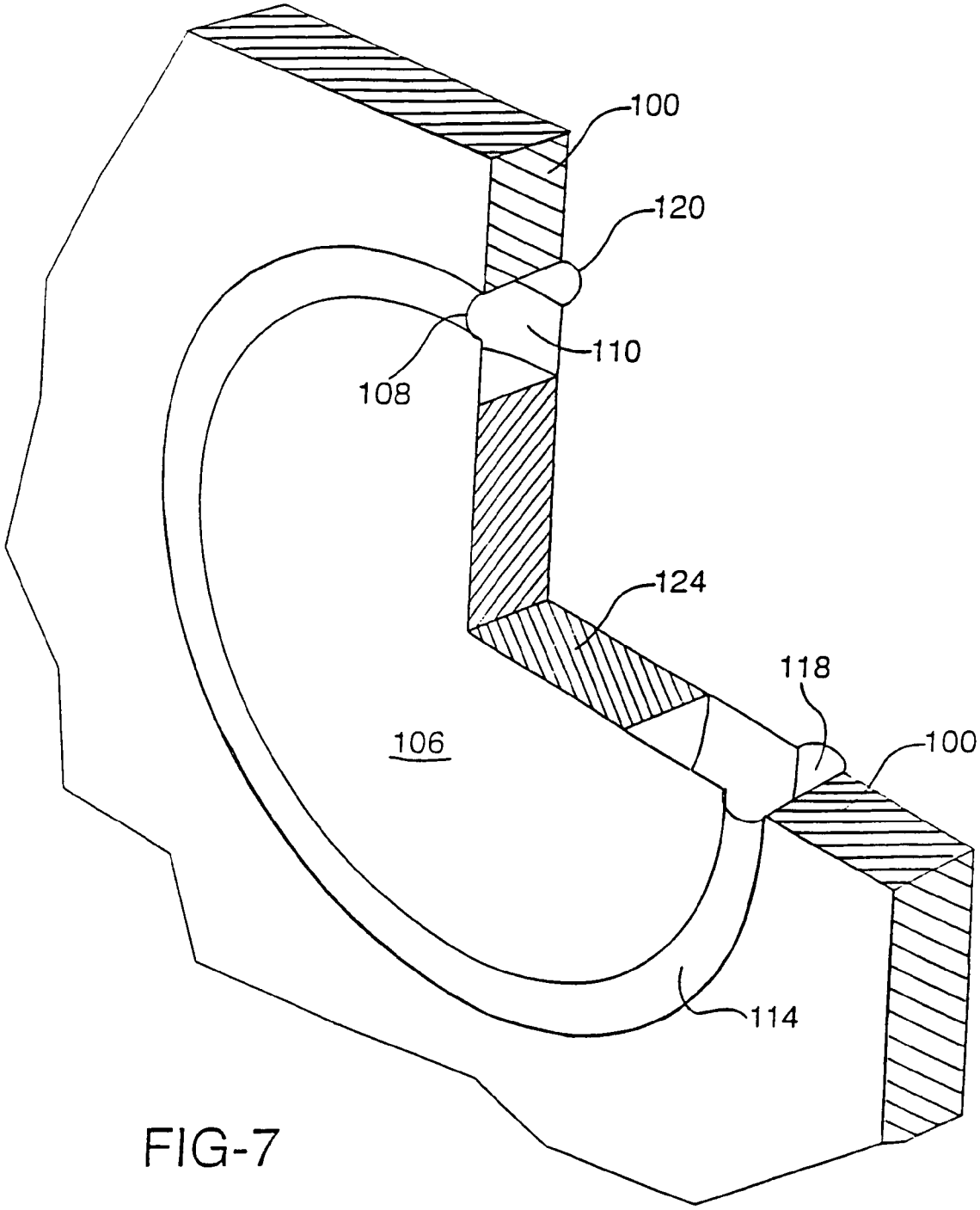
FIG. 7 shows an isometric cut away view of a configuration according to the invention.
Figure 8:
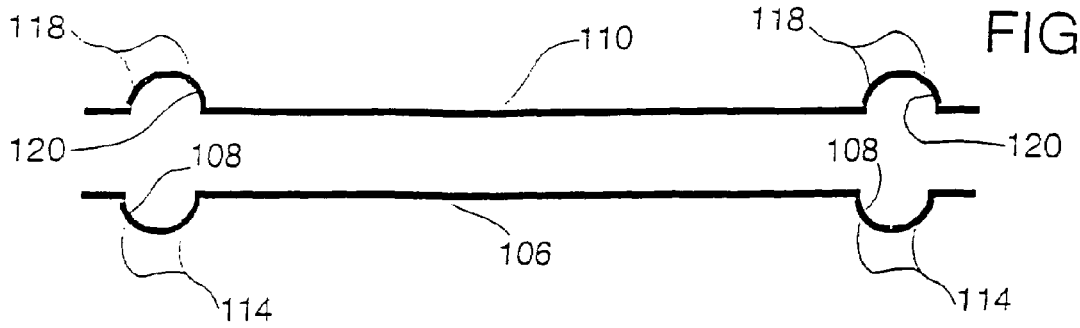
FIG. 8 shows a cross-sectional view of a diaphragm plate fixed to a surround which in turn is fixed to an external ring. Prior to their assembly into a configuration according to the present invention.

An embodiment according to the invention is shown is FIG. 7. A speaker box which acts as an integral speaker support ring 100 is a circular opening in a speaker box. To the speaker box at one edge of its wall is attached an inner surround 114 which has at its inner perimeter an inner diaphragm 106. At the outer wall of the speaker box 100, an outer surround 118 is attached with its inner perimeter fixed to an outer diaphragm 110. A connecting member (or mass) 124 is fixed between the two diaphragms 106, 110 so that the two move together in parallel as the sound pressure due to the frequencies in the sealed box causes the displacement of the two diaphragms simultaneous and in parallel. The inner and outer surrounds 114, 118 are configured so that the arch of 108 of the inner surround projects inwardly while the arch 120 of the outer surround 118 projects outwardly. In short, the center diaphragms 106, 110 and connection member 124 are supported only by the surrounds 114, 118 and the arches 108, 120 of the surrounds project in opposite directions.

In a normal speaker configuration where only one surround is used. e.g., at the perimeter of a speaker cone, there is a non-linear characteristic in the restoring force relative to displacement for a normal half circle type surround. The restoring force is the force that restores the speaker assembly to its neutral position for example during transportation and/or when the speaker is not in use. The non-linearity of the stressing of the inside surface of the arch versus the outside surface of the arch as the surround is stretch by the displacement of a center disk or speaker cone creates a small but detectable distortion. In such arrangements increased air pressure due to the sound waves does not move the diaphragm at the same rate when subject to similar pressure gradients, but rather the air starts to become compressed and generate reflected pulses as a result of the non-movement or slower movement of the diaphragm due to the different displacement rates. As the diaphragm in the passive radiator is exposed to air pressure due to sound volume, the use of two oppositely facing surrounds provide an effective compromise and an improvement over the use of the single surround by providing an approximately linear pressure to displacement relationship irrespective of whether a sound wave is positive (for example, causing the diaphragm to move out) or negative (for example, causing the diaphragm to move inward).

Figure 10:
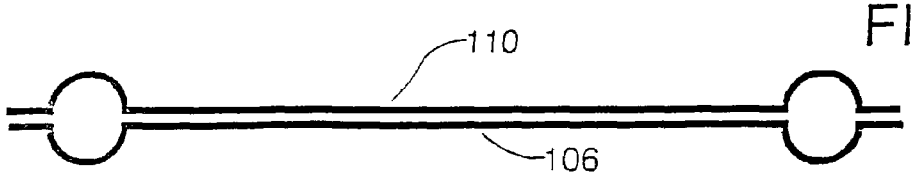
FIG. 10 shows a configuration according to the invention where the two diaphragm plates are fixed one to the other.
Figure 11:
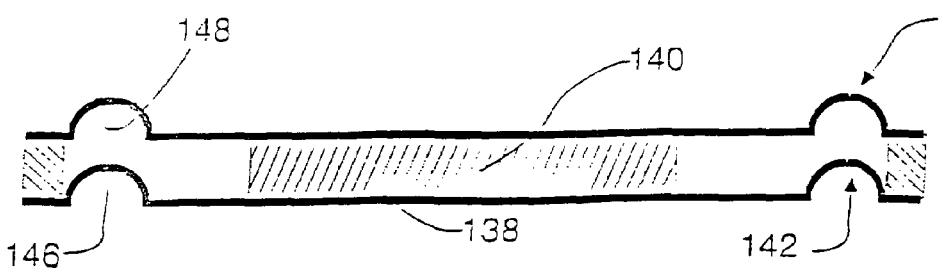
FIG. 11 shows an alternate configuration according to the invention where the arches of the speaker surround project in the same direction.

The use of two oppositely facing surrounds which are fixed to each other and with virtually no separation, for example, as shown in FIG. 10 provide a benefit over the prior art in that the spring constant in the full range of travel from the extreme negative through the neutral (or balanced condition) position to the extreme positive is much closer to linear than when using a single surround alone. However, in the configuration of FIG. 10, wobbling (defined as non-uniform displacement of the diaphragm) of the surround around its perimeter, for example, if a sound pressure wave were to come not perpendicularly into the diaphragm but at an acute angle from one side, then one side of the diaphragm could be preferentially displaced more than the other side at least momentarily this wobble could cause an undesired reflective wave and sound interference which is out of phase with the primary frequency. However, in instances where such a passive radiator is mounted directly opposite a single driver or a group of generally symmetrically arranged drivers, e.g., as in the Klasco patent discussed above, the configuration of FIG. 10 provides a noticeable if not distinct advantage over configurations where only a single surround using a speaker cone is used. Further, the flat surface of the diaphragm provides no transverse surface against which a transverse component of a pressure wave vector could cause lateral translation of the diaphragm as it could in a the prior art where the speaker cone provides a substantial laterally extending surface, which accentuates any wobble that is experienced.

Figure 9:
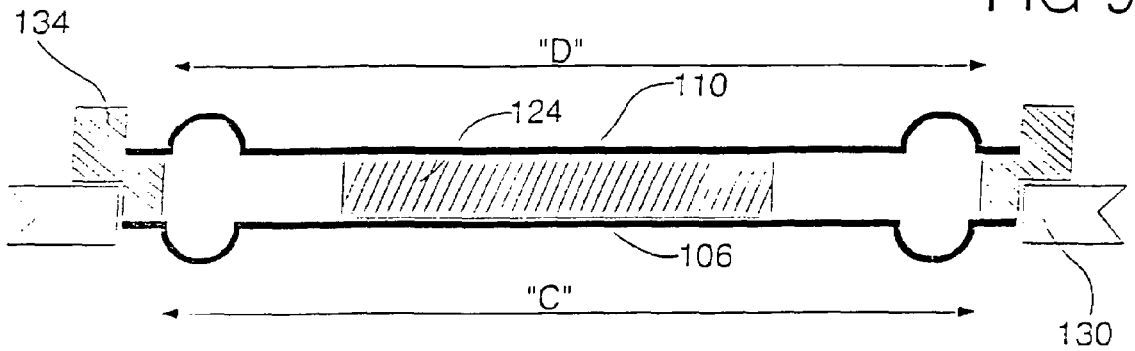
FIG. 9 shows a configuration according to the present invention fixed in a speaker wall.

A configuration according to the present invention has the additional advantage of eliminating the wobble problem by the use of a parallelogram-type parallel link arrangement where the two diaphragms 106, 110 each have their perimeters act as two ends of a fixed link of a parallelogram type linkage. A second set of fixed links are the corresponding inner and outer walls to which the outside perimeter of the surrounds 114, 118 are fixed. The moveable links connecting the two fixed links are the surrounds which extend between the perimeter of the central diaphragm 106, 110 and the inner perimeter of the outer ring for example, 134 in FIG. 9. Using this configuration will reduce any wobble by creating additional resistance to a wobbling effect due to the two surrounds being mounted in parallel at the end of what effectively amounts to an elastically extendible pivoting lever arm. Thus any configuration according to the invention for example as shown in FIG. 9, where a 45 degree sound wave corning into the central diaphragm would be resisted by both sets of surrounds such that predominately linear motion perpendicular to the face of the diaphragms would occur. The motion of the central diaphragm assembly while not completely limited to a linear back and forth motions is severely constrained to move easily only back and forth perpendicular to the diaphragms 106, 110 absent a strong transverse force vector. Similarly, the flat face of the diaphragm rigidly resists pressure pulses having force vectors which are parallel to its face, while it is very easily movable in a direction perpendicular to its face when impacted by sound pulses having force vectors with directional components perpendicular to the face of the diaphragm. In this way, an improved passive radiator can be constructed and used. While in the Figures shown, the ratio of the inner and outer diaphragm support openings are substantially equal, (i.e., they have a ratio of approximately 1), it is possible to construct passive radiators according to the invention where the ratio of the smaller diaphragm connection opening to the larger diaphragm connection opening is approximately 0.8 or greater (e.g., distance "C" on one side of the opening will be different than the distance "D" by a ratio of the smaller to the larger of 0.8).

The construction of the passive radiator is quite simple as shown in FIGS. 7, 8, 9, 10 and 11. The outside edge of the surrounds can be fixed directly to a sealed cavity or can be fixed to a surround support ring 134 which in turn is then fixed to a speaker enclosure wall 130. Some combination of elements to hold the outer ring and allow the center to move freely from its neutral position must be found.

An alternative configuration using a series of surrounds 142, 144 provides that the arches of 146, 148 such surround must extend in a single direction. This configuration while not optimum does provide the advantage over the prior art of eliminating or substantially eliminating the wobble problem referred to earlier. In a configuration as shown, the spring constants will be unequal and the non-linearity of the spring constant plot will be attenuated by the use of two surrounds whose spring constants add to exacerbate their distortion from linear.

Figure 12:
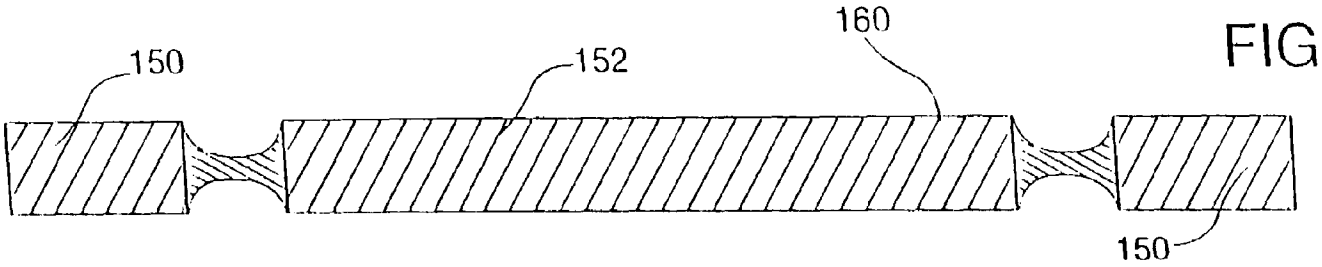
FIGS. 12, 13 and 14 show cross sectional views of several alternate embodiments according to the invention, where the wall of the speaker cabinet is used as the flat central core member of the passive radiator in a speaker system.

FIG. 12 shows an alternate embodiment according to the invention, a speaker cabinet wall 150, initially one piece, has circular slot routed into it thus separating a centerpiece 152 from the speaker cabinet wall 150. The round centerpiece 152 is centered in the opening of the cabinet wall and a wide contoured bead of filler material (e.g., silicon rubber) is run between the inside of the outer opening of the wall and the outside of the centerpiece 152. The cross sectional shape of the filler material is such that it retains an elastic character once cured. The cross section shown is commonly found in elastic seals between building joints where substantial movement is expected.

Figure 13:
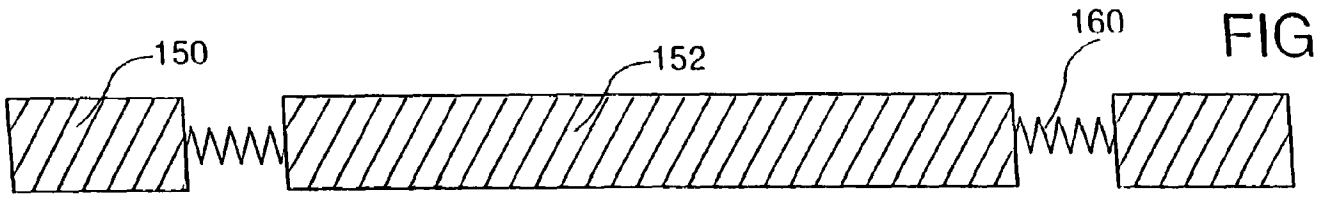

FIG. 13 pictures a spider type elastic member 160 having been placed between the centerpiece 152 and the speaker cabinet wall 150, as described for FIG. 12 above.

Figure 14:
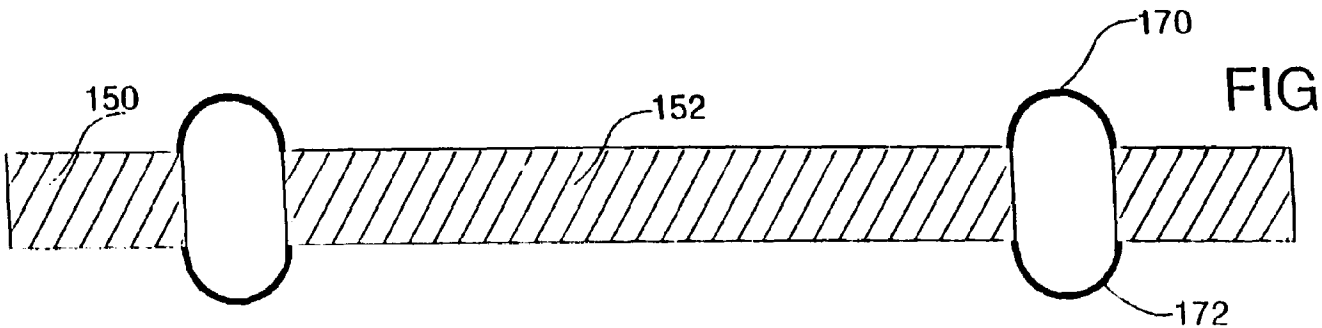

FIG. 14 pictures an alternate embodiment where a set of two surrounds 170, 172, provide the elastic connection between the speaker cabinet wall 150 and the centerpiece 152. While a round shape is preferred, the use of a less efficient shape is in accordance with the invention, for example a polygon or a compound curve shape may be used. A centerpiece thickness in excess of 0.25 inches is preferable to help maintain a linear movement and reduce or eliminate any wobble that may occur.

Figure 1:
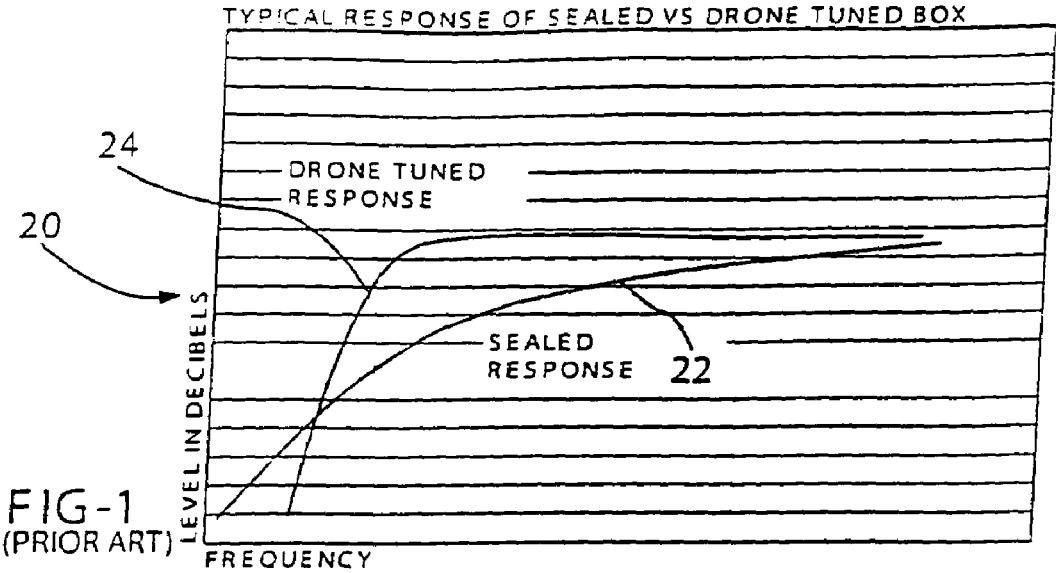
FIG-1 (PRIOR ART)
FIG. 1 is a plot of frequency response versus sound level in decibels showing the response of a sealed speaker box and a conventional droned tuned speaker box.
Figure 2:
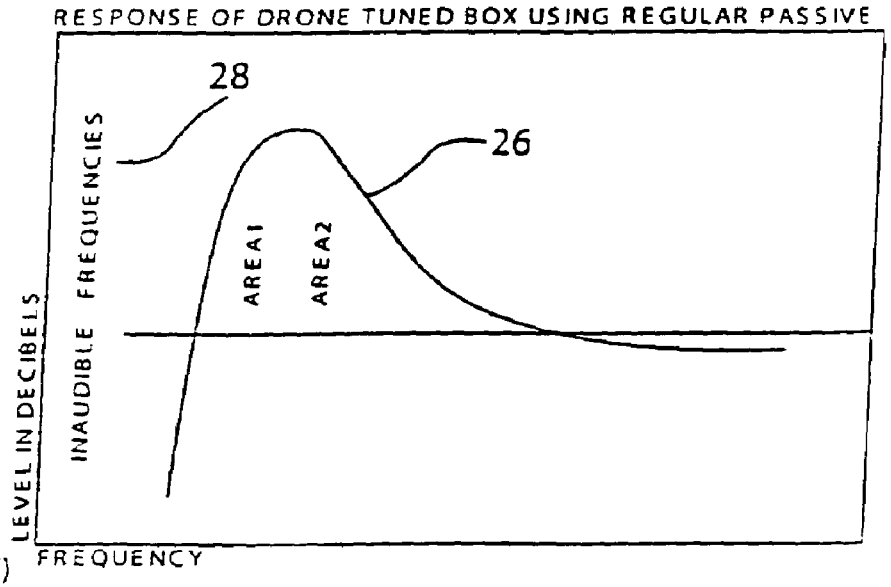
FIG-2 (PRIOR ART)
FIG. 2 is a frequency response graft showing the plot of the frequency response contribution from a passive radiator to the total tuned response in a speaker box system.
Figure 3:
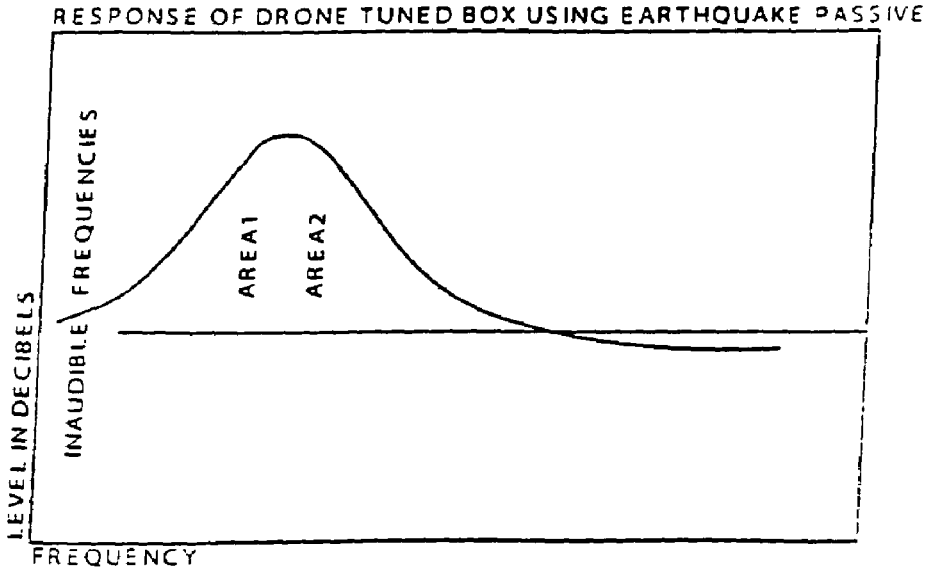
FIG. 3 is a frequency curve showing a plot of the frequency response using a device according to the present invention.

A review of the plot as shown in FIG. 3 shows that the frequency response of a tuned passive radiator according to the invention extends the usable frequency range from the low audible to the inaudible range of frequencies. All audible frequencies can be heard and the inaudible frequencies for example, an earth shake or pounding can be generated by such speakers so that the user can "feel" the vibration as the user's surroundings susceptible to such low frequency waves start to vibrate. The use of such speaker enhancing device is very attractive to sophisticated users as well as the general public in viewing many action movies that feature such low frequency sounds.

An aspect of the present invention further enhances the sound performance. The closure of spaces between opposing surround rolls can cause a high pressure secondary cabinet that slows down the response. A pressure relief system is provided to allow the air trapped between two diaphragms to have the same pressure as that in the speaker box (or alternately outside the speaker box) via port holes that are large enough to keep the air speed through these holes under 1% of the speed of sound with a va1ue of about 12 ft/second. Since these numbers are worse at the passive resonance frequency, this calculation can be optimized for the maximum excursion calculation. The pressure relief port can be implemented best through holes in the inner surround that leak air directly into the speaker box.

Figure 15:
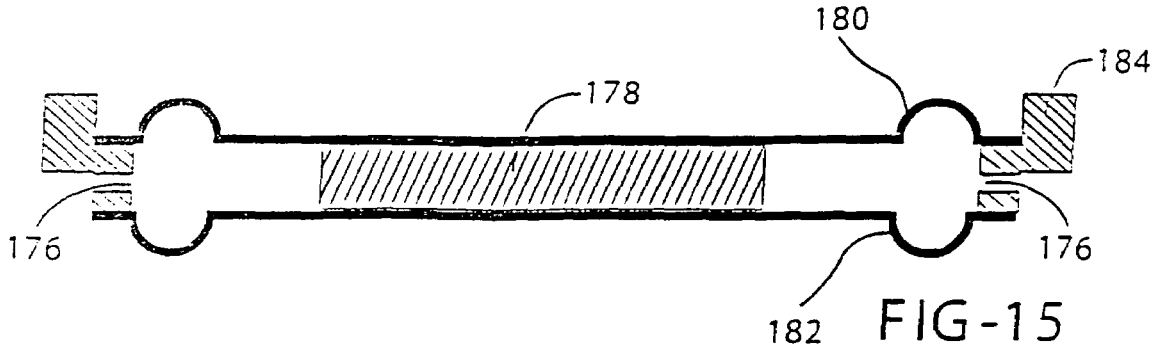
FIGS. 15, 16 and 17 show a schematic cross sectional configuration where the embodiment of FIG. 9 has been modified and configured with features which enhance in several different ways the passive speaker design.
Figure 16:
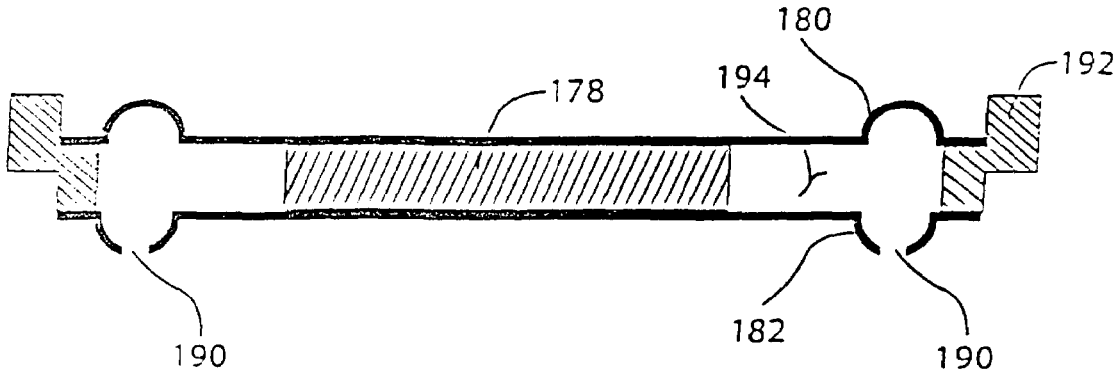
Figure 17:
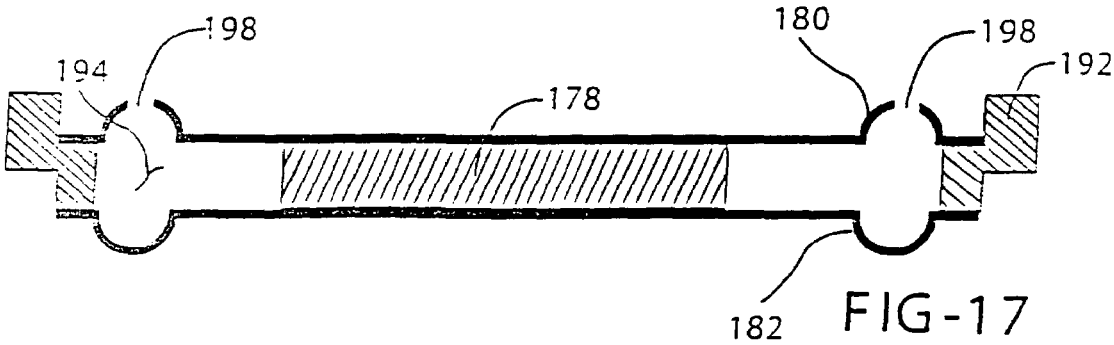
Figure 18:
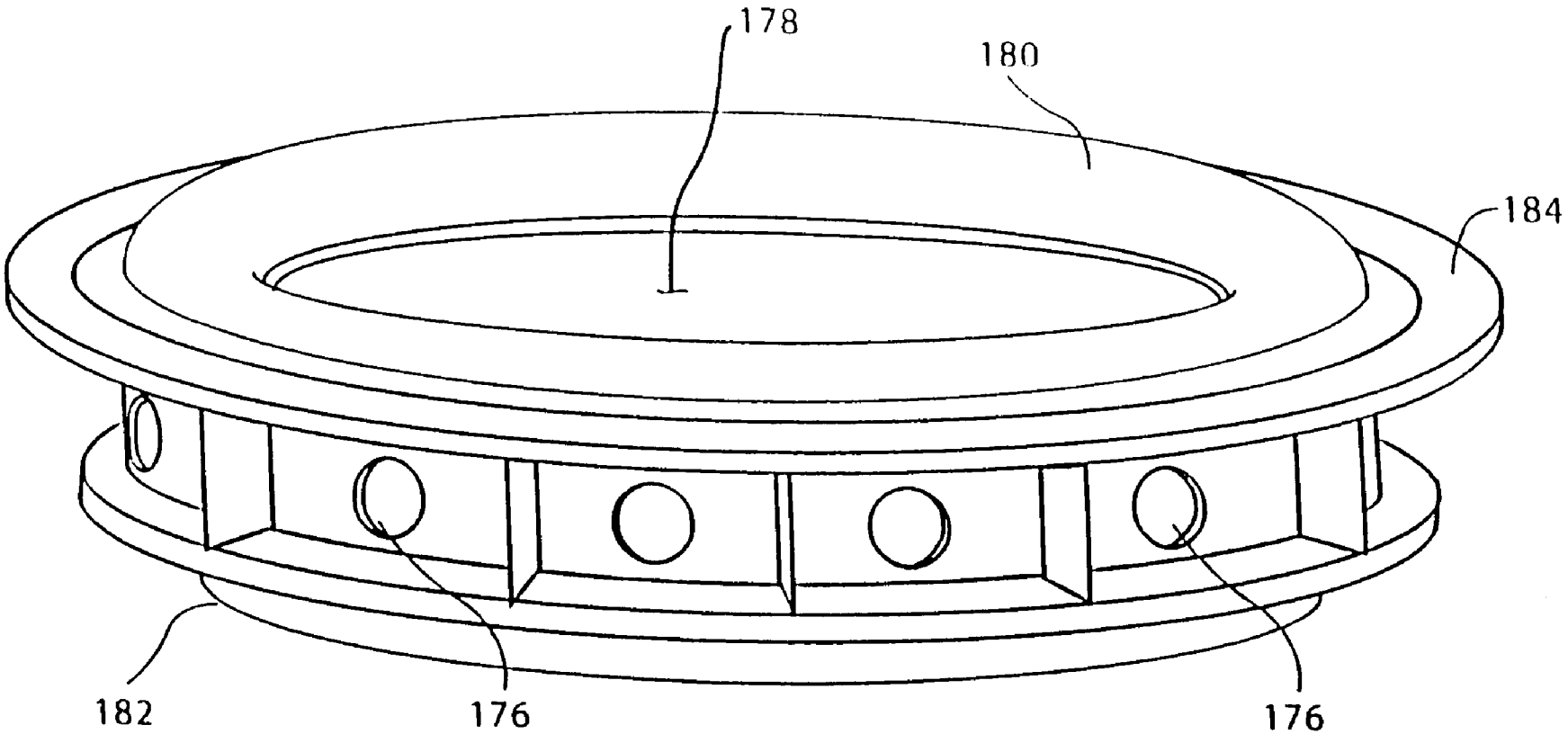
FIG. 18 shows a perspective view of a passive speaker according to the invention incorporating frame vent holes as one aspect of the invention.

FIGS. 15, 16 and 17 show several ways that an air vent (pressure relief system) according to the invention can be implemented. FIG. 15 shows in cross section vent holes 176 disposed to provide one or more passages from the air space between the center mass 178, the outer elastic member (surround) 180, the inner elastic member (surround) 182, and the outside frame 184, which can form a pressurizable chamber, through the frame 184. These same holes 176 are shown in the perspective view of FIG. 18 and again in the cross sectional perspective view of FIG. 19. In the schematic views in particular, it appears that the holes 176, in use, are situated to be nearly sealed against the surrounding wall hole opening of the speaker box in which the passive radiator might be mounted. To operate without noise and undue damping there must be a space between the hole of the speaker box in which such a configuration is mounted and the perimeter of the radiator frame 184 facing it, so that air can pass freely at speeds below 2% of the speed of sound.

FIG. 16 shows a schematic cross sectional view of an alternate configuration for maintaining parallelism as the center mass moves back and forth due to speaker box pressures while still providing for improved response and large travel due to a pressure extremes. A series of holes (or slits) 190 are disposed approximately equally spaced around the annular ring of the inside surround 182. The holes 190 in this configuration are open to the inside of a speaker box and act as a vent to prevent the build up of pressure in the surround contained air space 194. In the this configuration an outside frame flange 192 is solid.

Figure 20:
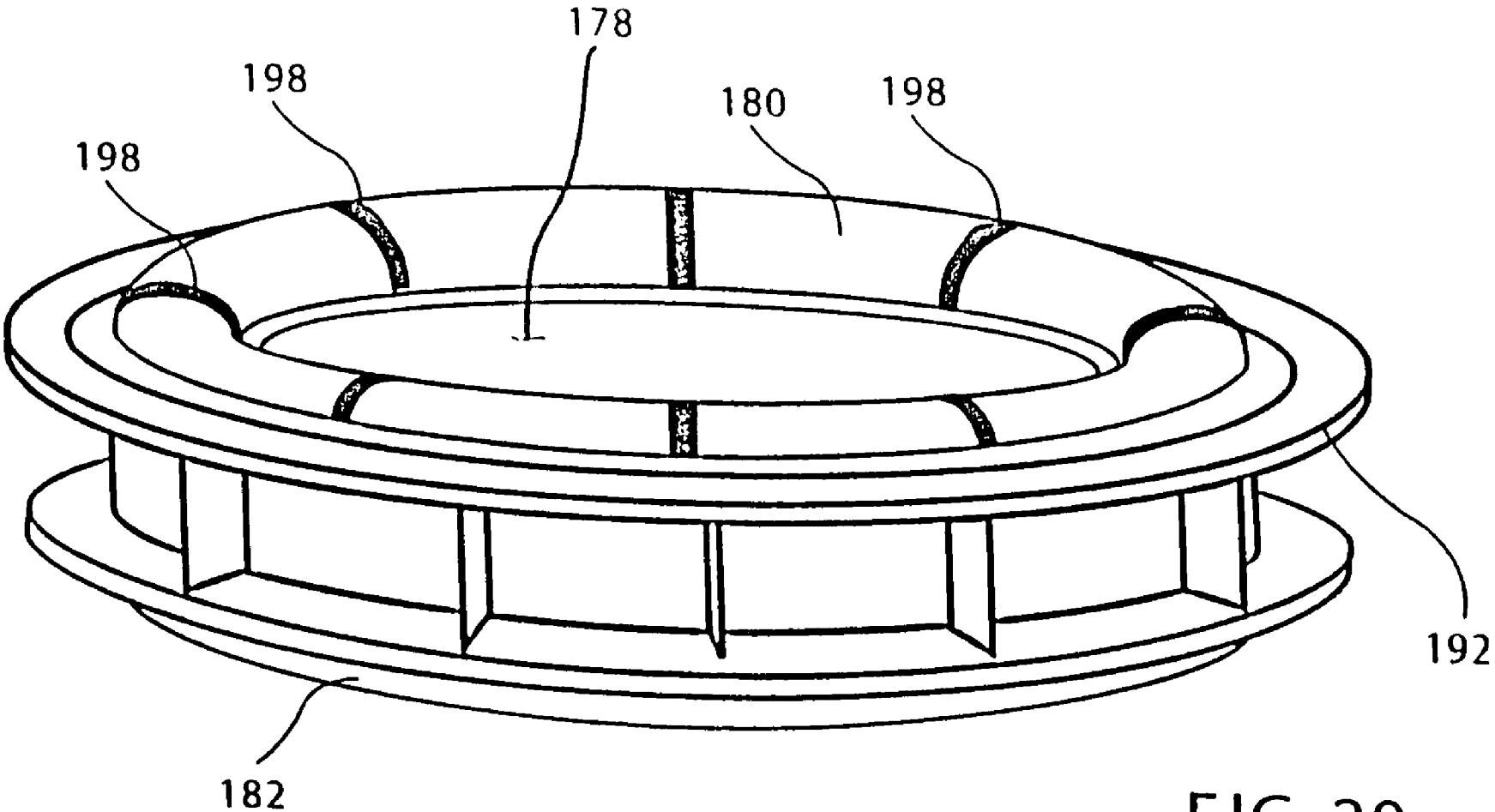
FIG. 20 shows a perspective view of a passive speaker according to the invention incorporating surround openings (slits) as vent holes as one aspect of the invention.
Figure 21:
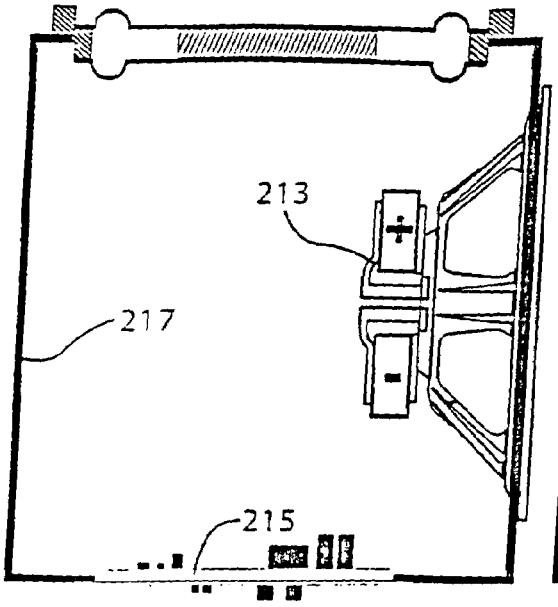
FIG. 21 shows a schematic cross sectional view of a speaker box utilizing a passive speaker design according the invention.
Figure 22:
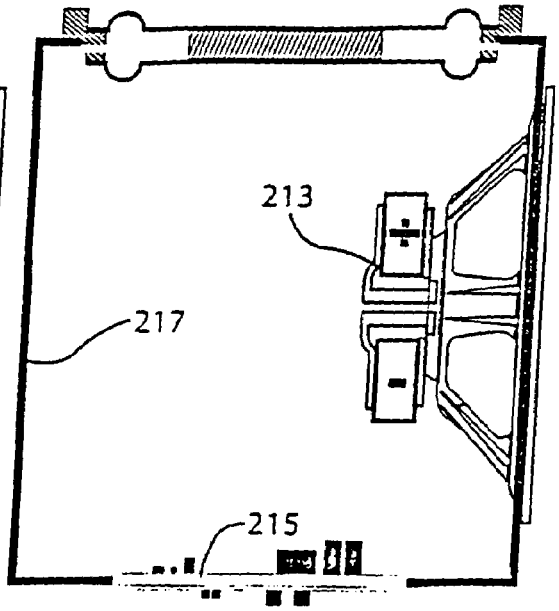
FIG. 22 shows a schematic cross sectional view of a speaker box utilizing a passive speaker with through the frame vent holes in a design according the invention.
Figure 23:
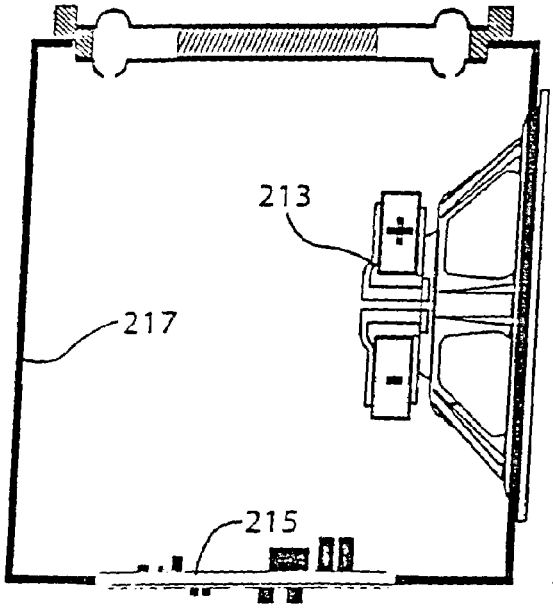
FIG. 23 shows a schematic cross sectional view of a speaker box utilizing a passive speaker with through the surround vent holes communicating with the inside of the speaker box enclosure in a design according the invention.
Figure 24:
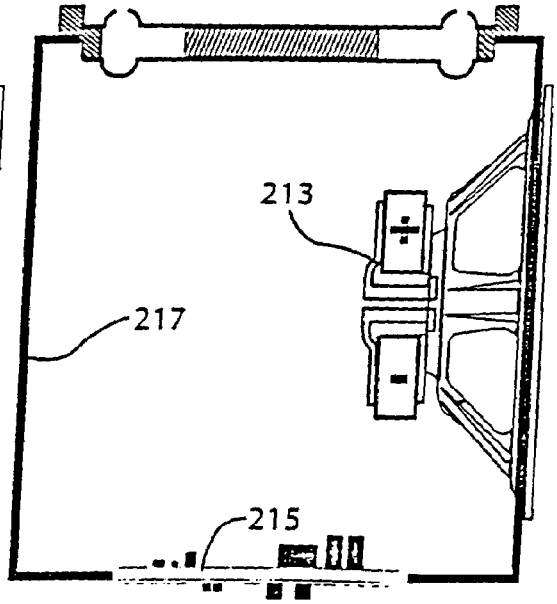
FIG. 24 shows a schematic cross sectional view of a speaker box utilizing a passive speaker with through the surround vent holes communicating with the outside of the speaker box enclosure in a design according the invention.

FIG. 17 shows a schematic cross sectional view similar to the configuration shown in FIG. 16. In this embodiment 1 here are a series of holes (or slits) 198 which are disposed approximately equally around the annular ring of the outside surround 180. The configuration of these holes 198 is also shown in FIG. 20, which shows a perspective view of this configuration. The holes 198 in this configuration are open to the outside of a speaker box and act as a vent to prevent the buildup of pressure in the surround contained air space 198.

Figure 19:
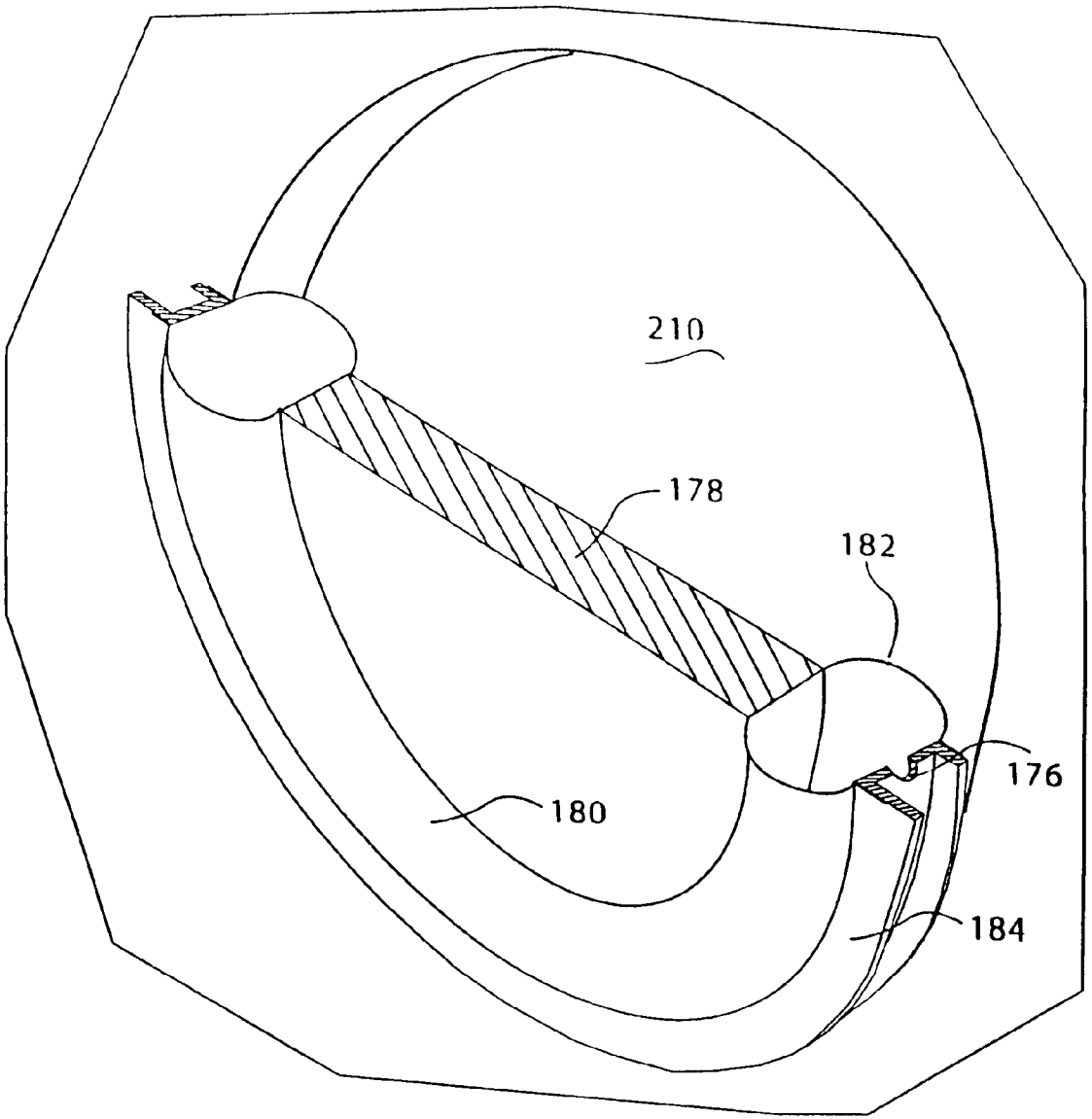
FIG. 19 shows a cross sectional perspective view of a frame side vent holed configuration as shown in FIG. 18.

FIG. 19 shows the passive radiator relationship to its mounting to a speaker box opening 210. In this configuration the outside frame 184 has two flanges, one smaller in diameter (which fits into the speaker box opening 210) and a second one that is larger in diameter that seals to the surface around the speaker box opening.

FIGS. 21, 22, 23 and 24 show arrangements of a speaker (high pressure box) box containing a driver (speaker) 213 and an amplifier frame with amplifier circuitry 215 fixed to the speaker box 217 (in these instances the frame is sealed to an opening of said speaker box with heat sink elements of the amplifier outside the box). Each of these speaker boxes includes an opening for receiving a passive radiator according to the invention. Passive radiators as shown and described in FIGS. 9, 15, 16 and 17 are shown positioned in the passive radiator opening of the speaker box as pictured in FIGS. 21, 22, 23 and 24, respectively.

Progressive Surround Roll Radiator Construction

An aspect of the present invention that utilizes low profile large stroke passive radiators includes the use of a progressive roll system that further enhances the performance of passive radiator design.

Low frequency instruments emanate sound waves via vibration of diaphragms. These diaphragms oscillate at a low frequency. The oscillations have maximum amplitude in the center of the diaphragm with a proportionally reduced oscillation across the diaphragm with no oscillatory motion at the diaphragm frame. The dynamic oscillatory activity associated with a bass drum is useful in illustrating the dynamic relationship between the oscillating diaphragm and the emanating sound wave.

When a drummer strikes the center of the bass drum, the striking force bends the diaphragm inward such that the diaphragm shape is no longer flat, but is deformed in an approximation of a cone or sphere. The pressure inside the drum increases and is transferred to the other side of the drum, and results in an outward movement of the diaphragm. The tension and the phase angle of the sound wave as they bounce back and forth allow the signal to decay in a harmonic fashion. The decay time is directly related to the diaphragm diameter, tension and the distance between the two diaphragms at any fixed frequency. Utilizing the apparatus and methods according the invention provides that opportunity to approach a bass drum sound when using relatively smaller 12" and 15" speakers. To approach the desired condition the passive radiator is matched with the speaker has to be tuned low enough and has to move out axially to produce the same air movement, i.e., SPL at any given frequency is strictly related to the quantity of air moved at that frequency. The quality of sound must also be maintained. The quality of sound is measured by the group delay. A group delay is the time versus frequency curve that describe the response time delay at any given frequency. A 20 ms delay at 20 Hz is said to be audible distortion. Group delay is directly proportional to the diaphragm excursion. A long excursion creates long group delays.

Figure 25:
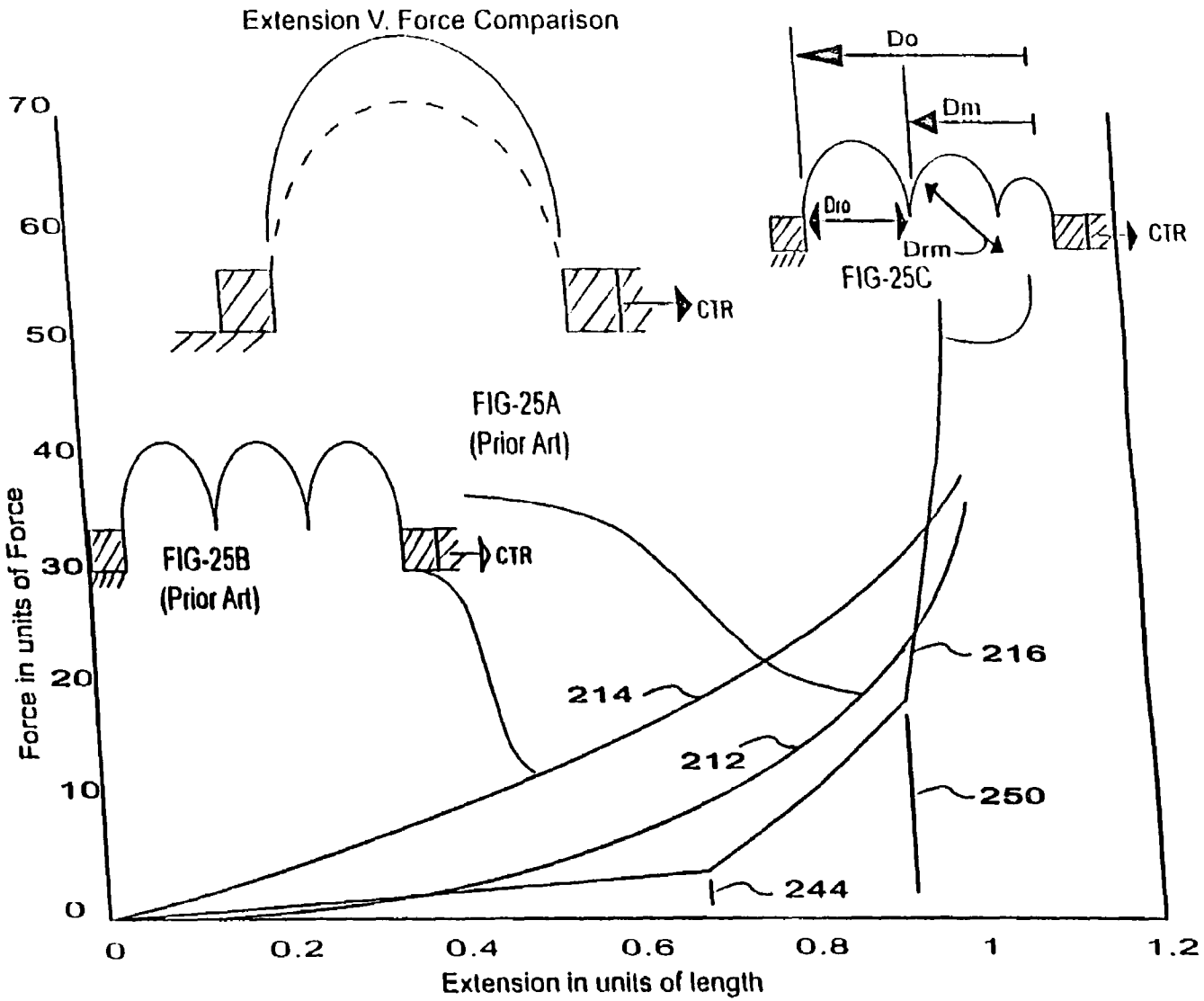
FIG. 25 shows plots of surround extension versus force for several configurations (as shown in FIGS. 25A, 25B and 25C) of large displacement passive radiators to show a comparison of generalized behavior when the progressive roll embodiment of the present design is compared with several alternatives.

One example of a surround structure used in a speaker is to used a single large, surround, a cross section of which is pictured in FIG. 25A. The single surround provides a large axial stroke and an even larger stroke if a an elliptical cross section (as shown by the solid line) as opposed to the circular cross section (as shown by the dashed line) is used. While this configuration has a good potential for large axial movements, the large roll diameter allows side to side instability at even small increments of axial excursion. A plot of relative excursion versus relative force for an approximation of an elliptical surround configuration is shown as curve 212 as pictured in FIG. 25. The restoring force is relatively small at small axial displacements (extensions) and rises rapidly as the extension increases.

Figure 4:
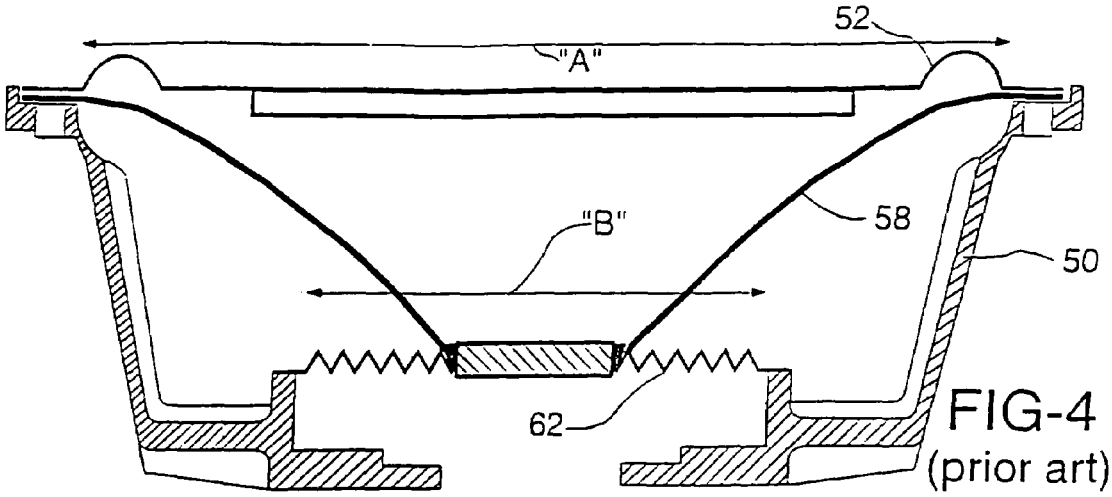
FIG-4 (prior art)
FIG. 4 is across sectional view of the prior art passive radiator supporting masses at both the base of the cone and on a diaphragm spanning the large opening of the cone at the base of the speaker.
Figure 5:
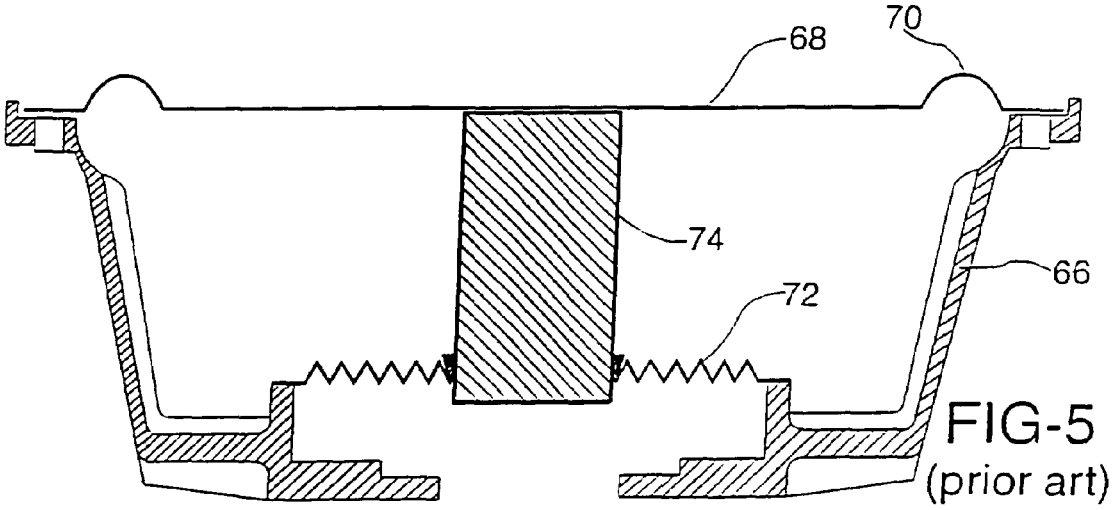
FIG-5 (prior art)
FIG. 5 is a cross-sectional view of a prior art passive radiator showing a moveable diaphragm connected to a speaker surround at the mouth of the speaker basket to a speaker spider at the back of the speaker basket.
Figure 6:
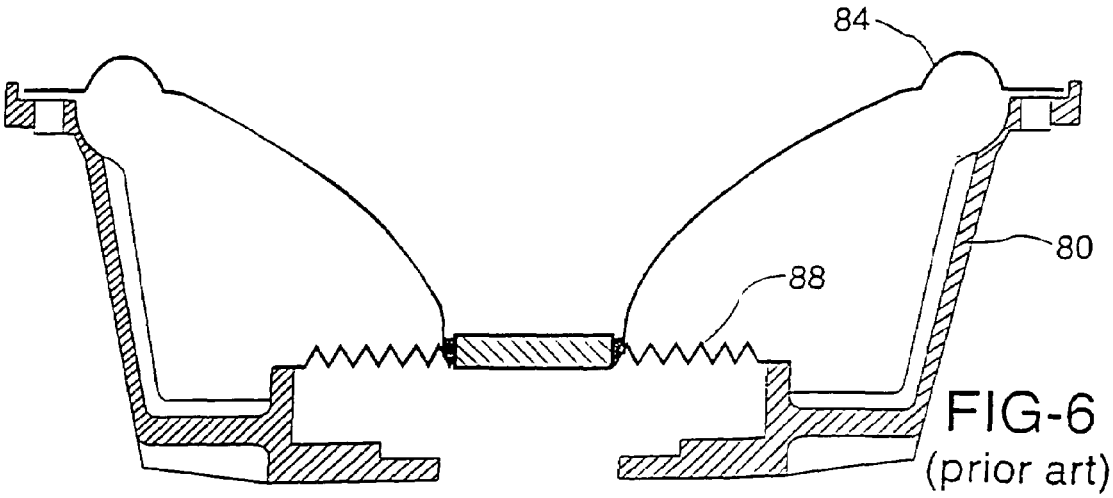
FIG-6 (prior art)
FIG. 6 shows a cross-section of a prior an passive radiator showing a speaker cone with a tuning mask at its base connected to the spider to the speaker basket at its narrow end connected through a surround to its wide end of the speaker basket.

A second example of a surround structure is the use of what are known as an "m" surround (two or more side by side surrounds). FIG. 25B shows such a structure where three smaller roll diameter surrounds are joined in a concentric circle pattern with the intent to achieve a large excursion—like the one shown for the single surround of FIG. 25A—with a lower profile. A plot of relative excursion versus relative force for an approximation of the three side by side surround arrangement is shown by the plot 214 shown in FIG. 4. The restoring force at low excursion (extension) dimensions is greater than that for a single elliptical surround as shown in FIG. 25A.

Figures 26A, 26B, 27A, 27B:
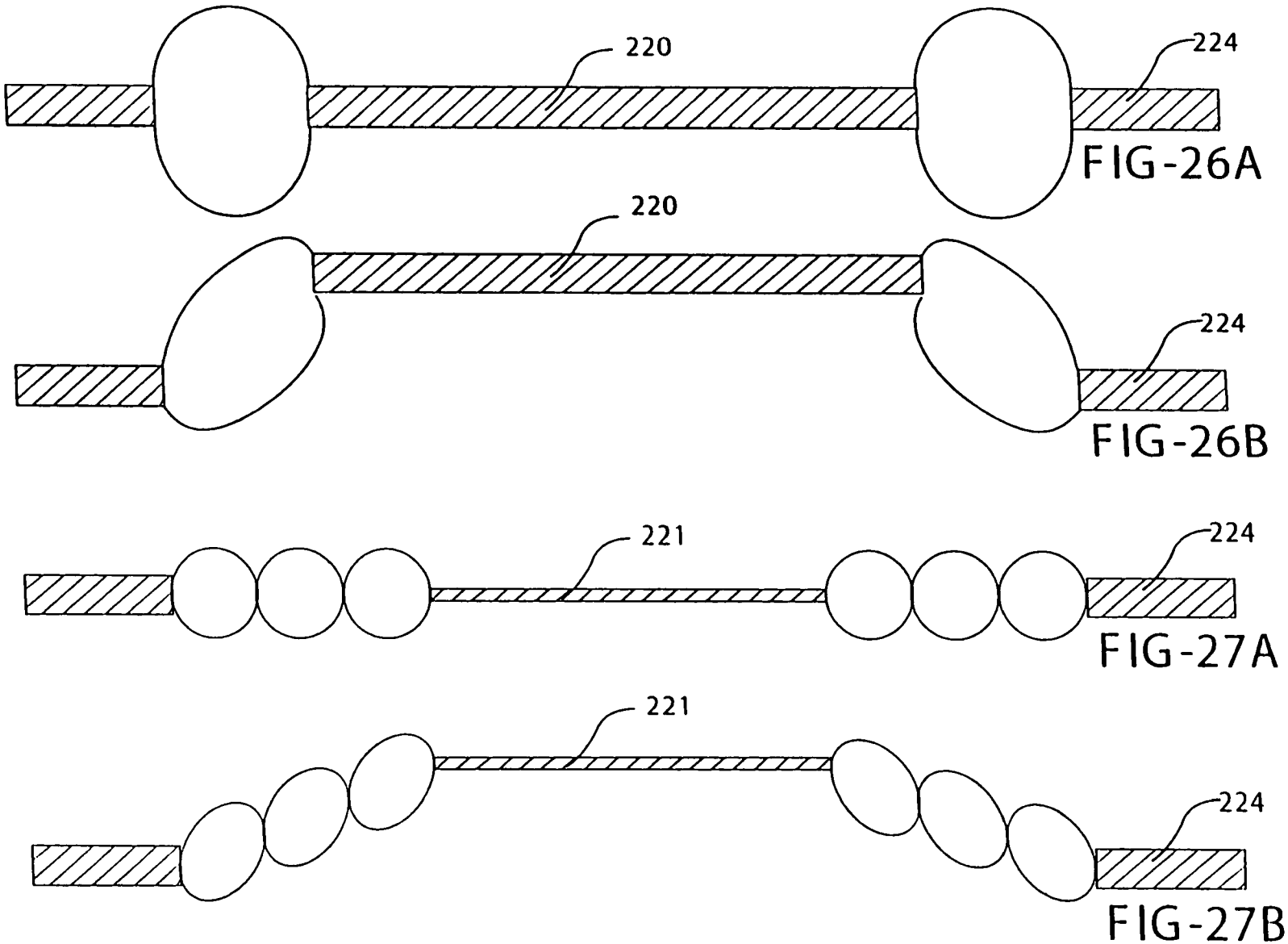
FIGS. 26A and 26B show cross sectional schematic views of the single surround large gap arrangement as shown in FIG. 25A, the relaxed state is shown in FIG. 26A and a nearly-fully extended state is shown in FIG. 26B.
FIGS. 27A and 27B show cross sectional schematic views of the three equally sized roll diameter surround arrangement as shown in FIG. 25B, the relaxed state is shown in FIG. 27A and a nearly fully extended state is shown in FIG. 27B.

A set of cross sectional views of a passive speaker arrangement using the single large surround and the three small surrounds (of FIGS. 25A and 25B) in a relaxed state is shown in FIGS. 26A and 27A, respectively, and in their fully extended state in FIGS. 26B and 27B, respectively. What is noteworthy about reviewing these passive radiator arrangements is that while their relative force versus extension curves are relatively straightforward (though non-linear) and similar, the excursion in the axial direction of motion is distributed substantially uniformly over the whole span of the gap between the centerpiece (220 or 221) and the outer frame 224. This uniform distribution of the strain (extension or excursion) correlates to a lateral (side to side) instability (wobble) of the centerpieces even at small excursions associated with small sound pressure levels. And any instability introduced at small excursions is amplified as the magnitude of the excursion increases.

To optimize an apparatus according to the present invention large qualities of air must be moved, but using the shortest most even diaphragm possible, like a bass drum. The diaphragm movement must decay uniformly at the side, i.e., as the diaphragm approaches the stationary frame. The movements must be axial and not side to side as such movements will cause a wobble that produces audible distortion.

Figures 28, 28A, 28B, 28C:
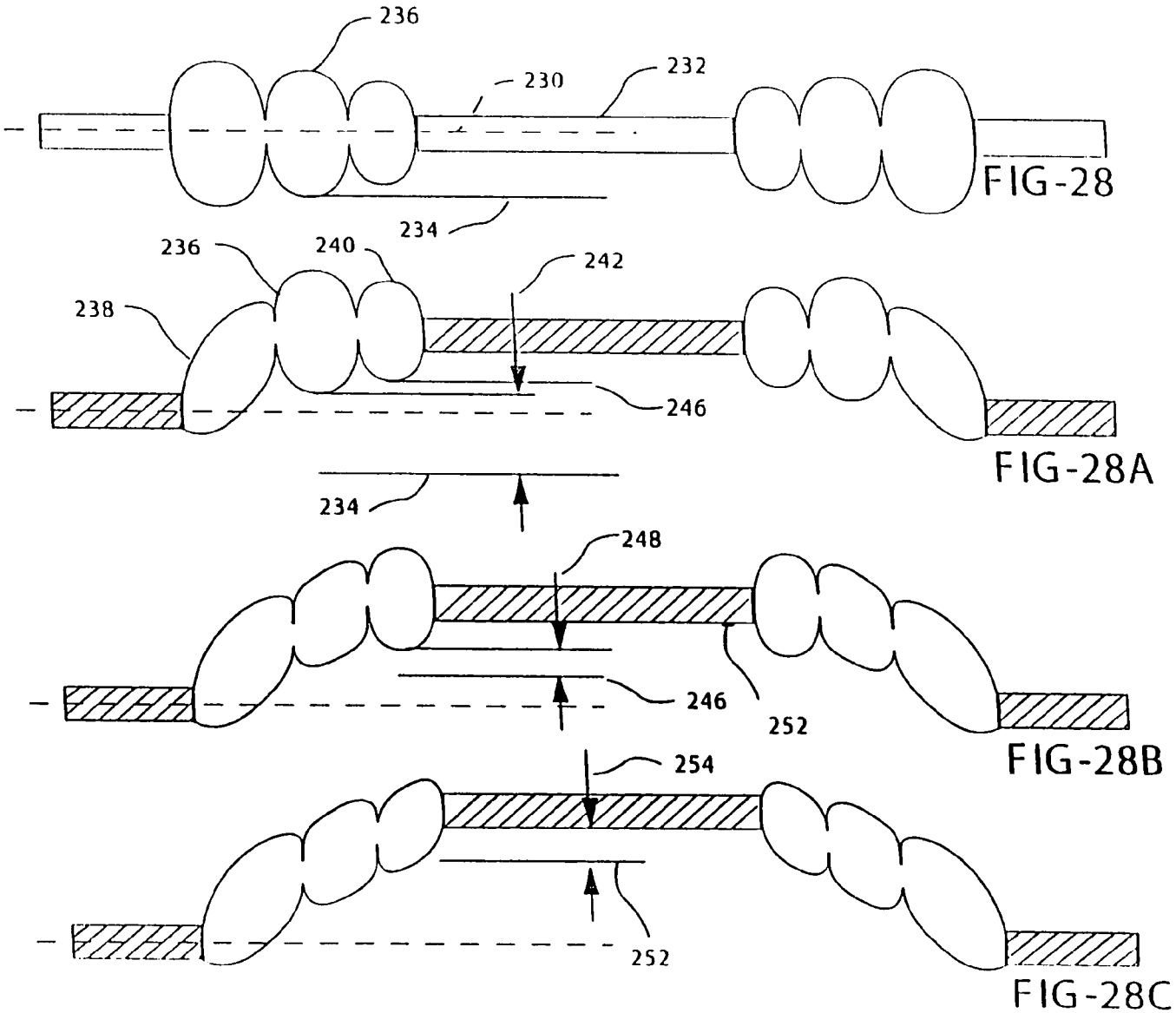
FIGS. 28, 28A, 28B and 28C show cross sectional schematic views of the three progressively sized roll diameter surround arrangements as shown in FIG. 25C and according to the invention, the relaxed state is shown in FIG. 28 and a nearly fully extended state is shown in FIG. 28C, a state where substantially only the outer surround roll is extended is shown in FIG. 28A, and a state where the outer surround roll and middle surround roll are substantially fully extended is shown in FIG. 28B.

An embodiment according to the invention which overcomes the drawbacks of the previously discussed arrangements, is to use a progressive roll diameter configuration, for example a cross section of which is shown in FIG. 25C. In this arrangement a set of three surrounds are provided, the outer surround being the largest, with surrounds internal to the outer one being progressively smaller. This arrangement provides a non uniform position specific extension characteristic, an approximation of which is shown by the curve 216 in FIG. 25. An understanding of the localized position based extension of the progressive surround arrangement can be understood by correlating the plot of the curve 216 in FIG. 25 with the relative movement of the centerpiece and surround portions as shown in FIGS. 28, 28A, 28B and 28C. A relaxed unextended condition of a passive radiator is shown in FIG. 28, where dashed line 230 correlates to the centerline of the frame and centerpiece 232 in an at rest condition and where line 234 provides a relative position reference for the position of the middle surround 236. In FIG. 25 this condition is represented by the origin (position 0,0). When a first level excursion (extension) takes place as is shown in FIG. 28A, the interrelationship of the overall stiffnesses of the three adjacent surrounds causes the perimeter surround 238 to be stretched to its travel limit at a first correlative rate, while the middle surround 236 and the inner surround 240, are stretched very little and almost not at all, respectively. The first correlative rate, might be considered to be an approximation of a spring constant which correlates to the movement of the centerpiece 232 from its at rest position to be displaced a distance 242 which shows that the movement of the centerpiece is due to the extension of the outer surround 238. The displacement of the centerpiece to this first level correlates to the portion of the curve 216 that goes from the origin to a corner of the curve identified adjacent a vertical reference line 244 on FIG. 25. If the total available travel of the centerpiece is identified as being 100% which correlates to 1.0 in this example, then it can be seen from FIG. 25 that the relative travel due to extension of primarily the outer surround exceeds 60% of the total available travel. Thus all small excursions and even moderately sized excursions of the centerpiece occur at the outer perimeter of the structure in the outer surround thus providing a localized position based extension. The distance 242 shown in FIG. 28A correlates approximately to the curve position associated with the reference line 244.

In FIG. 28A, reference line 246 correlates to the position of the inner surround 240 at the first level extension shown in FIG. 28A.

FIG. 28B shows a second level extension of the centerpiece 232 of the passive radiator. In this condition, the outer surround 238 which had formerly been stretched to the limit of its travel, stretches no more. The additional travel of the centerpiece, through a distance 248, occurs primarily by stretching of the middle surround 236, with very little stretching of the stiff inner surround 240. The increased force needed to stretch the middle surround (stiffness) causes the curve 216 relating to the movement of the centerpiece to turn a corner (at 244) and move at an increased rate upward to a curve position correlating to the reference line 250 on FIG. 25. At this position, the middle surround 236 has reached the limit of its travel. A reference line 252 corresponding to the vertical position of the bottom of the centerpiece 232 at this second level position is identified in FIG. 28B.

FIG. 28C shows the fully extended third level position of the centerpiece 232 showing the vertical travel distance over the second level position as shown in FIG. 28B. To reach this position, since both the outer 238 and middle 236 surrounds had reached the limits of their travel only the inner surround is subject to stretching. This stretching occurs over the distance 254, which correlates to the portion of the curve 216 to the right of the reference line 250. Curve 216 again turns a corner (at 250) and requires a markedly increased rate of force versus extension to achieve full travel. The result being that while the general overall characteristics of the progressive roll configuration exhibits a similar overall appearance, the actual performance due to the localized position based extension substantially reduces the chance that wobble (as sound distortion) will be heard at low sound pressure levels without unduly limiting the ability of the passive resonator to resonate at relatively high sound pressure levels without audible distortion which results in improved sound quality.

As shown in the FIG. 28 series, vent opening between adjacent surround compartments allows for pressure equalization and/or venting. Several other configurations will be discussed below.

The sizing of the surrounds closest to the perimeter compared with the surrounds positioned closer to the center of the vibrating element depends on two important considerations:

1. Linear stiffness where by the closest to the perimeter (next to the frame) surround will approach maximum excursion just as the range of excursion for the next adjacent surround begins a larger relative motion. This is necessary to produce a distortion free response. If this is not respected a harmonic distortion will overwhelm the fundamental signal and will create a complex signal out of a single tone.

2. The outer roll diameter, whereby the piston diameters relates to the amount of movement for a particular piston and roll diameter. Also the second (inside the outer) roll diameter and the second piston diameter are related in a similar way. Furthermore the outer roll diameter and the inner roll diameter are related to each other in a proportional way such that the outer roll is larger than the inner one following the arc of sphere or a cone (e .g., the inner is no greater than 80% of the diameter of the immediately adjacent outer roll diameter). Once the outer diaphragm diameter (Do-diameter outer) is selected (see FIG. 25C) and a maximum excursion distance associated with the outer piston (the diameter to the outside of the selected surround) is selected and the configuration of the progressive roll arrangement is set. Since the maximum axis travel equates to approximately 70% of the corresponding roll diameter (dro-diameter roll outer) a ratio of (Do/dro) the roll diameter is set and the distance to the next diaphragm inside the outer one is set, approximately correlating to Do minus dro. Using the three surround example, the middle surround has a piston diameter (Dm-diameter middle) and a corresponding roll diameter (drm-diameter roll middle) such that the ratio (Do/dro)=(Dm/drm) holds true as surrounds progressively get smaller toward the center. These ratios of geometric quantities in practice are dependent on material properties and transitional variations and thus are approximately equal rather than being exactly so. There will be an optimum value for the next roll diameter based on the air quantity moved and speed (i.e., surround stiffness).

Figure 29:
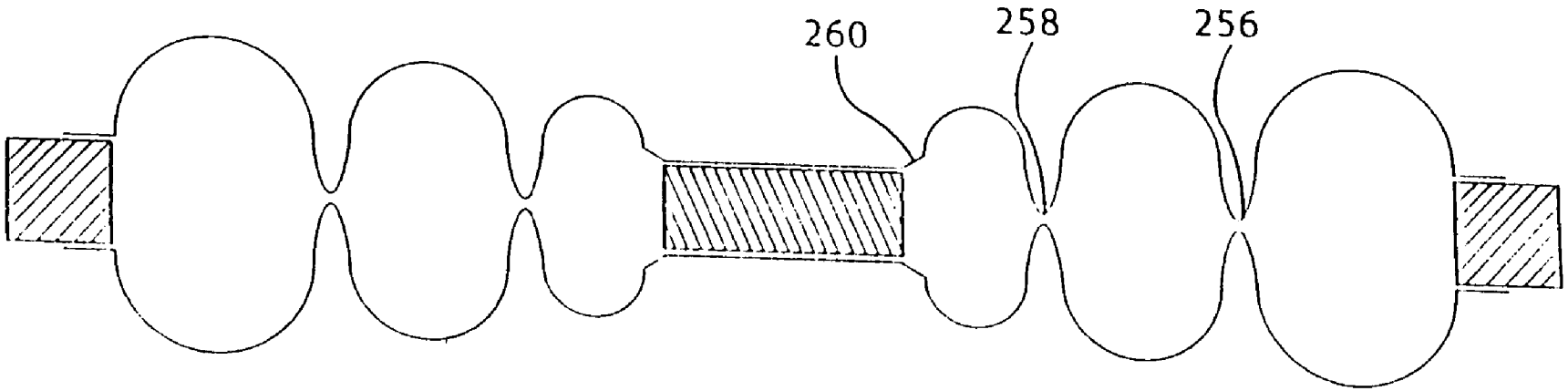
FIG. 29 shows a cross sectional schematic view according to the invention where three progressively sized surrounds contact each other at their saddles.

FIG. 29 shows a schematic cross sectional view of an embodiment of a progressive passive roll according to the invention where surrounds symmetrically mounted in opposing directions are connected by a series of smooth release transitions 256, 258, 260 to avoid material concentration and the elongation discontinuities associated with stresses and strains through such material concentrations.

Figure 30:
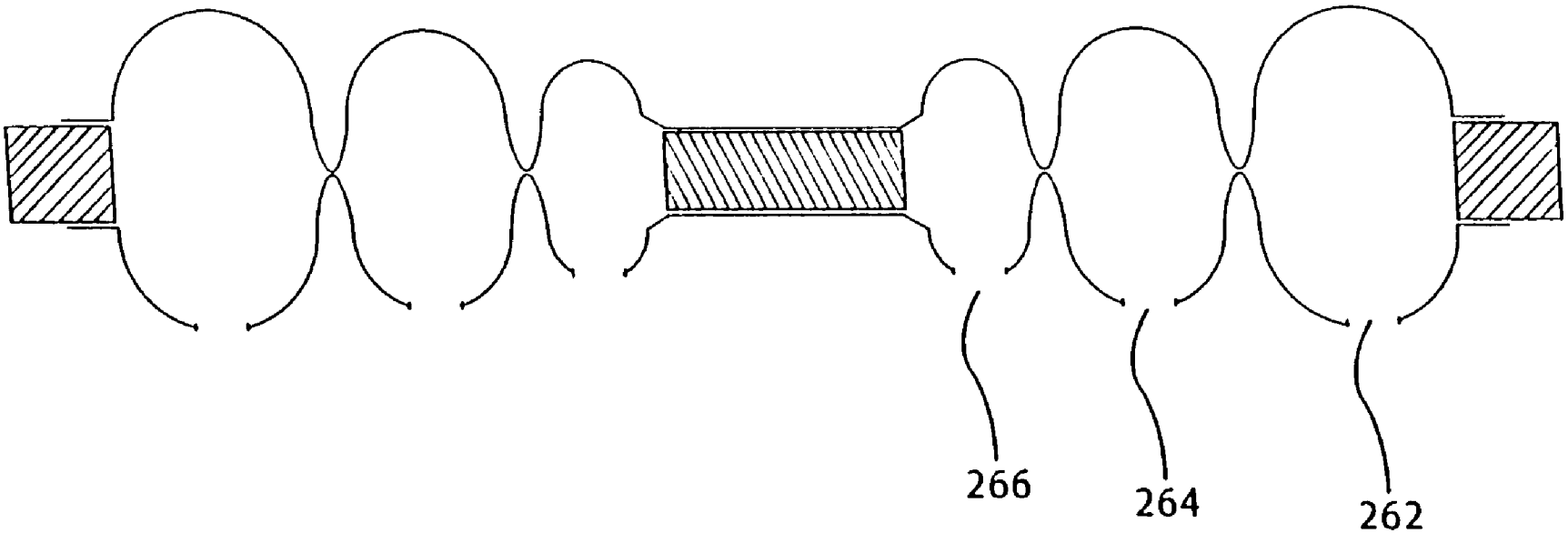
FIG. 30 shows a view of FIG. 29 with the addition of vent features for a device according to the invention.

During long strokes, the air trapped between the diaphragms can have a high pressure secondary cabinet that slows down the response. To eliminate this problem, air ventilation holes are made in the inside diaphragm (similar to that described above). The ventilation holes must have enough window area to allow air to pass at a speed of no more than 12 ft/sec (approximately 1% of the speed of sound). These holes must be symmetrical so that they do not pose a bias to the surrounds. FIG. 30 shows the configuration as shown in FIG. 29 modified to have vent openings 262, 264,266 through a face of the several surrounds, similar to that described above for the single surround arrangement (e.g., FIG. 20).

Figure 31:
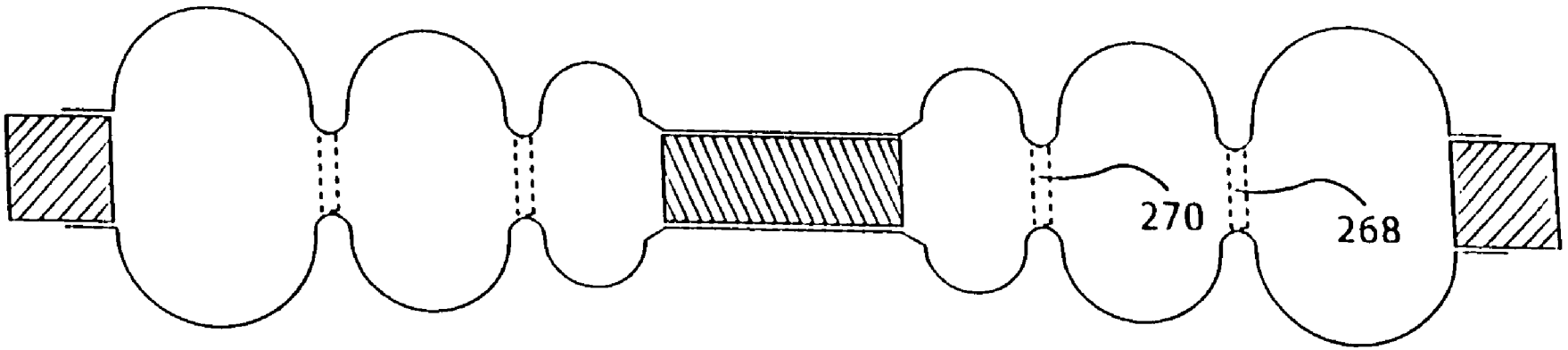
FIG. 31 shows a cross sectional schematic view according to the invention where three progressively sized surrounds are separated from each other at their saddles by spacers which maintain the distance between saddles.

FIG. 31 shows a schematic cross sectional diagram of a progressive roll arrangement, as previously described, where the centerpiece and frame vertical thickness are greater to reduce the chance of sideways motion and the related distortion. To prevent collapse (buckling) of the surround elements, a series of vertical spacers 268, 270, comprising vertical cylinders mating the valley bottoms between surround roll peaks together are provided. These spacers 268,270 can be a thin Mylar sheet or other comparable material whose effect is only to keep the corresponding connections on the upper and lower surrounds at equidistant to one another. In general it is preferred to have the spacer be so lightweight that the oscillatory reaction of the surrounds is unchanged from what they would be without the spacer, except that our of phase and collapse conditions are avoided.

Figure 32:
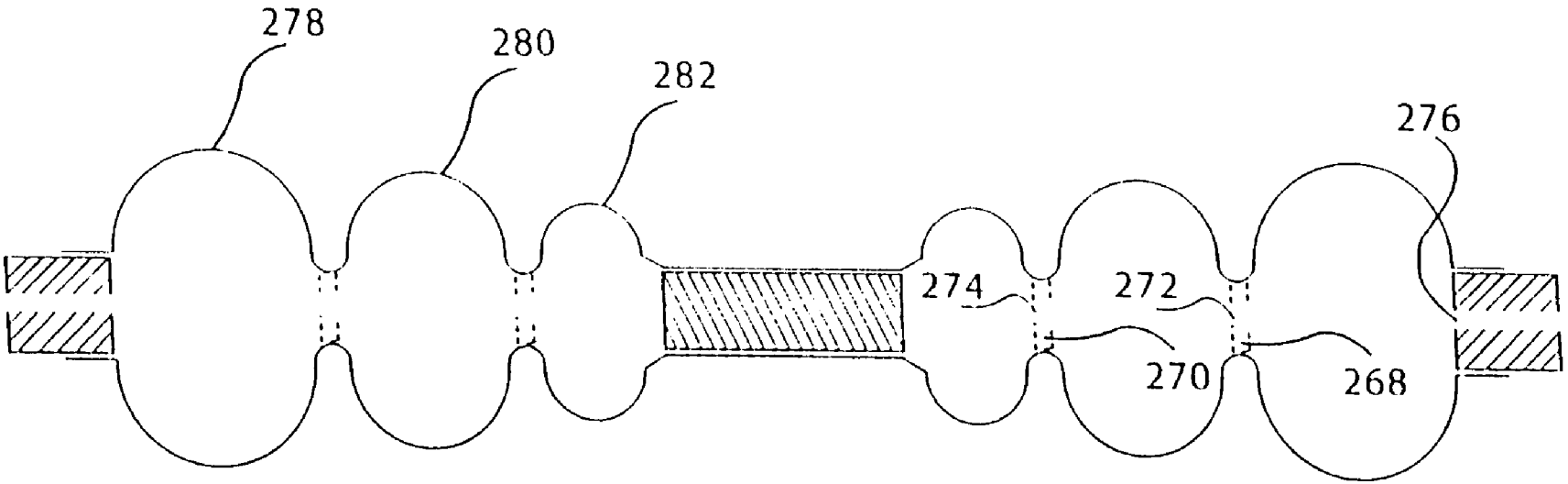
FIG. 32 shows a view of FIG. 31 with the addition of vent features for a device according to the invention.

FIG. 32 provides a vented configuration of the embodiment as shown in FIG. 31. The vents are holes 272, 274 through the wall of the spacers 268, 270 with a set of perimeter flange holes 276 providing surface area to allow air movement without generating audible notice of the movement.

Figure 33:
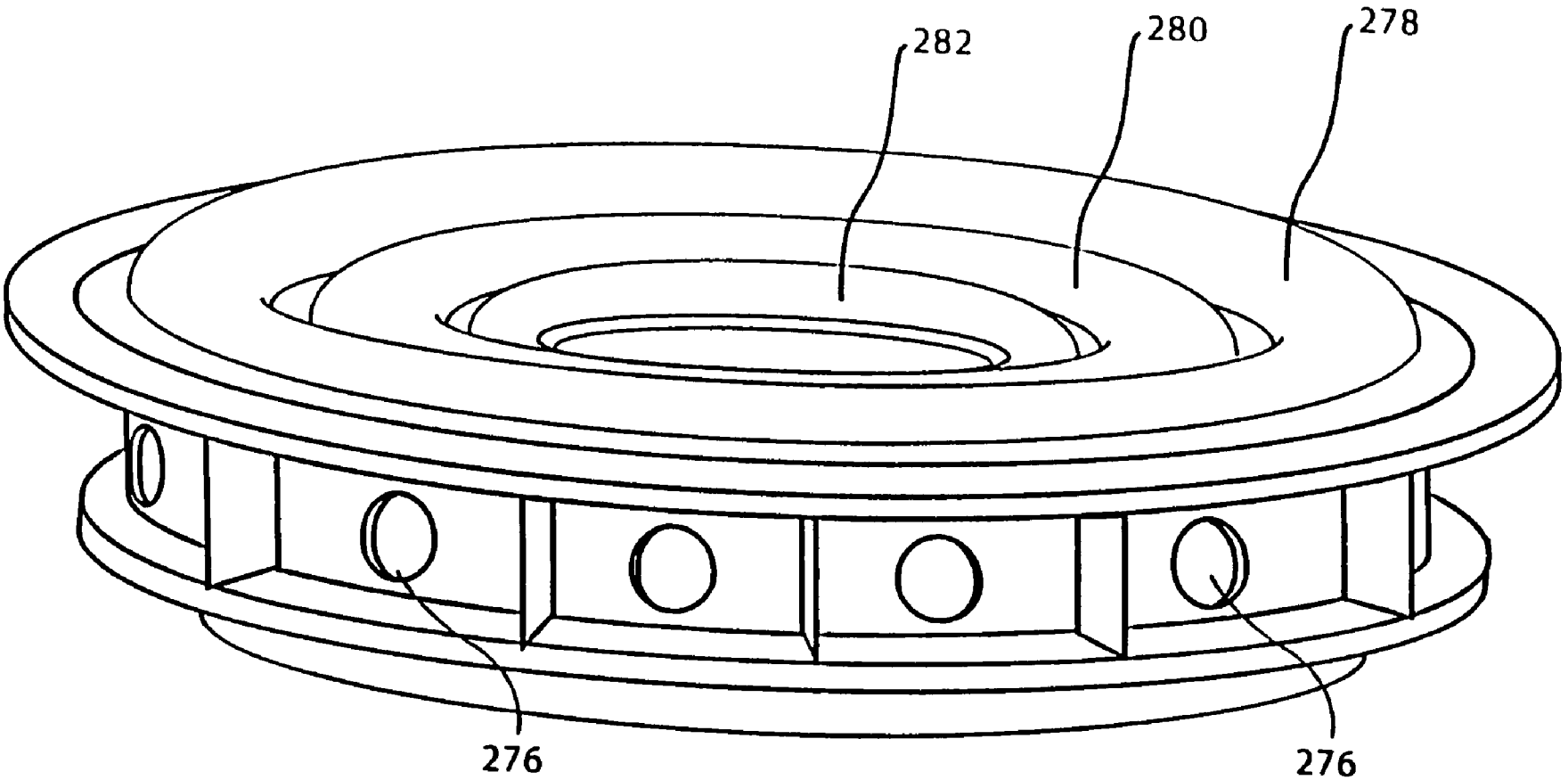
FIG. 33 shows a perspective view of a passive radiator incorporating three progressively sized surrounds as pictured in cross section in earlier Figures.

FIG. 33 presents a physical realization of the embodiment of FIG. 32. The perimeter flange holes 276 are shown distributed around the perimeter flange and the progressive surround roll diameters 278, 280,282, correlating to these structures in FIG. 32 are illustrated.

Tube Arrangement

Figure 34:
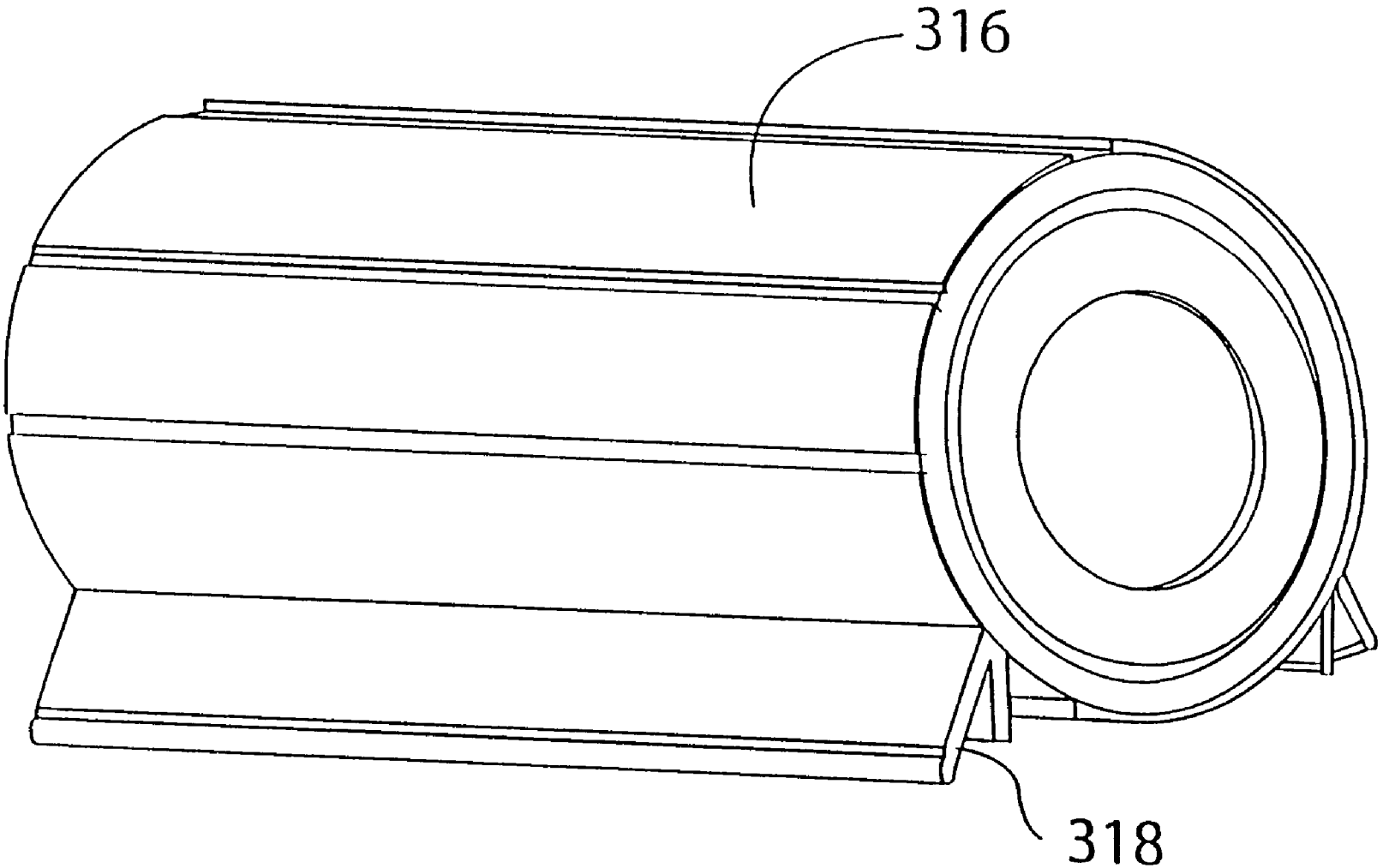
FIG. 34 a perspective view of a sound transducer system (speaker system) contained in a tube enclosure.
Figure 35:
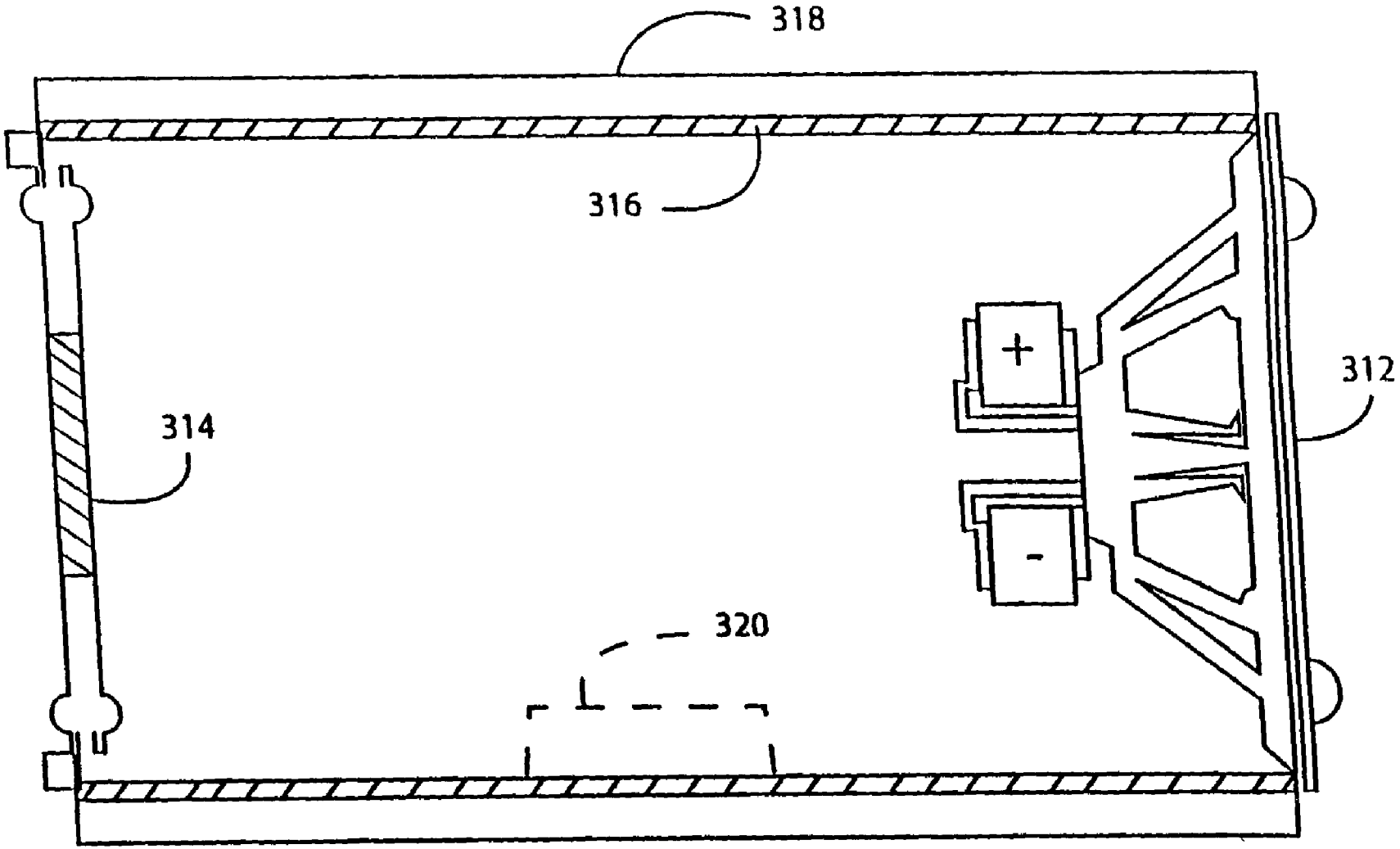
FIG. 35 is a schematic cross sectional view-of the tube enclosure for the speaker system of FIG. 34, with an active element at one end and a passive element at the other end, the tube is made of aluminum, and may have fins to assist in cooling.

Another configuration according to the invention, showing a speaker and a passive radiator in an enclosure is shown in FIGS. 34 and 35. A speaker enclosure, not unlike the speaker boxes of FIGS. 21, 22, 23 and 24, is specially configured in a tube shape. A 35 driver (speaker) 312 at one end and a passive radiator 314 according to the invention at the other end. Passive radiators as shown and described in FIGS. 9, 15, 16, 17, 29, 30, 31, 32 and 33 can be used. One of the biggest reasons for failure of voice coils of speakers is embrittlement and insulation breakdown due to high temperatures. In a closed box system where there is no transfer of air between the inside and outside, thermal energy is not dissipated quickly. In the present configuration the tube 316 containing the speaker and driver is made of aluminum and made be fitted with perimeter ribs 318 to enhance cooling. Measurements have shown that the temperature of the air inside the tube shows a drop of 5° F. inside the tube at moderate speaker power levels when the ambient surrounding temperature is about 70° F. Such a reduction in voice coil temperature is significant. When an amplifier (e.g., 320) is mounted in the tube as well the air temperature reduction due to the use of a high thermally conductive material such as aluminum will be even more significant.

Low Profile, Shallow Speaker Embodiments

The various embodiments of the present invention permit the designer to maximize air movement in a given mounting depth with a configuration that optimizes the operation of the moving parts (i.e., diaphragm, suspension and voice coil) in the electromagnetic environment that complements the fixed mechanical structural configuration of the non-moving parts. In one embodiment, this invention allows the designer to have an over excursion (outward/inward limiter) that is optimized with the available mounting depth. For example, the present invention allows the designer to have a 15" diameter speaker that fits in a mounting depth of as little as 3.5" with a diaphragm excursion of approximately ±1", while a conventional speaker with the same size working piston requires a mounting depth of 6" to 7".

FIGS. 36A through 45B illustrate a variety of embodiments of low profile, shallow speaker embodiments of the present invention that are mountable in shallow, small clearance locations. To simplify the understanding of each of these embodiments, elements in the various figures that are the same have been given the same reference number. Those elements that are modified and which perform the same or similar function have the same number with the first use without a prime and for each variation one or more primes have been added to the reference number.

Figure 36A:
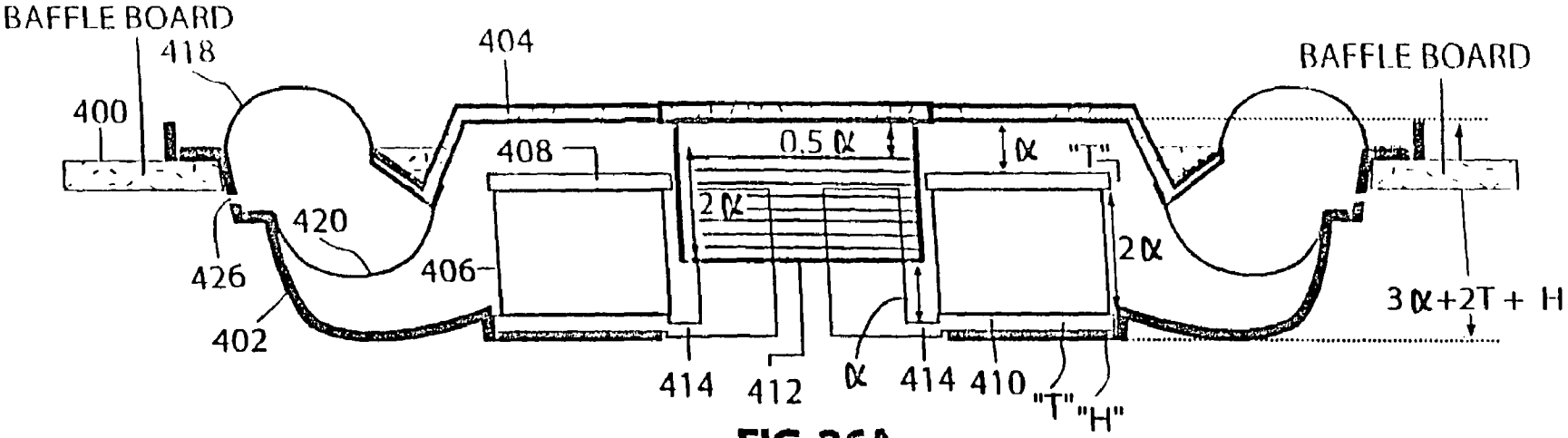
FIG. 36 show a first embodiment low profile, overhung, shallow speaker design in cross-section with FIG. 36A in the unexcited position, FIG. 36B in the maximum outward excursion position, and FIG. 36C in the maximum inward excursion position.
Figure 36B:
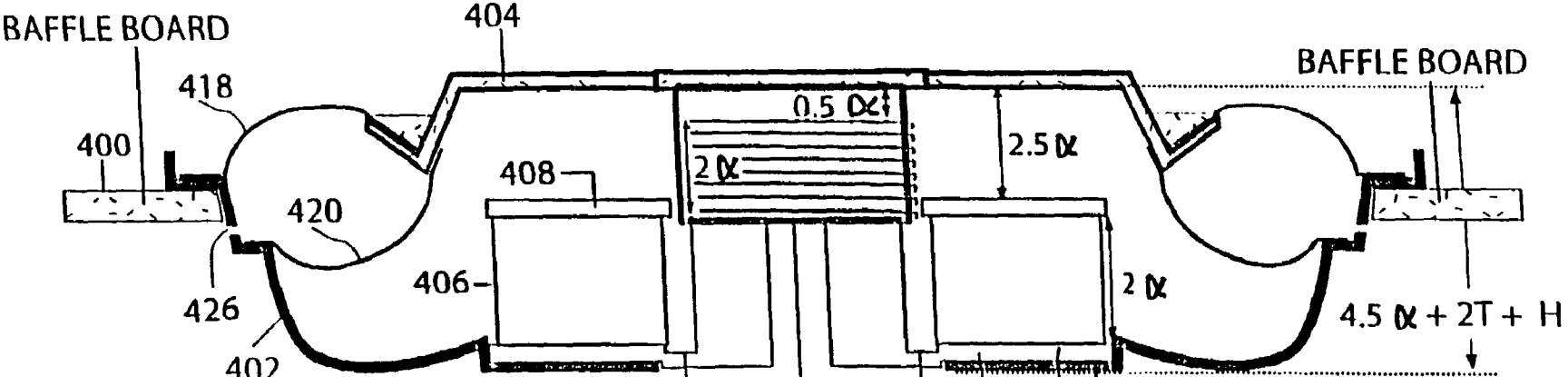
Figure 36C:
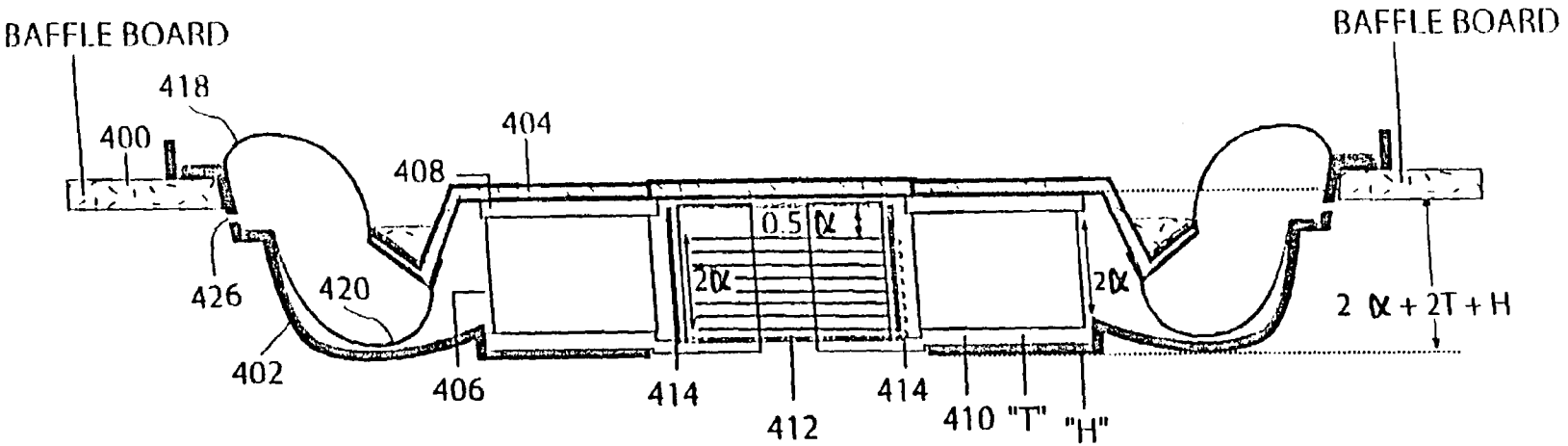

FIG. 36 show a first embodiment low profile, overhung, shallow speaker design with FIG. 36A in the unexcited position, FIG. 36B in the maximum outward excursion position, and FIG. 36C in the maximum inward excursion position. Included is a low profile frame or basket 402 that mounts to baffle board 400 in the installed location. Basket 402 has a bottom thickness of "H". In the bottom center of basket 402 is a typical overhung magnet/voice coil audio motor with an upwardly extending steel doughnut with an outwardly extending flange 410 with that flange having a thickness of "T". Mounted on the flange of doughnut 410 is a circular magnet 406 having a center hole that has a larger diameter than the diameter of the upwardly extending portion of the doughnut. Magnet 406 has a thickness of 2α. On top of magnet 406 is a steel ring 408 having outer and inner diameters that are approximately the same as those diameters of magnet 406. Ring 408 also has a thickness "T".

Additionally, there is a stiff, substantially flat diaphragm 404 with the diameter of the flat area being larger than the outer diameter of magnet 406. The outer most edge of diaphragm 404 is shown having a "V" shaped outer edge that extends downward and away at approximately 60°, however that specific angle is not critical to the design. Diaphragm 404 is ideally made of a material such as honeycomb, thin aluminum, or other composite and non-composite light-weight materials; conventional cone materials will not work in this application since the diaphragm is substantially flat and light-weight. Diaphragm 404 is suspended with two matched surrounds: an upwardly extending flexible surround 418 having an inner edge attached to the top of the outwardly extending leg of the "V" shaped edge of the diaphragm and an outer edge attached to the top, outer most flange of basket 402; and a downwardly extending flexible surround 420 having an inner edge attached to the bottom of the inner leg of the "V" shaped edge of the diaphragm and an outer edge attached to a point within basket 402 below the top, outer most flange. With surrounds 418 and 420 mounted in this way, maximum linearity of the inward/outward strokes of the speaker is achieved. Between the attachment points of surrounds 418 and 420, ventilation holes 426 have been formed around the circumference of basket 420. Attached to the lower center of diaphragm 404 is voice coil 412 that fits loosely around the upwardly extending portion of steel doughnut 410 with the upper most turn of the coil of voice coil 412 being spaced 0.5α below the inner surface of the diaphragm and the coil winding having a height of 2α in this overhung configuration. By making the height of the coil winding the same as the thickness of the magnet makes it possible to minimize the overall height of the speaker in every excited and unexcited positions of the diaphragm. With respect to each of the views of FIGS. 36A, 36B and 36C, and each of the embodiments discussed below, the thickness of the diaphragm adds the same amount to the overall height of the speaker in each illustrated state, and since the thickness of the diaphragm can vary depending on the material used, for comparison purposes, the thickness of the diaphragm is not included in the height calculations.

FIG. 36A illustrates the position of the various components of this speaker embodiment when no current is flowing through voice coil 412 and when the speaker is not being driven. In this position, surrounds 418, 420 are relaxed with the lower half of the coil winding opposite the upper half of the magnet and the inner surface of diaphragm 404 spaced apart from the upper surface of ring 408 by a distance of α. Thus the overall height of the speaker is the spacing between diaphragm 404 and ring 408, α, plus the thickness of ring 408, T, plus the height of magnet 406, 2α, plus the thickness of the flange of 410, T, plus the thickness of the bottom of basket 402, H, for a total of 3α+2T+H.

In FIG. 36B the speaker is in the maximum outwardly extending position with the surrounds both stretched upward and the bottom coil of the voice coil even with the upper surface of ring 408. In this position the speaker achieves the maximum height possible. Here the spacing between ring 408 and diaphragm 404 is 2.5α (the height of the coil, 2α, plus the spacing of the upper most turn of the coil 0.5α from the bottom surface of the diaphragm). Thus the overall height of the speaker in this state is that 2.5α, plus the thickness of ring 408 and the flange 410, each T for a total of 2T, plus the height of the magnet, 2α, plus the thickness of the bottom of the basket, H, for a total of 4.5α+2T+H.

In FIG. 36C the speaker is in the maximum inwardly extending position with the surrounds both stretched inward and the overall height of the coil of voice coil 412 directly adjacent magnet 406 with the inward pull of the speaker being limited by the inner surface of diaphragm 404 coming into contact with the top surface of ring 408. Note that a circular groove 414 has been provided in the flange to protect the bottom edge of the voice coil from bottoming out with the flange. In this position the speaker achieves the minimum height possible. That height is the thickness of the magnet, 2α, plus the thickness of ring 408 and the flange, each T, and the thickness of the bottom of the basket, H, for a total of 2α+2T+H.

Note that the outermost edge of suspension system 418, 420 and diaphragm 404 is entirely outside the outer diameter of magnet 406, thus allowing the suspension to extend below the top surface of ring 408 with surround 420 nearly extending to the bottom of the basket on the maximum inward excursion of the voice coil and diaphragm as shown in FIG. 36C. Thus, the suspension operational depth is not a limiting factor of the speaker basket design and the actual mounting depth of the speaker. As noted above the mounting depth and cone wobble control are interrelated in the speakers of the present invention; the closer the outer portion of the suspension is to an inner one, the chance of wobble increases as the mounting depth of the speaker becomes shallower. As can be seen in FIGS. 36A, B and C the spacing between the two surrounds 418 and 420 is maintained throughout the full range of travel of the diaphragm, thus minimizing the possibility of wobble.

Figure 39:
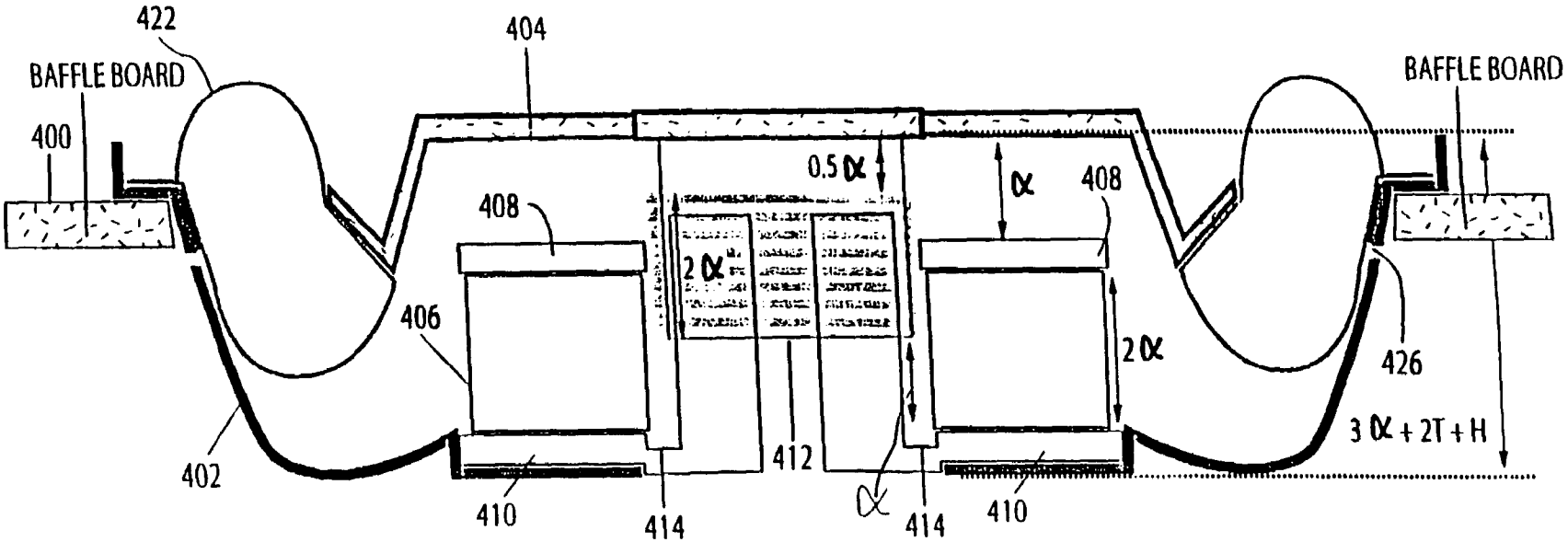
FIG. 39 shows the embodiment of FIG. 36A with a modified suspension.

FIG. 39 shows a second embodiment of an overhung, low profile speaker that is similar to that of FIG. 36A, the difference being that surrounds 418 and 420 have been replaced with a single bladder 422. In construction, bladder 422 is similar to a bicycle tube with the outer most side connected to inside top edge of basket 402 and an opposite side connected to the bottom of the outer most leg of the "V" shaped edge of diaphragm 404. Mounted in that way, a portion of bladder 422 extends upward like surround 418 while another portion extends downward into basket 420 like surround 420. In operation, bladder 422 performs similarly to the combination of surrounds 418 and 420 as discussed above in relation to FIGS. 36A, 36B and 36C.

By connecting the outer most side of bladder 422 to a lower point within basket 402 that is approximately horizontally even with the underside of the outer most leg of the "V" shaped edge of the diaphragm rocking of the diaphragm during speaker operation is minimized. Bladder 422 could be manufactured by injection molding and the wall thickness could be increased as necessary to achieve the desired performance. Additionally, to reduce internal pressure that develops during extreme in/out strokes, bladder 422 can have ventilation holes around the circumference to reduce internal pressure to allow air trapped within to leak into the space in which the speaker is mounted through ventilation holes 426. The overall height calculations for this embodiment are the same as for the first embodiment of FIG. 36A.

Figure 40:
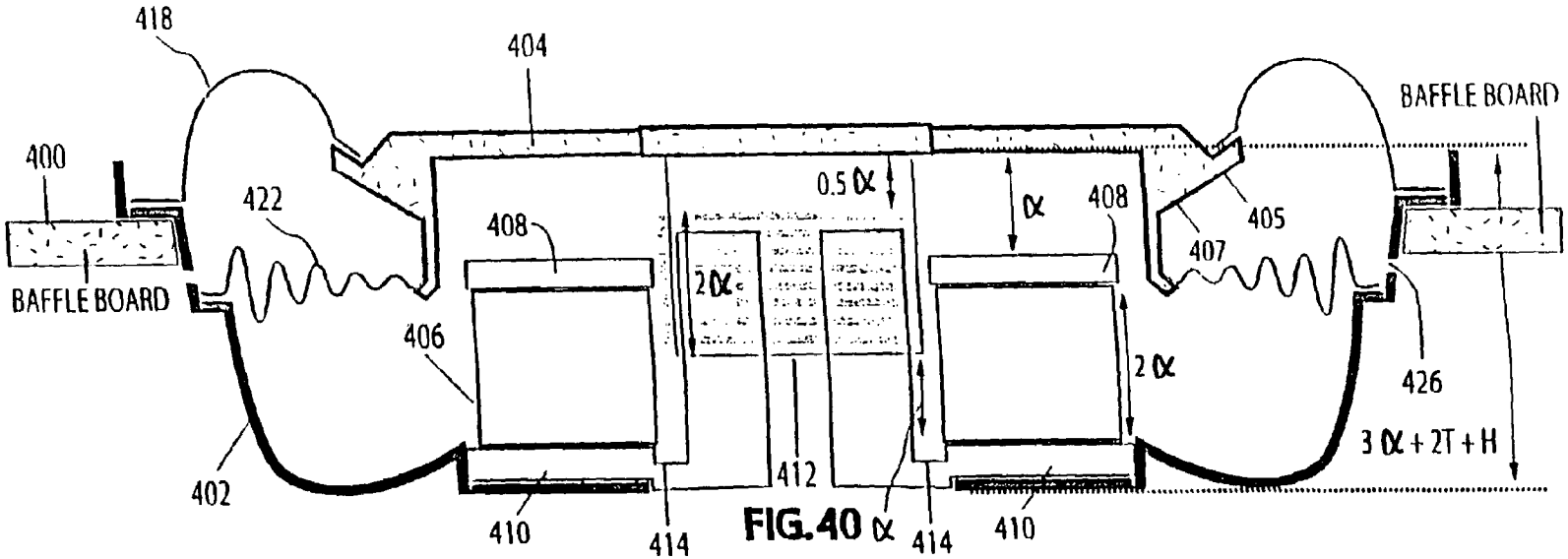
FIG. 40 shows the embodiment of FIG. 36A with a second modified suspension and a modified diaphragm configuration.
Figure 41A:
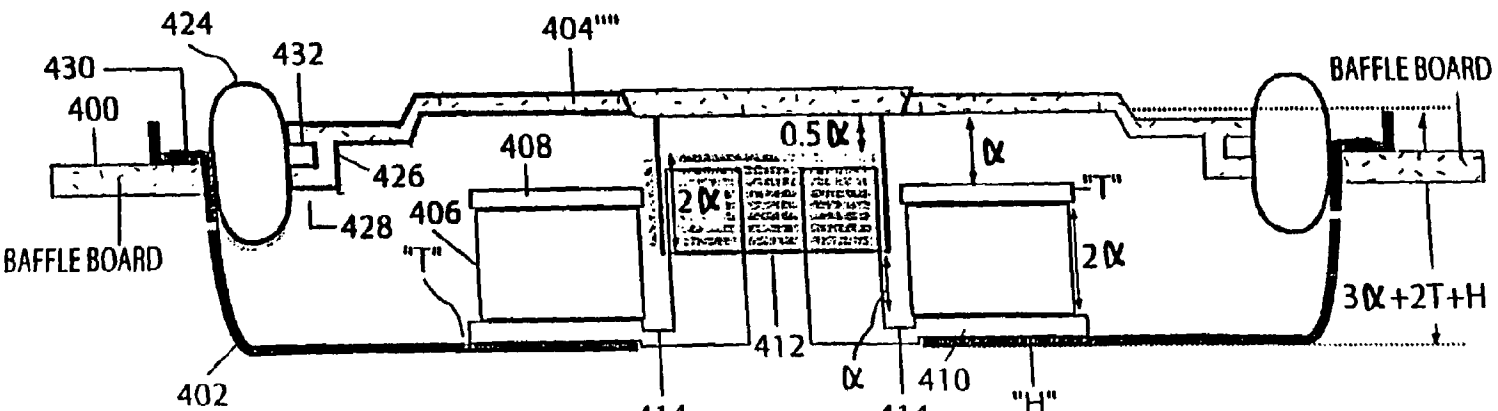
FIG. 41 show the embodiment of FIG. 36 with a third modified suspension and a second modified diaphragm configuration with FIG. 41A in the unexcited position, FIG. 41B in the maximum outward excursion position, and FIG. 41C in the maximum inward excursion position.
Figure 41B:
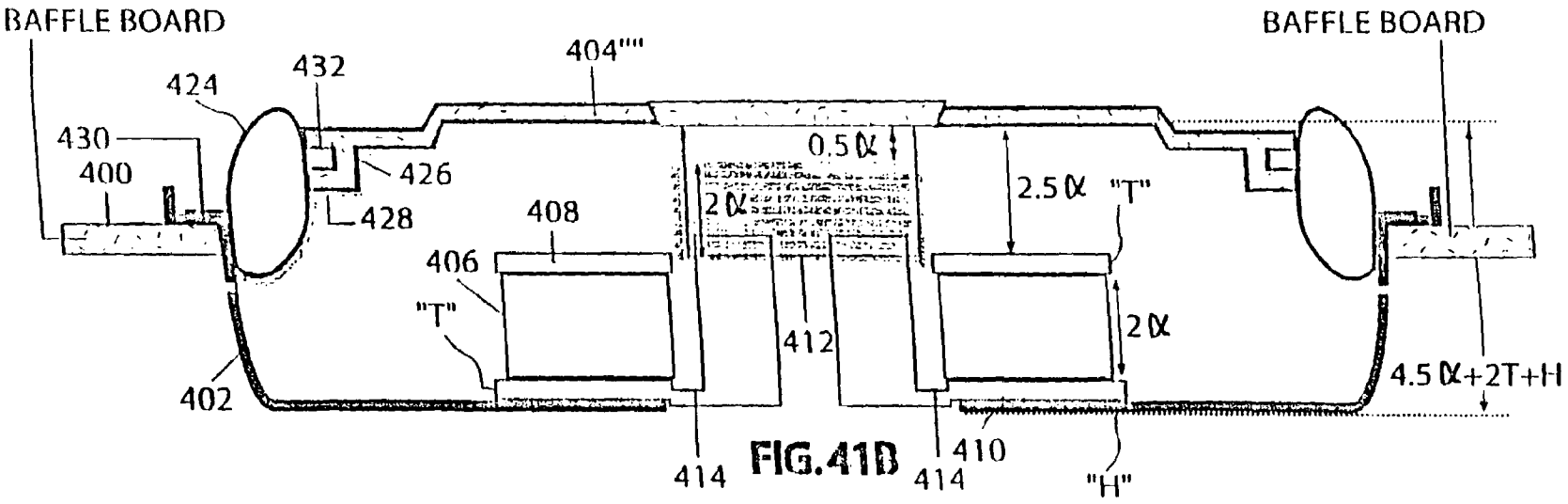
Figure 41C:
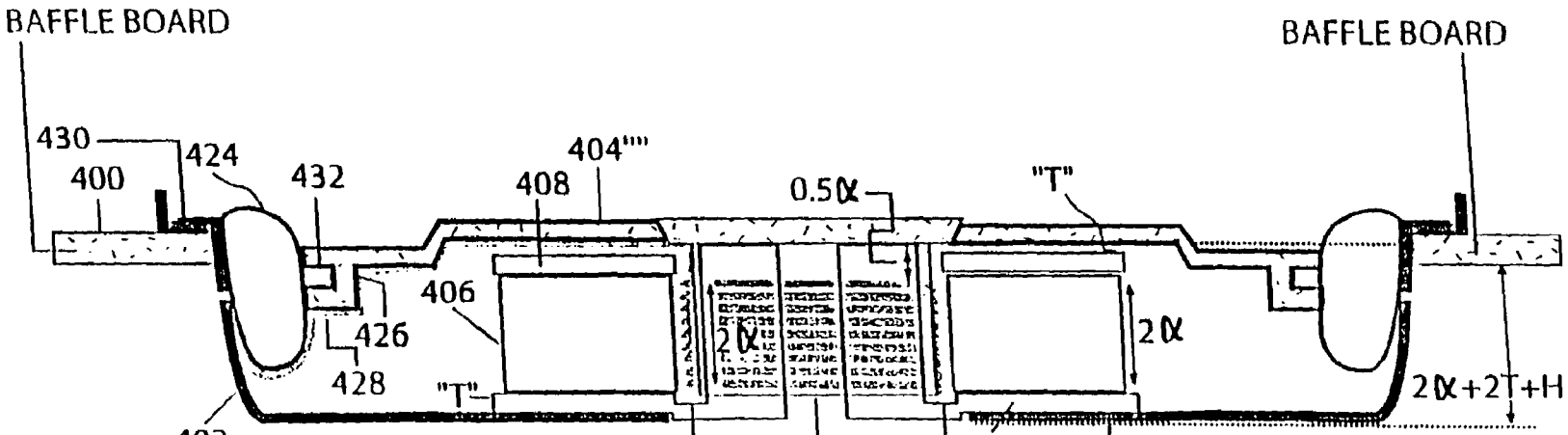

The third overhung, low profile speaker embodiment of FIG. 40 is also similar to the embodiment of FIG. 36A with two modifications—the outer edge shape of the diaphragm and the inner and outer surrounds. The outer edge of diaphragm 404''' of this embodiment has two suspension points, one being an upper outwardly small "V" shaped finger 405 that is slightly below the top surface of diaphragm 404''', and a downward extending finger 407 outside the diameter of magnet 406. Downward extending finger 407 also has formed to the end thereof a small outwardly extending flange. An outwardly extending surround 418' is connected between the outer most leg of the small "V"

shaped finger 405 and the top flange of basket 402, similar to surround 418 in FIG. 36A. Additionally, a spider 422 is connected between the small outwardly extending flange of downwardly extending finger 407 and a point within basket 402 below the top flange and ventilation holes 426, similar to the connection point of surround 420 in FIG. 36A. It should be noted that in this configuration spider 422 is mounted entirely outside the outer diameter of magnet 406, unlike the design of conventional speakers where the spider/cone connection is mounted directly over the magnet by a distance that is related to the desired travel of the speaker cone. With spider 422 mounted to the side of magnet 406 as in FIG. 40, the additional speaker height required in a conventional speaker is eliminated thus reducing the overall height of the speaker making a low profile speaker possible. In operation, surround 418' and spider 422 perform similarly to the combination of surrounds 418 and 420 as discussed above in relation to FIGS. 36A, 36B and 36C. The overall height calculations for this embodiment are the same as for the first embodiment of FIG. 36A.

FIG. 37 show a fourth embodiment of an overhung, low profile speaker of the present invention. This embodiment, as will be seen, has built in stops that define the maximum inward and outward travel of the diaphragm. Included in this embodiment is a speaker basket 402' with an outwardly extending upper flange that mounts to baffle board 400 of the mounting location of the speaker. Basket 402' has a bottom thickness "H". Mounted centrally within basket 402' is a post 428 having a threaded upper end 430 with the overall height of post 428 being less than the height of basket 402' from the bottom to the mounting flange. Also included is steel ring 408 magnetically adhering to the bottom of circular magnet 406 which in turn magnetically adheres to the flange of circular steel doughnut 410' with a hole therethrough that is tapped at the upper end. The flange of doughnut 410' and ring 408 each have a thickness "T", and magnet 406 has a thickness $2\alpha'$ (note the distance $\alpha'$ in this figure is not necessarily the same as the distance $\alpha$ in FIG. 36). Doughnut 410' is screwed onto the top of post 428 with the ring/magnet/doughnut 408, 406, 410' assembly having a substantially uniform diameter that is suspended above the bottom of the basket. Note that doughnut and flange 410' is substantially the same as doughnut 410 in FIG. 36 with the addition of the tapped center hole and being mounted inverted to that of FIG. 36.

In this embodiment, diaphragm 404' consists of two elements—a flat ridged top disk 413 and a circular enclosure 409 to the top of which top disk 413 is coupled. Circular enclosure 409 has cylindrical open interior with an inner diameter that is greater than the diameter of assembly 410, 406, 408' that opens to the opening in the basket. Through the center of bottom portion 411 of enclosure 409 is a circular hole that has a diameter substantially equal to that of voice coil 412 with the lower end thereof coupled within the bottom hole of enclosure 409. Voice coil 412 extends upward and fits loosely around the downwardly extending portion of steel doughnut 410' with the lower most turn of the coil of voice coil 412 being spaced $0.5\alpha'$ above the inner surface of bottom portion 411 and the coil winding has a height of $2\alpha'$ in this overhung configuration. Additionally, the inner depth of enclosure 409 is $2\alpha'$. Extending radially outward from enclosure 409 is a ring with the outer edge undercut inward shown here at approximately 45°, however the undercut angle is not critical to the operation of the speaker. The outwardly extending ring of the enclosure is coupled to the mouth of the basket by surrounds 418, 420 similar to that shown in FIG. 36A.

Figure 37A:
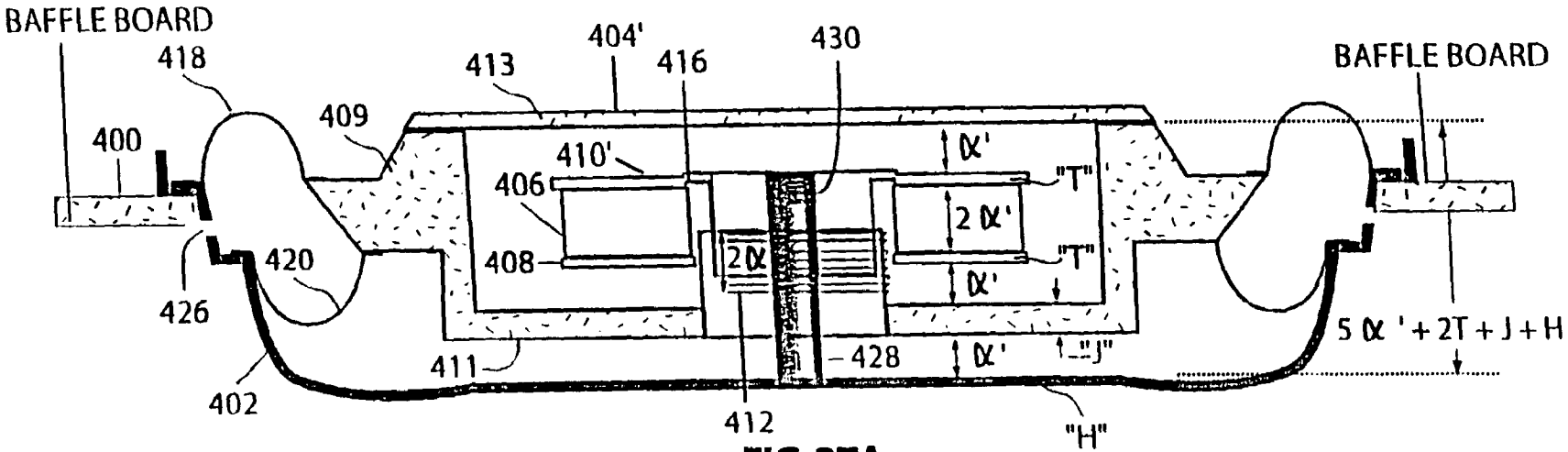
FIG. 37 show a second embodiment low profile, overhung, shallow speaker design in cross-section with FIG. 37A in the unexcited position, FIG. 37B in the maximum outward excursion position, and FIG. 37C in the maximum inward excursion position.

FIG. 37A illustrates the position of the various components of this speaker embodiment when no current is flowing through voice coil 412 and when the speaker is not being driven. In this position, surrounds 418, 420 are relaxed with the upper half of the voice coil winding opposite the lower half of the magnet, and the inner surface of plate 413 of diaphragm 404' is spaced apart from the upper surface of the flange of 410' by a distance $\alpha'$. Thus the overall height of the speaker is the distance between diaphragm 404' and the upper surface of 410', $\alpha'$, plus the thickness of 410', T, plus the height of magnet 406, $2\alpha'$, plus the thickness of ring 408, T, plus the spacing between ring 408 and the inner surface of 411, $\alpha'$, plus the thickness of 411, J, plus the distance between 411 and the bottom of the basket, $\alpha'$, plus the thickness of the bottom of basket 402', H, for a total of $5\alpha'+2T+J+H$.

Figure 37B:
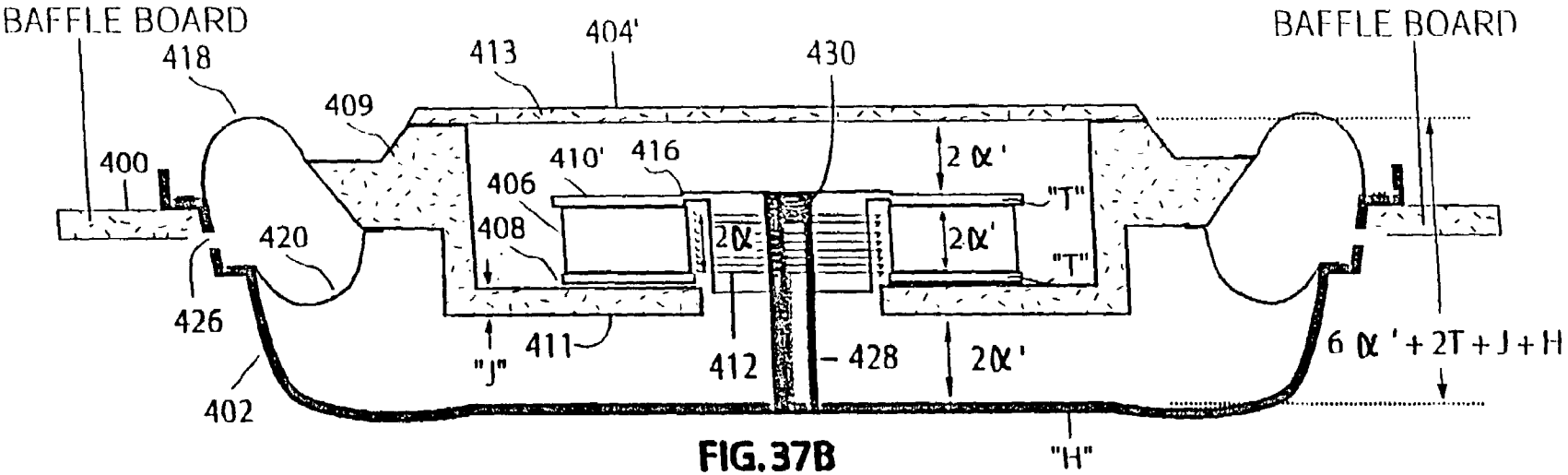

In FIG. 37B the speaker is in the maximum outwardly extending position with the surrounds both stretched upward, voice coil 412 is fully within the inner diameter of magnet 406, and the bottom 411 of enclosure 409 is in contact with the lower surface of ring 408 being pulled into that position by the fact that voice coil 412 is connected to 411. Note that a circular groove 416 has been provided in the flange to protect the top edge of the voice coil bobbin from bottoming out with the flange. This contact between 411 and the bottom of 408 stops the upward travel of diaphragm 404'. In this position the speaker achieves the maximum height possible. In this configuration the height of the speaker is the spacing between plate 413 of diaphragm 404' and 410', $2\alpha'$, plus the thicknesses of 410' and ring 408, each T, plus the height of magnet 406, $2\alpha'$, plus the thickness of 411, J, plus the distance between 411 and the bottom of the basket, $2\alpha'$, plus the thickness of the bottom of basket 402', H, for a total of $6\alpha'+2T+J+H$.

Figure 37C:
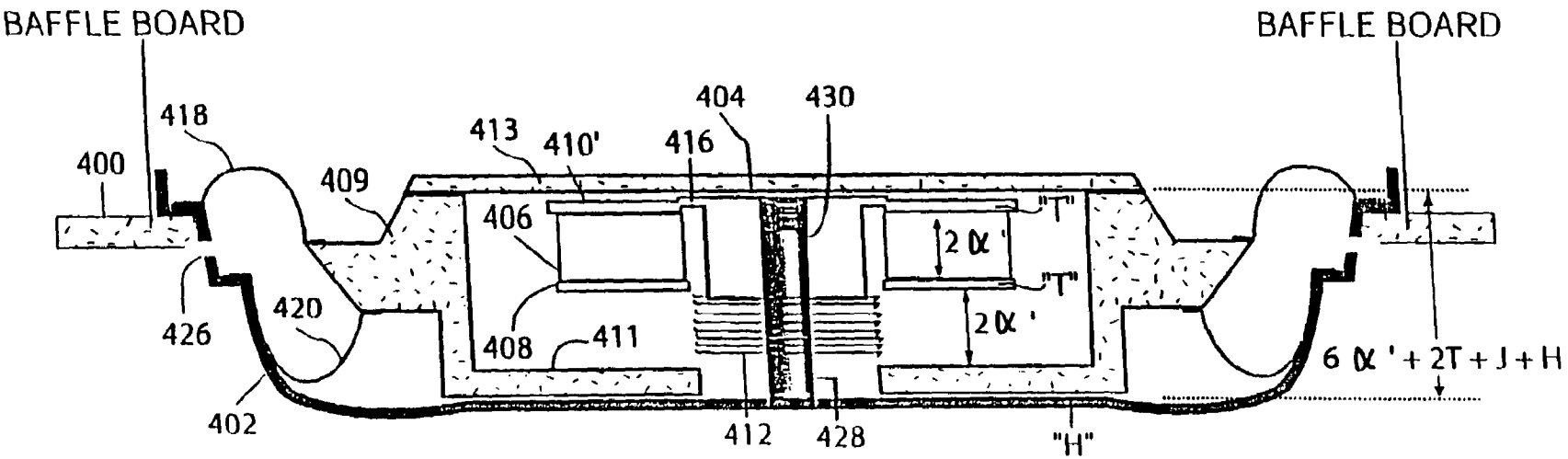

In FIG. 37C the speaker is in the maximum inwardly extending position with the surrounds both stretched inward and the overall height of the coil of voice coil 412 totally withdrawn from within the inner diameter of magnet 406 with the inward pull of the speaker being limited by the bottom surface of 411 coming into contact with the bottom of basket 402'. In this position the speaker achieves the minimum height possible. That height is the thicknesses of 410' and 408, each T, plus the height of the magnet, $2\alpha$, plus the thickness of 411, J, plus the thickness of the bottom of basket 402', H, for a total of $4\alpha'+2T+J+H$.

Figure 38A:
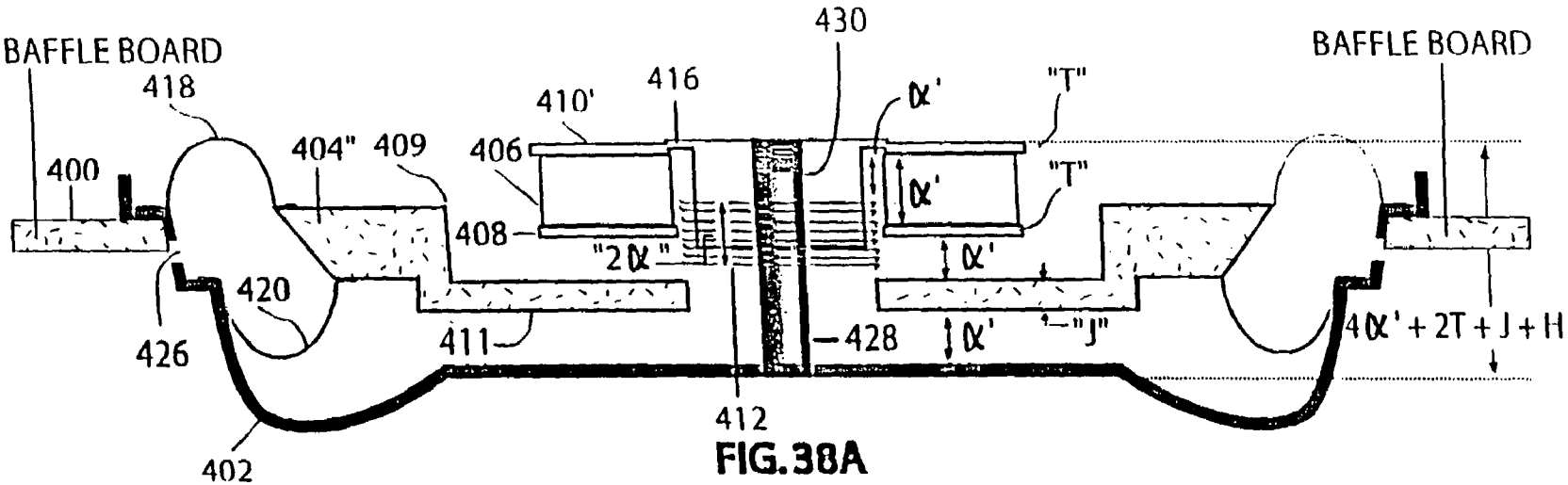
FIG. 38 show a third embodiment low profile, overhung, shallow speaker design in cross-section with FIG. 38A in the unexcited position, FIG. 38B in the maximum outward excursion position, and FIG. 38C in the maximum inward excursion position.

FIG. 38 show a fifth embodiment of an overhung, low profile speaker of the present invention that is similar to the fourth embodiment of FIG. 37 with the only difference being the configuration of the diaphragm which gives the speaker the same height regardless of the position of the diaphragm for all levels of excitation. This embodiment, as will be seen, also has built in stops that define the maximum inward and outward travel of the diaphragm. Given that only the diaphragm is different from the embodiment of FIG. 37, only the configuration of the diaphragm will be discussed here. Diaphragm 404" is similar to diaphragm 404' of FIG. 37, the difference being that diaphragm 404" does not have top plate 413 and the depth of enclosure 411' is only $2\alpha'$ as compared to the $4\alpha'$ depth of enclosure 411 of diaphragm 404' of FIG. 37. Thus, each of FIGS. 38A, B and C are similar to FIGS. 37A, B and C with all of the components in the same positions without plate 404' above 410'.

Thus the unexcited height of the speaker in FIG. 38A is the thicknesses of each of 410' and 408, each being T, plus the height magnet 406, $2\alpha'$, plus the spacing between ring 408 and the inner surface of 411', $\alpha'$, plus the thickness of 411', J, plus the distance between 411' and the bottom of the basket, α', plus the thickness of the bottom of basket 402', H, for a total of 4α'+2T+J+H.

Figure 38B:
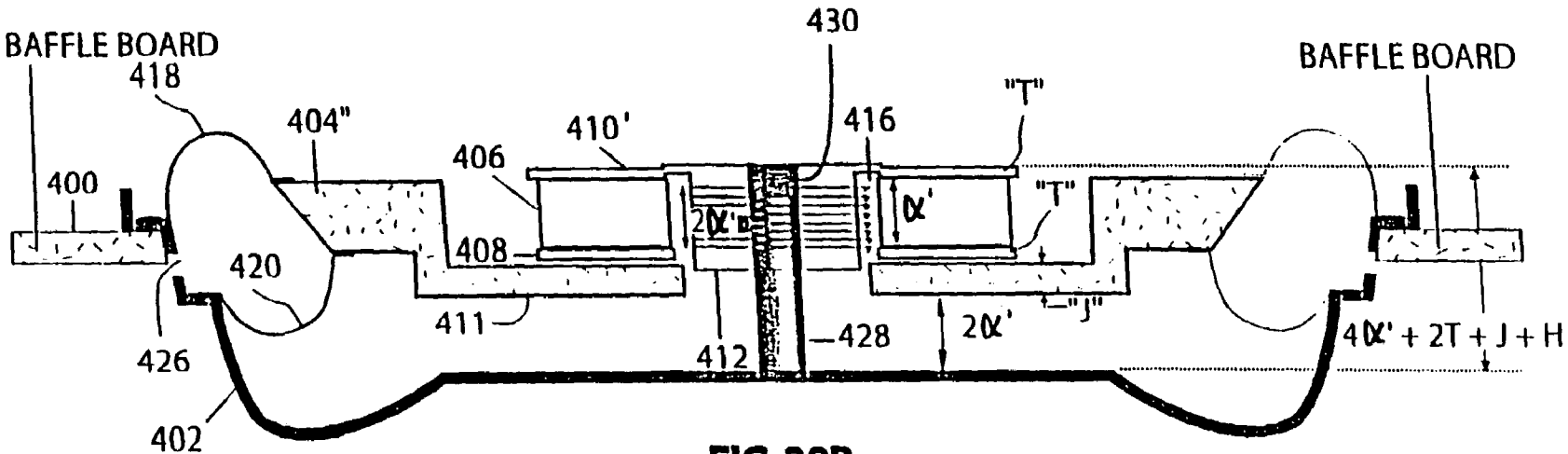

The maximum outward excited height of the speaker in FIG. 38B is the thicknesses of each of 410' and 408, each being T, plus the height magnet 406, 2α', plus the thickness of 411', J, plus the distance between 411' and the bottom of the basket, 2α', plus the thickness of the bottom of basket 402', H, for a total of 4α'+2T+J+H.

Figure 38C:
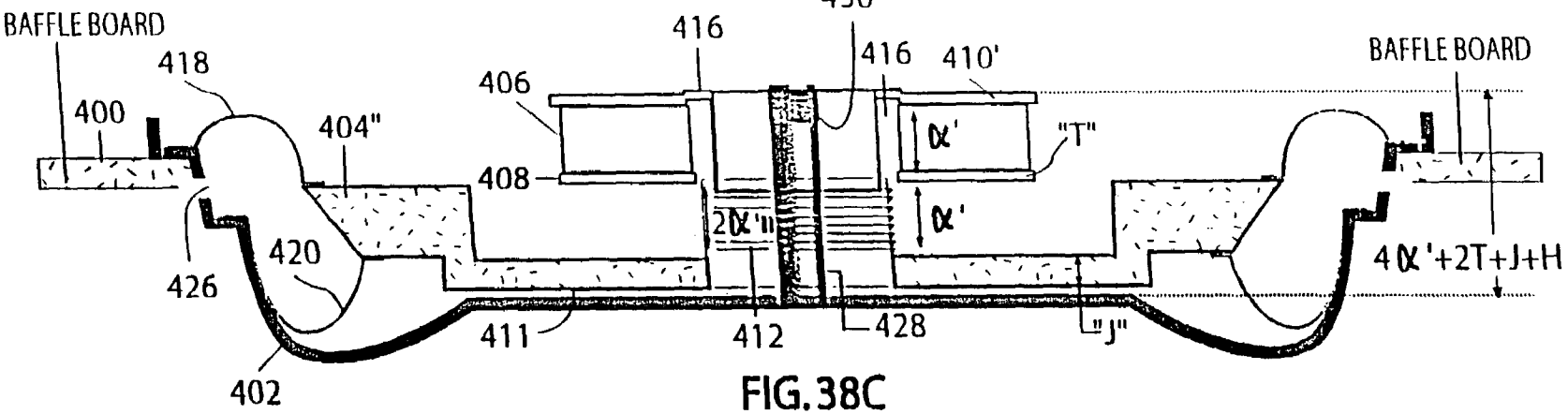

Similarly, the maximum inwardly excited height of the speaker in FIG. 38C is the thicknesses of each of 410' and 408, each being T, plus the height magnet 406, 2α', plus the spacing between ring 408 and the inner surface of 411' which is the same as the winding height of voice coil 412, 2α', plus the thickness of 411', J, plus the thickness of the bottom of basket 402', H, for a total of 4α'+2T+J+H.

FIG. 41 show a sixth embodiment of an overhung, low profile speaker of the present invention that is similar to the first embodiment shown in FIG. 36. The only differences between these two embodiments is in the outer edge of the diaphragm and the suspension between the diaphragm and the speaker basket. The various heights of this embodiment are the same as those of the first embodiment.

Diaphragm 404"" of this embodiment has an outer edge that is a two tine, horizontally extending fork with the upper surface of diaphragm 404"" forming a first tine 426 of the fork with the second tine 428 spaced apart from and below the first tine. In place of surrounds 418 and 420, the present embodiment utilizes a single support bladder 424 with a first mounting tab 430 extending outward for attachment to the outwardly extending flange of basket 402, and a second mounting tab 432 extending outward on the opposite side of the bladder from tab 430. Tab 432 is sized to fit between, and be captured within, the space between tines 426 and 428 on the outer edge of diaphragm 404"". In the unexcited state of the speaker shown in FIG. 41A, substantially equally sized portion of bladder 424 extend upward from basket 402 and downward into basket 402, similar to surrounds 418 and 420 in FIG. 36A. It can be seen from the maximum outwardly excited state shown in FIG. 41B and the s maximum inwardly excited state shown in FIG. 41C, that bladder 424 is stretched in the same way as do surrounds 418 and 420 in FIGS. 36B and 36C. Thus the performance of this embodiment is substantially the same as the first embodiment of FIG. 36.

Figure 42A:
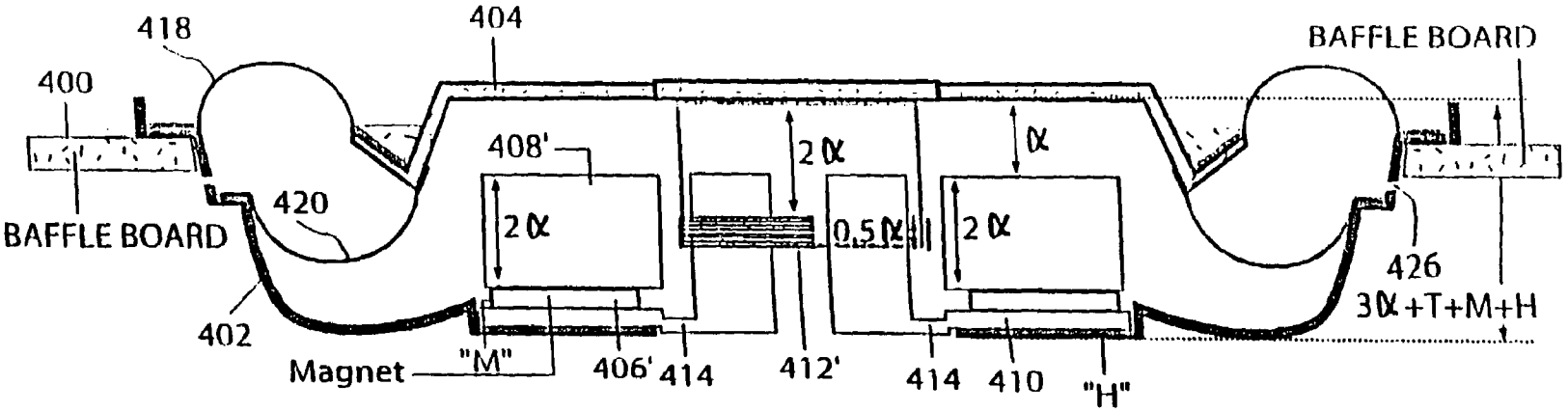
FIG. 42 show a first embodiment low profile, underhung, shallow speaker design in cross-section with FIG. 42A in the unexcited position, FIG. 42B in the maximum outward excursion position, and FIG. 42C in the maximum inward excursion position.

FIG. 42 illustrate a first underhung, low profile speaker embodiment of the present invention. This embodiment is similar to the overhung embodiment of FIG. 36 with only three changes. One change is the replacement of magnet 406 that has a height of 2α (FIG. 36) with magnet 406' with a height of "M" (FIG. 42) in the same location of the structure. A second change is the replacement of steel ring 408 that has a thickness of "T" (FIG. 36) with a steel ring 408' with a thickness of 2α (FIG. 42). The third change is the replacement of voice coil 412 with a coil winding that is 2α high and spaced 0.5α below the underside of diaphragm 404 (FIG. 36) with a voice coil 412' with a coil winding that is 0.5α high and spaced 2α below the underside of diaphragm 404 (FIG. 42). With these changes the underhung, low profile speaker of FIGS. 42A, B and C performs in the same way as the overhung, low profile speaker of FIGS. 36A, B and C with the same overall heights of the speaker in each of the illustrated excitation/non-excited positions illustrated in FIGS. 36A, B and C and FIGS. 42A, B and C, respectively.

Namely, in FIG. 42A the overall height is the spacing height between the under side of diaphragm 404 and the top side of ring 408', α, plus the thickness of ring 408', 2α, plus the height of magnet 406', "M" (that is equal to "T"), plus the thickness of the flange on 414, "T", plus the thickness of the bottom of basket 402, "H", for an overall height of 3α+T+M+H which is equal to 3α+2T+H in FIG. 36A.

Figure 42B:
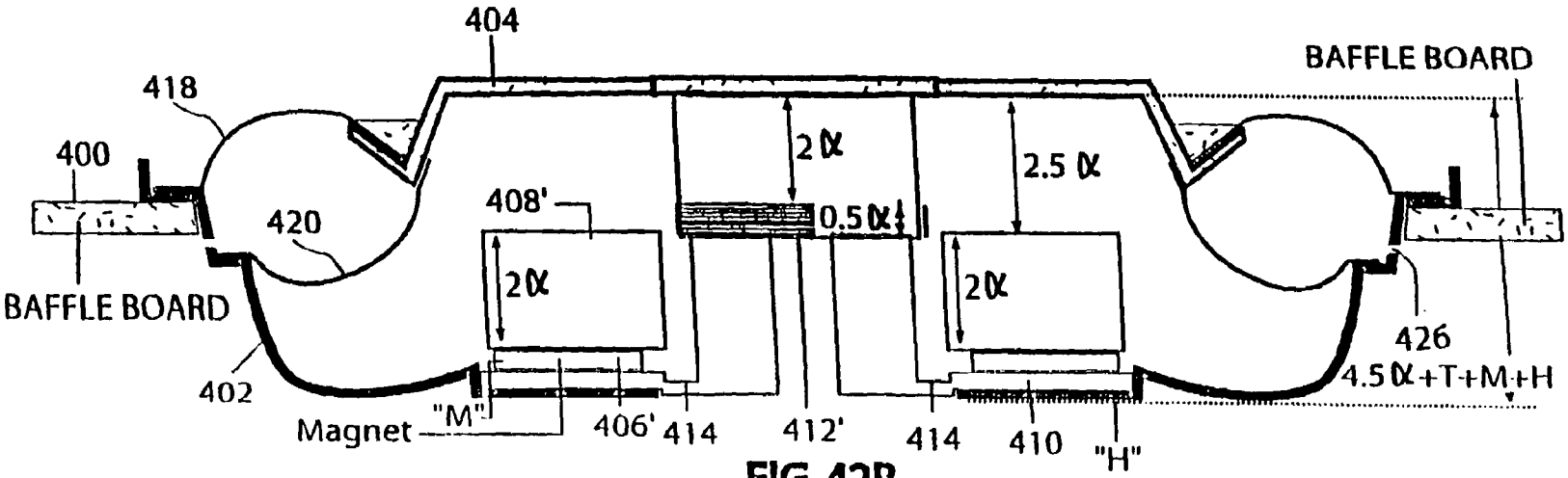

In FIG. 42B the overall height is the spacing of the winding of voice coil 412' from the underside of the diaphragm, 2α, plus the height of the coil winding, 0.5α, plus the thickness of ring 408', 2α, plus the height of magnet 406', "M" (that is equal to "T"), plus the thickness of the flange on 414, "T", plus the thickness of the bottom of basket 402, "H", for an overall height of 4.5α+T+M+H which is equal to 4.5α+2T+H in FIG. 36B.

Figure 42C:
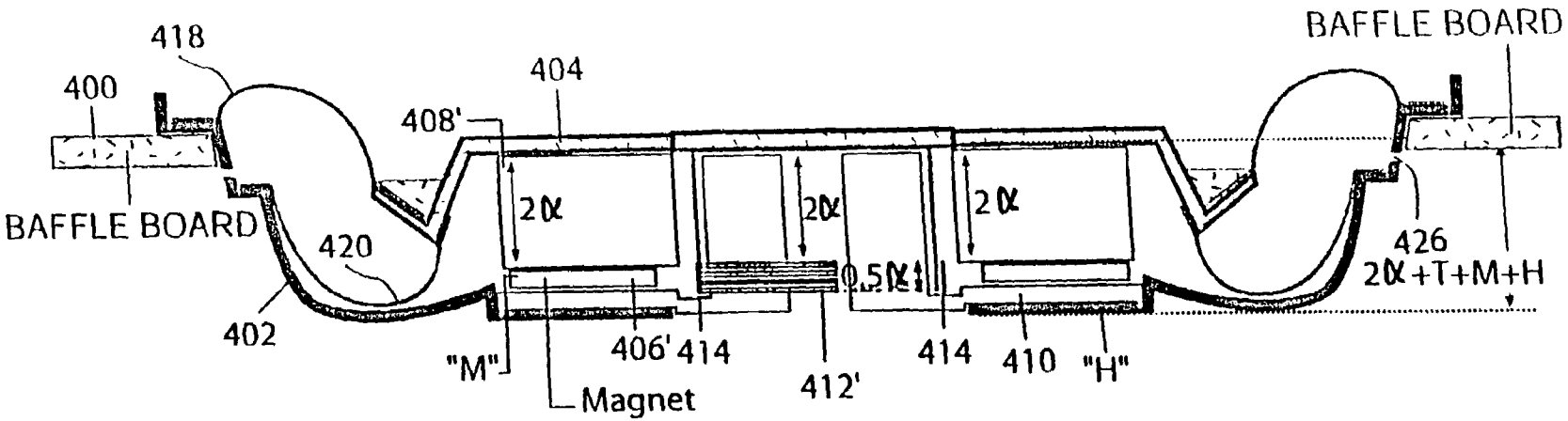

In FIG. 42C the overall height is the spacing of the winding of voice coil 412' from the underside of the diaphragm or the thickness of ring 408', 2α, plus the height of magnet 406', "M" (that is equal to "T"), plus the thickness of the flange on 414, "T", plus the thickness of the bottom of basket 402, "H", for an overall height of 2α+T+M+H which is=to 2α+2T+H in FIG. 36C.

Figure 43A:
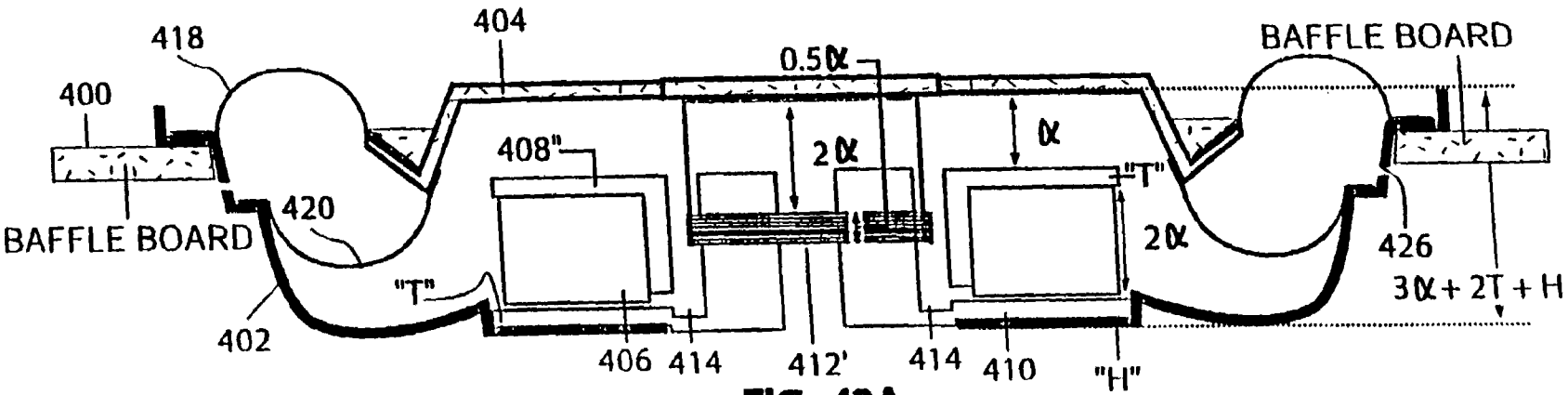
FIG. 43 show a second embodiment low profile, underhung, shallow speaker design in cross-section with FIG. 43A in the unexcited position, FIG. 43B in the maximum outward excursion position, and FIG. 43C in the maximum inward excursion position.
Figure 43B:
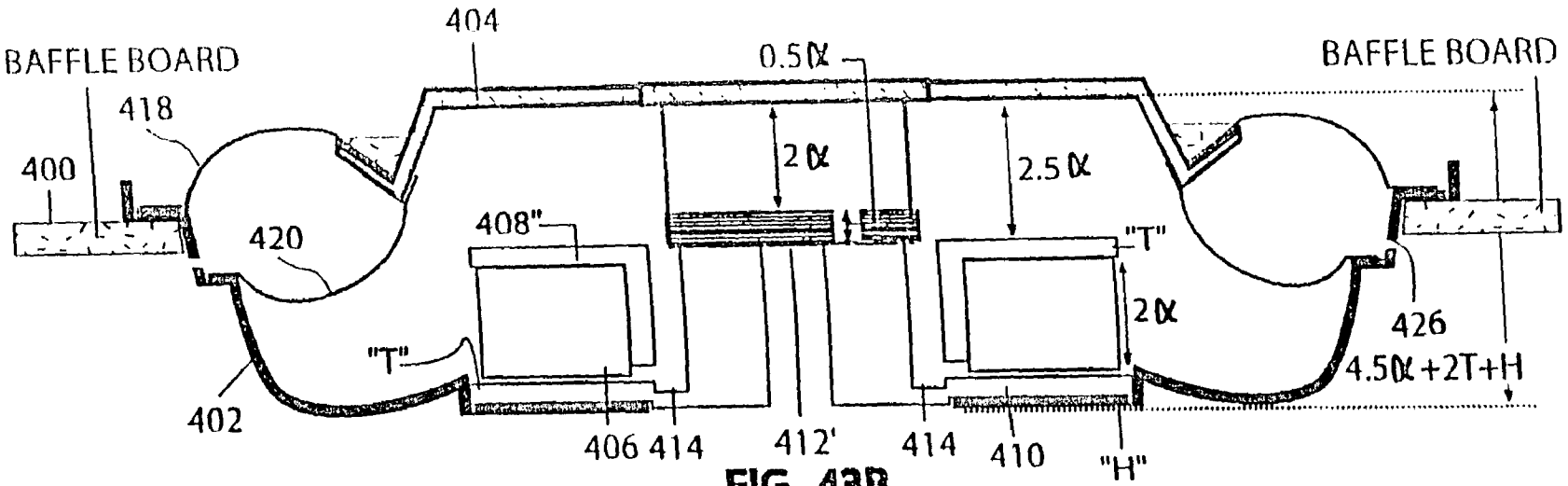
Figure 43C:
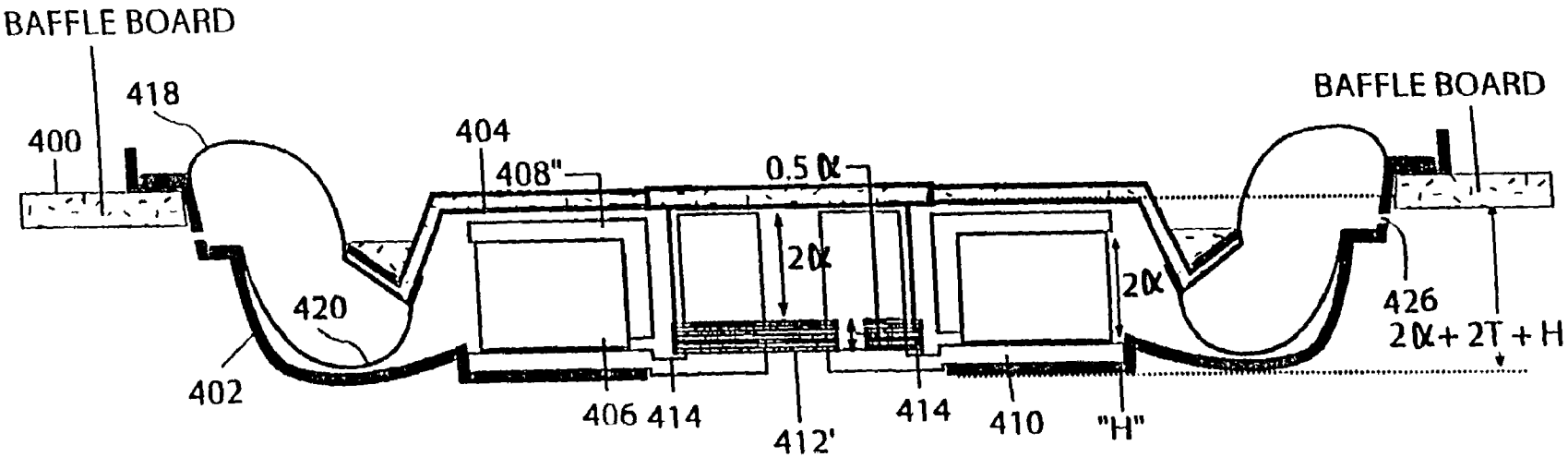

A second embodiment of an underhung, low profile speaker of the present invention is illustrated in FIG. 43. This embodiment is also similar to the first overhung embodiment of FIG. 36 with two changes to the speaker structure. One change is the replacement of voice coil 412 with a coil winding that is 2α high and spaced 0.5α below the underside of diaphragm 404 (FIG. 36) with a voice coil 412' with a coil winding that is 0.5α high and spaced 2α below the underside of diaphragm 404 (FIG. 43). The other change is the replacement of steel ring 408 (FIG. 36) with a second steel doughnut 408" with a flange inverted over magnet 406. The doughnut portion of 408" having an outer diameter that is substantially the same as the inner diameter of magnet 406, and an outer diameter that is substantially less than the outer diameter of the doughnut portion of 410 thus leaving a space between the two doughnuts that is significantly wider than the thickness of the mounting ring of voice coil 412'. The doughnut portion of 408" extends down the inside surface of the magnet, nearly the entire height of the magnet leaving a space between the bottom end of 408" and the upper surface of the flange of 410. The flange portion of 408" having a thickness, "T", that is the same as the thickness of ring 408 in FIG. 36. The doughnut portion of 408" being needed to extend the effect of the upper pole of magnet 406 (typically considered to be the North pole) into the space traversed by the winding of voice coil 412' to permit operation of the speaker in an underhung configuration.

Figure 45A:
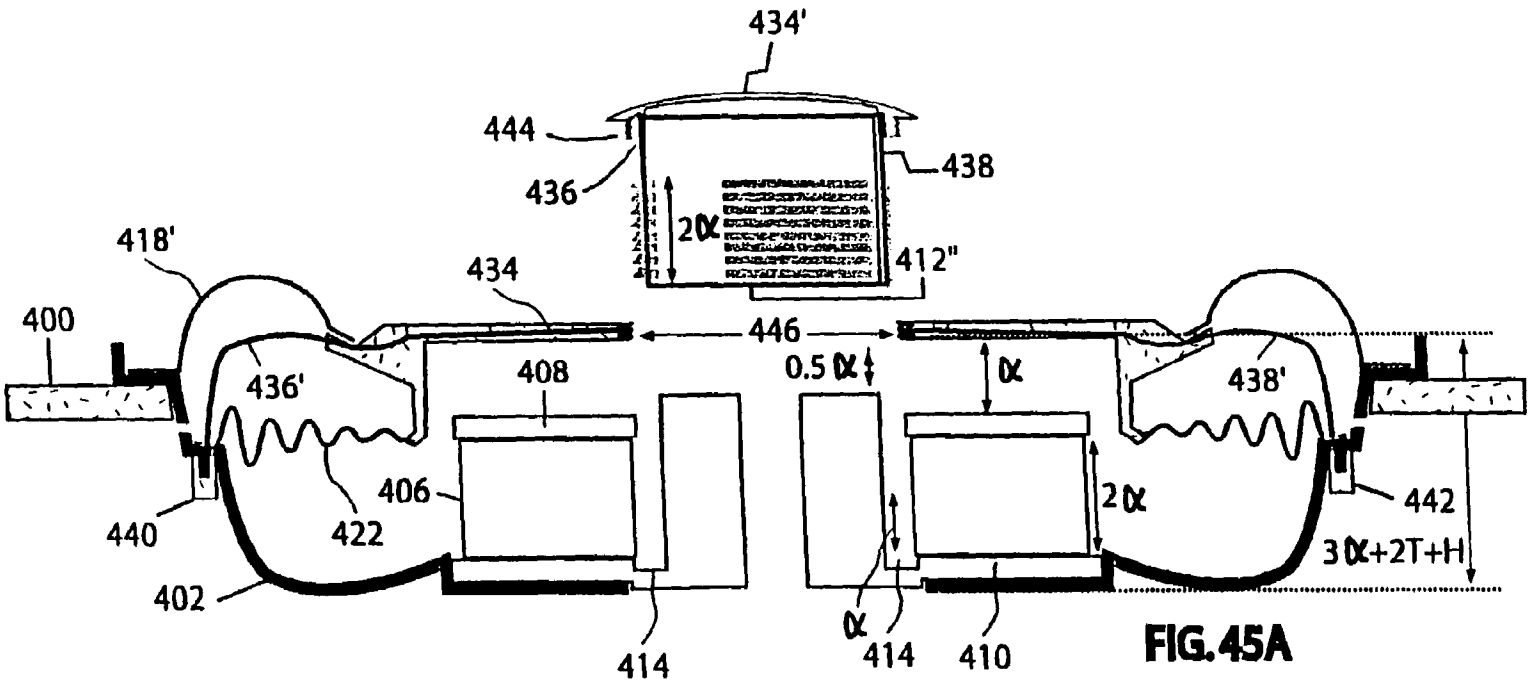
FIG. 45 show a first embodiment low profile, shallow speaker design in cross-section having a replaceable voice coil with FIG. 45A showing the voice coil external to the reminder of the speaker, and FIG. 45B showing the voice coil installed in the speaker.
Figure 45B:
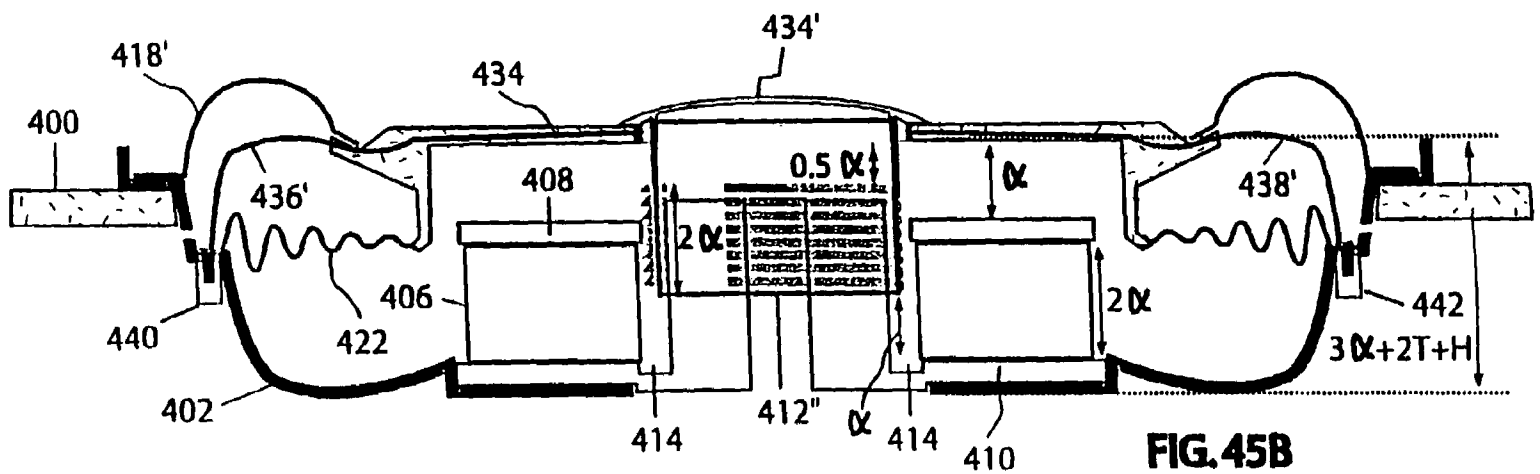

FIG. 45 show an embodiment of a speaker with a replaceable voice coil, the speaker otherwise being similar to the speaker shown in FIG. 40. In FIG. 45A there is shown in the upper part of that figure, the removable/replaceable voice coil assembly and in the lower part of that figure the assembled other components of the speaker. In addition to what is shown in FIG. 40, the lower part of FIG. 45A also includes a modified diaphragm 434 that is similar to diaphragm 404'" with the center removed from above the location for the voice coil. The diameter of the center hole in diaphragm 434 being slightly larger than the diameter of voice coil 412" shown in the upper part of FIG. 45A. Forming the edge of the center hole in diaphragm 434 is a bifurcated conductive internally threaded ring 446 that is described more fully below. In this view, the left side of ring 446 is electrically connected to conductor 436 that is molded into the diaphragm and passes through the space between surround 418' and spider 422 on the left side and is then coupled to connector 440 that is disposed to be connected to an amplifier to apply signal to the voice coil. Similarly, the right side of ring 446 is electrically connected to conductor 438 that is molded into the diaphragm and passes through the space between surround 418' and spider 422 on the right side and is then coupled to connector 442 that is also disposed to be connected to an amplifier to apply signal to the voice coil.

The voice coil assembly in the upper portion of FIG. 45A includes voice coil 412" with the coil winding on a typical voice coil bobbin. One lead wire 436 of the coil is shown extending to the top of the bobbin on the left side, while the other lead wire of the coil is shown extending to the top of the bobbin on the right side. Surrounding the top of the voice coil bobbin is a bifurcated conductive externally threaded ring 444 that is described more fully below. The left conductive half of ring 444 has lead wire 436 connected thereto, while the right conductive half of ring 444 has lead wire 438 connected thereto. Then covering the top of the bobbin is circular cap 434' that closes the center of diaphragm 434 when voice coil 412" is installed as in FIG. 45B. Voice coil 412" is installed by inserting the lower end of the bobbin first through the central hole in diaphragm 434 and then screwing ring 444 into ring 446 and positioning the left half of ring 444 on the bobbin opposite the left half of ring 446 which then causes the right half of ring 444 to be in contact with the right half of ring 446. When so positioned, lead wire 436 is electrically connected, through the left half of rings 444 and 446 with wire 436 and connector 440, and similarly lead wire 438 is electrically connected, through the right half of rings 444 and 446 with wire 438 and connector 442.

Figure 44B:
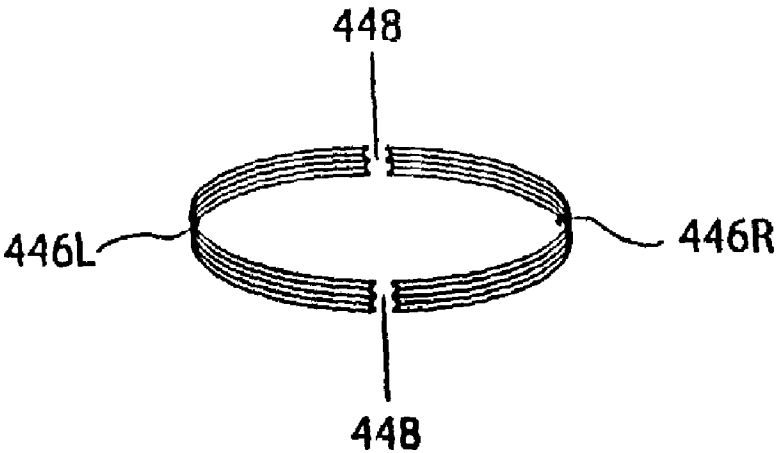
FIG. 44 show an attachment mechanism for the replaceable voice coil of FIG. 45 with FIG. 44A being an exploded, perspective view of the voice coil attachment components and FIG. 44B being a perspective view showing the screw type conductors of FIG. 44A in a joined position.
Figure 44A:
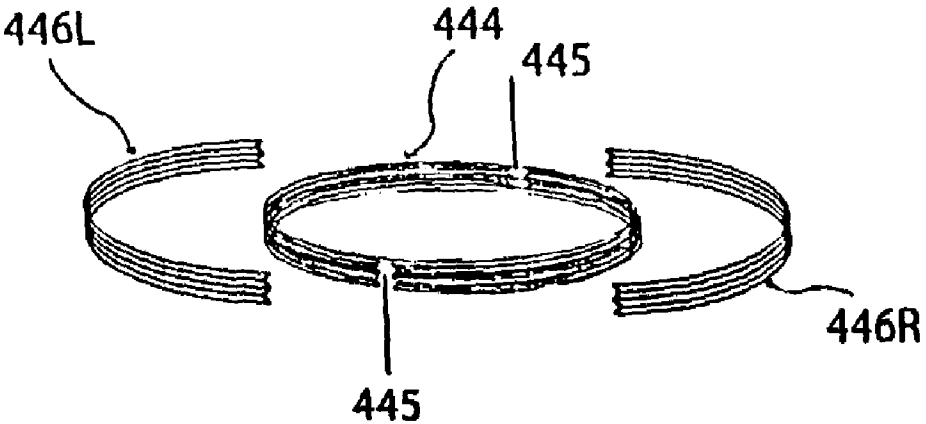

The details of rings 444 and 446 are shown in FIGS. 44A and 44B. In FIG. 44A ring 444 can be seen to consist of right and left halves which are bound together with non-conductive elements 445 (e.g., plastic or epoxy) to form the ring. Also shown in FIG. 44A are ring 446 sections 446L and 446R in an exploded relationship with respect to ring 444. Then in FIG. 44B, the two halves of ring 446 are shown assembled as is ring 444, with non-conductive elements 448 joining the two halves while electrically isolating one half from the other.

Figure 46A:
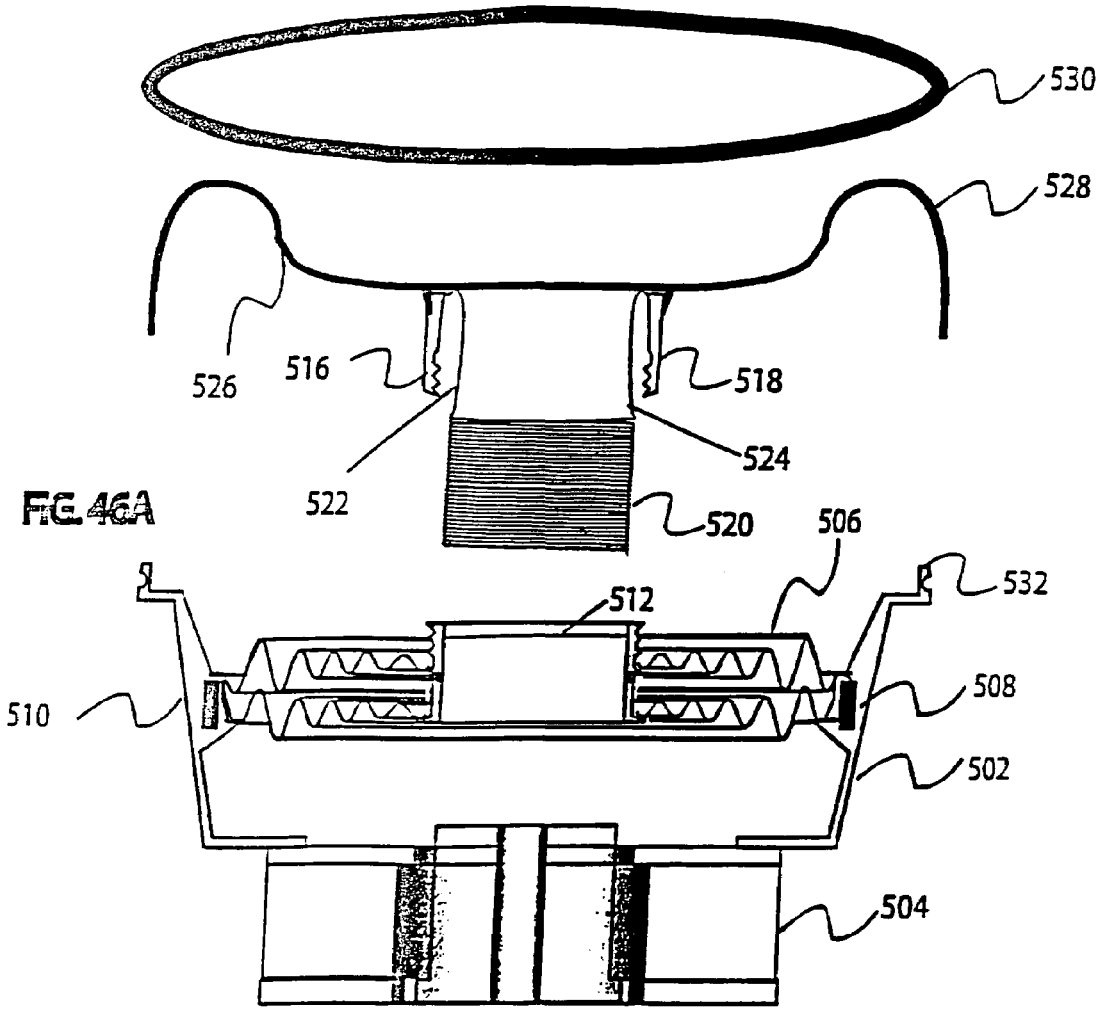
FIG. 46 show in cross-section a speaker in a conventional configuration with a replaceable cone and voice coil with FIG. 46A showing the cone removed and the details for attachment of the cone and voice coil to the remainder of the speaker.
FIG. 46B shows the fully assembled speaker.
Figure 46B:
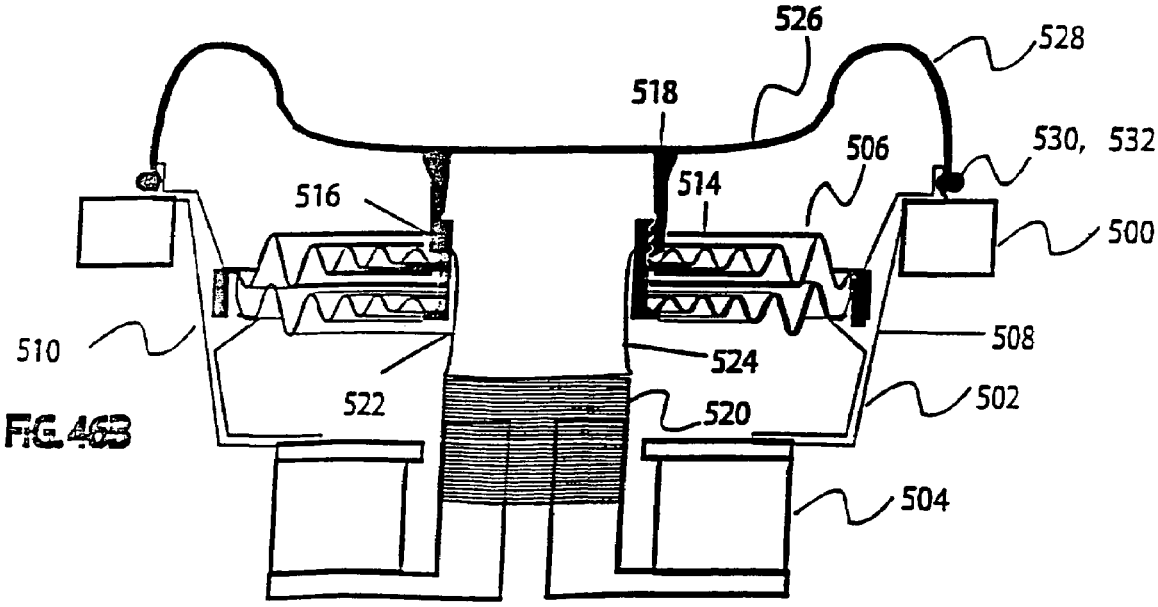

FIG. 46 are provided to illustrate a second embodiment of a speaker with a removable/replaceable cone or voice coil, or both. While the views shown in FIG. 46 are that of a conventional speaker, the same techniques can be used with low profile speaker. FIG. 46A shows an exploded view of the speaker of the this embodiment, and FIG. 46B shows the same speaker fully assembled. The speaker is to be mounted on a baffle board 500 with a flange of basket 502. Shown at the bottom of the basket is magnet assembly 504. Within the basket and above magnet 504, is a spider assembly 506 with a center cylinder 512 having external screw threads 514 around the upper end thereof. Cylinder 512 and threads 514 can be made of a non-conductive material, or threads 514 could be a conductive ring 446 such as that of FIG. 44B. On the left side of cylinder 512, a conductive wire (not shown) extends from threads 514, through spider 506 to an external connector 510 that is disposed to be connected to an audio source. Similarly, on the right side of cylinder 512, a conductive wire (not shown) extends from threads 514, through spider 506 to an external connector 508 that is disposed to be connected to the same audio source. The purpose of these wires and external connectors will soon become apparent. Extending above the flange is a rim with a concave half circle groove 532.

Also included is a cone 526 with surround 528 bonded to the outer edge of the cone. Beneath the center of cone 526 is a voice coil 520 on a bobbin with one lead 522 from the coil extending up the left side of the bobbin to the underside of the cone, and on the right side of the bobbin the other lead 524 of the coil also extends upward to the under side of the cone. The bobbin can either be permanently fixed to the under side of the cone, or it can with ring 444 (FIG. 44A) to the top edge of the bobbin screwed into a ring 446 that is bonded to the underside of the cone.

Also connected to the underside of the cone, outside of, and spaced apart from, of the bobbin, is a downwardly extending cylinder that is approximately one third the length of the bobbin with an internal thread at the lower end thereof. That cylinder includes a left conductive portion 516 and a right conductive portion 518 that are connected at their cone end to lead wires 522 and 524, respectively. Conductive portions 516 and 518 could be left and right sides of a ring such as ring 446, or lead wires 522 and 524 could be extended from the cone down into the internal threads of 516 and 518.

The final step of assembly of such a speaker is the lowering of the cone/voice coil assembly to the mouth of basket 502 with the winding of the voice coil passing through the central cylinder supported by the spider with the windings of the coil extending to the magnet assembly. The cone/voice coil assembly is attached to the cylinder/spider assembly by mating the internal threads of the cylinder attached to the cone with the outer threads of the cylinder taking care to position the cone/voice coil assembly such that lead wires 522 and 524 are coupled to external connectors 510 and 508, respectively. Once the voice coil is positioned as such, the final step of assembly is the placement of the outer edge of surround 528 to the outside of the rim on the basket flange opposite the concave half circle groove 532. Then elastic ring 530 is placed around the so located outer edge of the surround to seat the edge of the surround in groove 532 and retained in that position by elastic ring.

With a speaker of this design, a user of such a speaker will be able to replace either the voice coil of the cone should they, or the surround be however damaged. Also the user will be able to interchange the cone and/or voice coil with those of a different design or configuration to produce a different audio response and sound from the speaker.

Anti-Wobble Voice Coil Speaker

Figure 47:
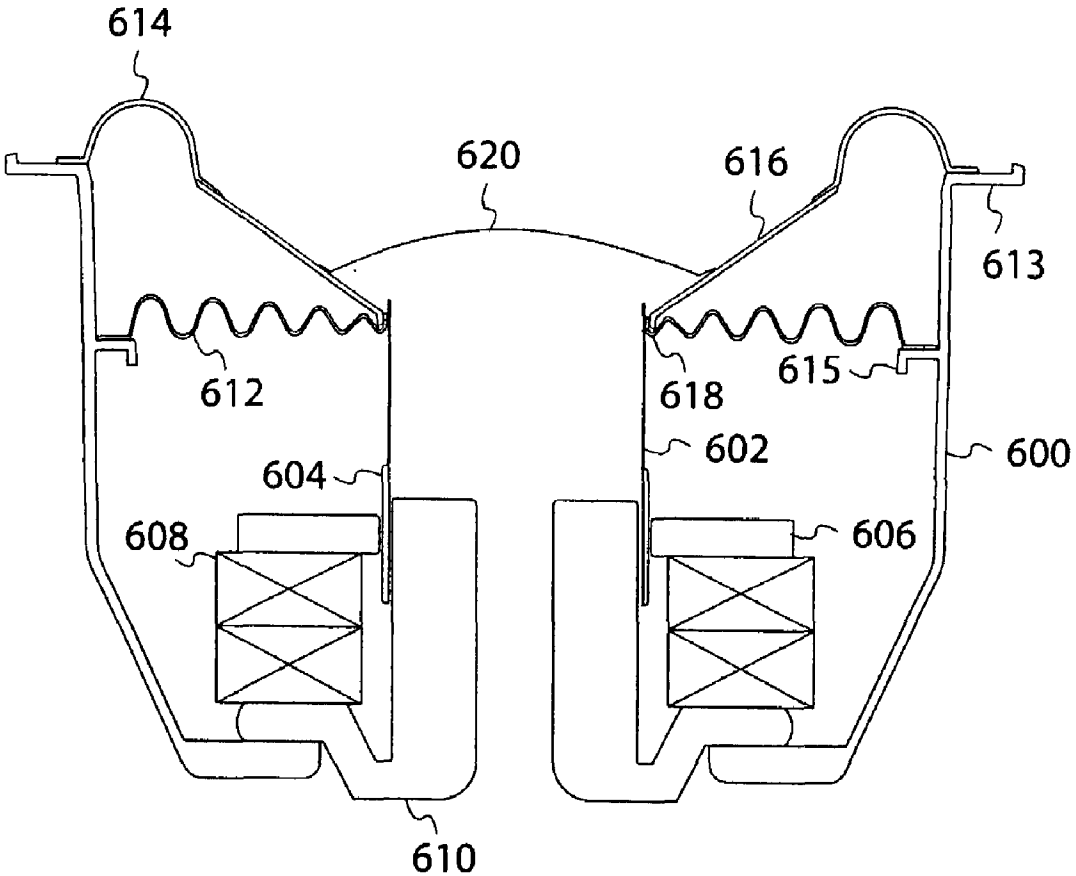
FIG. 47 (PRIOR ART)
FIG. 47 shows, in cross-section, or a center slice of, a convention speaker with the spider connected to the top edge of the voice coil bobbin (cross-hatching has been omitted to minimize confusion)

Referring next to FIG. 47 there is shown, in cross-section, or a center slice of, a convention speaker with the spider connected to the top edge of the voice coil bobbin and without cross-hatching to minimize confusion. This speaker includes a basket 600 with the excitation motor mounted in the bottom of basket 600. The motor includes a steel center pole piece 610 centered in the bottom of basket 600 and extending upward away from the bottom of the basket into the interior thereof. Next there is shown a pair of circular magnets 608 resting on an outward extending flange of pole piece 610 and surrounding the upward extending portion of pole piece 610. Then, on the top surface of the top magnet 608 is a circular steel top plate 606 having a circular center hole that has a diameter that is somewhat larger than the outer diameter of pole piece 610 to allow room for the lower portion of voice coil bobbin 602 and the voice coil 604 wound thereon to pass within a narrow space between the outer surface of pole piece 610 and the inner hole through top plate 606. Thus the inner diameter of bobbin 604 is slightly larger than the outer diameter of pole piece 610 and the outer diameter of the combination of bobbin 602 and voice coil 604 wound thereon is smaller that the diameter of the center hole in top plate 606.

Attached to the top rim 613 of basket 600 is the outer edge of surround 614 with the inner edge of surround 614 attached to the outer edge of cone 616. Additionally, cone 616 has a center hole therethrough that is substantially the same diameter as the diameter of bobbin 602. Basket 600 includes an interior flange 615 that extends completely around the inner surface of basket 600 at a point that is slightly deeper in basket 600 than the top edge of bobbin 602 when the fully assembled speaker is not excited. Additionally, included is a spider 612 having an outer edge with a diameter that is substantially the same as the inner diameter of basket 600 at flange 615 and a center hole that has substantially the same diameter as bobbin 602. The outer edge of spider 612 is attached to flange 615. The edges defining the center holes of cone 616 and spider 612 are both attached around bobbin 602 near the top edge thereof at connection point 618. To complete the conventional speaker of FIG. 47, a non-structural dust cap 620, having an outer diameter that is greater than the diameter of bobbin 602, has that outer diameter edge attached to the outer face of cone 616 to cover the center hole in bobbin 602.

Figure 48A:
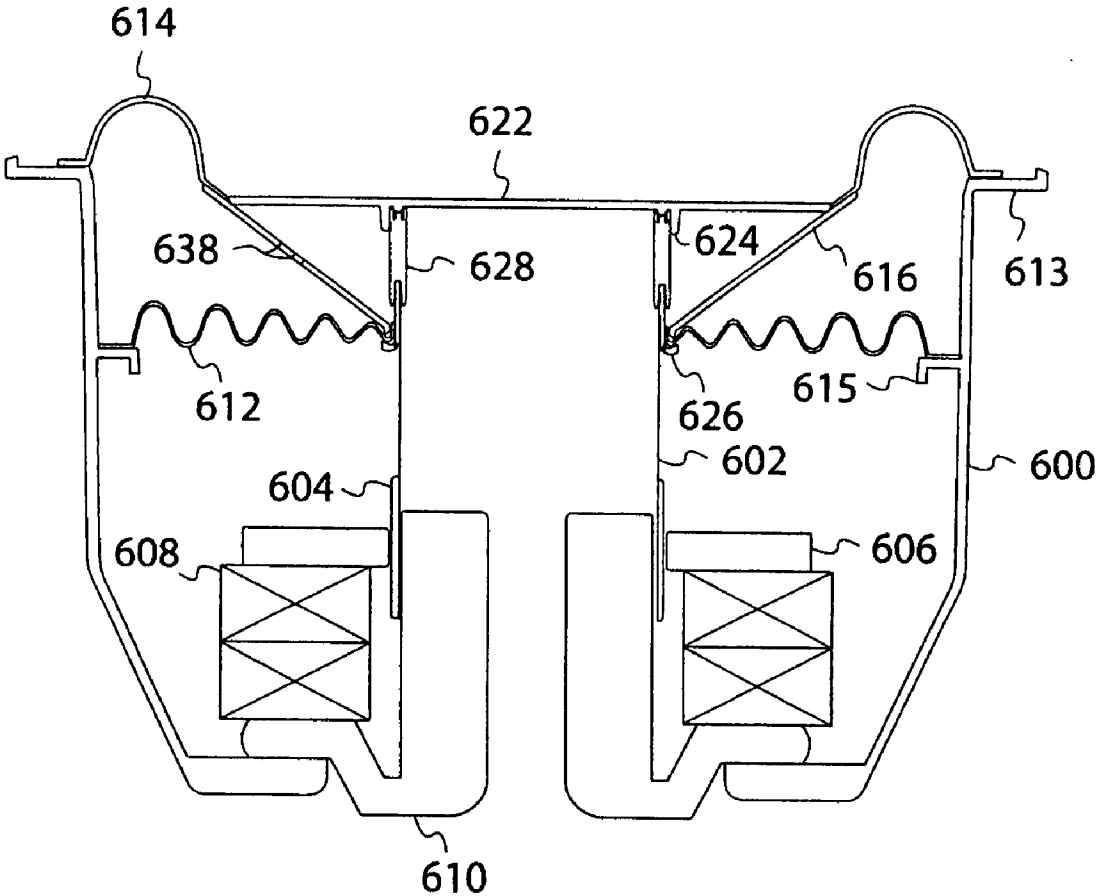
FIG. 48A shows, in cross-section, or a center-slice of, a another embodiment of a speaker of the present invention that minimizes wobble of the voice coil bobbin during excursions during use that is easily assembled (cross-hatching has been omitted to minimize confusion)

FIG. 48A shows, in cross-section, or a center-slice of, another embodiment of a speaker of the present invention that minimizes wobble of the voice coil bobbin during excursions during use that is also easily assembled. To permit operational comparisons below of the speaker of this embodiment with the conventional speaker of FIG. 47, the basic structure of the embodiment shown in FIG. 48A includes many of the same components as in the conventional speaker of FIG. 47. Where the components are the same, the same reference numbers are used in FIG. 48A as in FIG. 47. Those components include: basket 600, voice coil bobbin 602, voice coil 604, magnet top plate 606, circular magnets 608, magnet center pole piece 610, spider 612, basket top rim 613, surround 614, basket interior flange 615 and cone 616 with dust cap 620 not being needed.

The embodiment of FIG. 48A additionally includes three components that are not in a conventional speaker. The components are joining collar 626, extension ring 628 and lateral support diaphragm 622. The interaction of these components can be more clearly be seen in the partial exploded view of FIG. 48B. Joining collar 626 is circular in shape with an inner diameter that is substantially the same as the outer diameter of bobbin 602, has a straight top edge and an outward flaring lower edge. Joining collar 626, when placed around the top edge of bobbin 602 is glued in place with the top edges of joining collar 626 and bobbin 602 substantially even with each other and the outward flaring lower edge of joining collar 626 being on the order of ¼" to ½" below the top edge of bobbin 602 and flaring outward on the order of ⅛" to ¼". These dimensions with vary depending on the size of the speaker and the thickness of the material from which spider 612 and cone 616 are constructed which will be better understood below.

Once joining collar 626 is in place on bobbin 602, the inner edge of spider 612 is placed around the upper edge of bobbin 602 in contact with the outward flaring lower edge of joining collar 626, either before or after the voice coil 604 end of bobbin 602 is placed in the space between center pole piece 610 and top plate 606 with the outer edge of spider 612 resting on flange 615 to which it is attached. Next, cone 616, with surround 614 attached around the outer edge is installed by placing the inner edge that defines the center hole of cone 616 around the top end of bobbin 602 and joining collar 626 with that inner edge of cone 616 on top of the inner edge of spider 612, against the flaring lower edge of joining collar 626 where they are fastened with glue or another appropriate fastening means. In this position, the outer edge of surround 614 is resting on top rim 613 of basket 600 to which it is attached. At this point in the assembly, bobbin 602 and voice coil 604 are positioned substantially in the at rest position of the speaker when no current is flowing in voice coil 604, being supported in that position by spider 612 and surround 614.

Figure 48B:
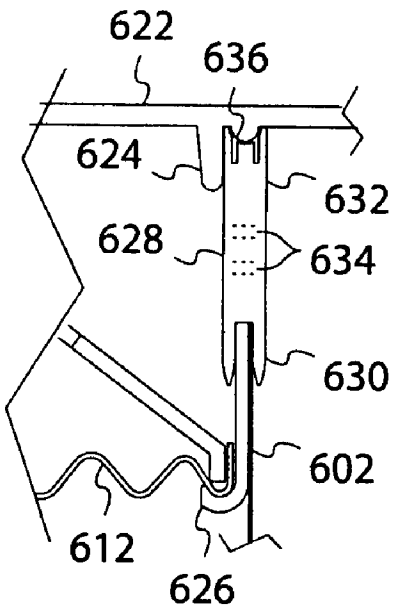
FIG. 48B is a partial view of the speaker of FIG. 48A to illustrate the details of various items of the speaker and how they attach to the top edge of the voice coil bobbin.

Then the lower end 630 of extension ring 628 is placed on the combined upper ends of bobbin 602 and joining collar 626. From FIG. 48B is can be seen that the lower end 630 of extension ring 628 is bifurcated with the width of the notch therein substantially the same as the combined thickness of bobbin 602 and joining collar 626 with the diameters of the two sides of the notch being substantially the same as the inner diameter of bobbin 602 and the outer diameter of joining collar 626, respectively, with lower end 630 glued in place. The height of extension ring 628, as will be seen from the discussion below, is selected so that when lateral support diaphragm 622 is in place the outer edge thereof extends outward and makes contact with cone 616 at substantially the point at which cone 616 is joined to surround 614 with lateral support diaphragm glued to cone 616 and surround 614 at that point. Extension ring 628 could be made of any material with a non-conductive material such as plastic being preferred, and can be formed with air vents 634 through the side walls and spaced substantially uniformly around ring 628. The upper end 632 of extension ring 628 as viewed in cross-section as in FIG. 48B is in the form of a three tined fork with the center tine slightly shorter than the two outer tines.

To complete the assembly of the speaker, lateral support diaphragm 622 is then put in place. As can be seen in FIGS. 48A and 48B, on the under side of diaphragm 622 two centering features are formed thereon. One is a centering ring 624 that is perpendicular to the under side of lateral support diaphragm 622 with the center of the circle formed by centering ring 624 being the center of lateral support diaphragm 622, and the inside diameter of centering ring 624 is substantially the same as the outer diameter of extension ring 628. Slightly spaced apart from, and inside centering ring 624 is a circular positioning bead 636. Circular positioning bead 636 could be formed as a continuous ring of material or spaced apart raised dots in a circle inside centering ring 624.

When lateral support diaphragm 622 is attached to upper end 632 of extension ring 628, the outer surface of extension ring 628 abuts the inner side of centering ring 624 with the outer tines of upper end 632 on opposite sides of circular positioning bead 636, and the free end of the center shorter tine of upper end 632 in direct contact with the top of positioning bead 636. Positioning bead 636 and the upper forked end 632 of extension ring 628 have been included to provide more positive connection between the under side of lateral support diaphragm 622 and extension ring 628, however satisfactory operation of the speaker would be provided without those features. To complete the assembly of the speaker, the outer edge of lateral support diaphragm 622 is attached to the outer face of cone 616 and surround 614, at the point of connection between cone 616 and surround 614, with a suitable glue. Lateral support diaphragm 622 can be made of any suitable material that provides the desired stiffness, e.g., metal, pressed paper, carbon fiber plastics, any of these materials with a foam or honeycomb interior, other composite and non-composite light-weight materials or any other material with the desired structural characteristics; conventional cone materials will not work in this application.

Lateral support diaphragm 622 functions similarly to the "cone" of a conventional speaker; diaphragm 622 is the sound radiator in the speaker of the present invention wherein the cone is the sound radiator of the conventional speaker. In the present invention the lateral support diaphragm 622 is stiff, substantially flat and light-weight. Additionally, cone 616 can be made of conventional materials since the only purpose of cone 616 is one of the structural elements that minimize or eliminate wobble of bobbin 602.

The ends of the wire of voice coil 604 are typically glued to, and dressed up the outside of bobbin 602 toward the upper end portion thereof. Those wires could be then dressed up the underside of cone 616 for attachment to other wires that are attached to input terminals (not shown). Alternatively, the ends of the voice coil wires that have been dressed up the outside of bobbin 602 could be connected to wires that have been placed through spider 612 with the other end of those wires close to basket 600 then attached to input terminals (not shown) mounted on the basket.

In operation, when the speaker is placed in an enclosure, air is free to flow through the mesh or open construction of spider 612, through vent holes 634 in extension ring 628 and through vent holes 638 through cone 616 that are evenly spaced therearound. Cone 616 serves as one of the structural components of the voice coil bobbin 602 anti-wobble triangle shown in FIG. 48A (actually a triangular ring in the complete speaker). That triangle includes cone 616 as one side, the portion of lateral support diaphragm 622 outside of centering ring 624 as a second side, and the third side is the combination of extension ring 628 and the end of bobbin and joining collar 626 above the attachment flange. That triangle, as a result of the stiffness of the components that form that triangle, is rigid and holds its shaped during operation of the speaker. The anti-wobble triangle assembly together with spider 612 attached to the lower corner of the triangle substantially eliminates wobble of bobbin 602 at all positions relative to the magnet assembly during excitation of the speaker.

Further, cone 616 could have air vent holes 638 formed therethrough and evenly placed therearound to vent the anti-wobble support triangle. Since the upper face of cone 616 is totally enclosed beneath lateral support diaphragm 622, cone 616 is non-functional with respect to radiating sound from the speaker; diaphragm 622 is the sound radiator. Thus vent holes 638 through cone 616 are not detrimental to sound reproduction. Vent holes 638 in cone 616 and vent holes 634 in extension ring 628 keep the pressure within the triangle the same as the rest of the space within the speaker beneath surround 614 and lateral support diaphragm 622 to minimize the possibility of varying the shape of the anti-wobble triangle by pressure that could be greater inside or outside the triangle.

It should also be kept in mind that when the speaker is viewed from above, the shape of the mouth of basket 600 and lateral support diaphragm 622 is not limited to being round. That shape can be any that is desired for whatever reason. While round and oval are probably the most common shapes since they are the most practical, the present invention can be used with speakers that have a triangular, square, rectangular or any polygonal shape.

The next several figures are presented to illustrate the various bending forces on the various components of the conventional speaker of FIG. 47 that cause wobble of the voice coil bobbin in comparison with cancellation of forces in the sub-zero speaker of the present invention of FIG. 48A.

Figure 49A:
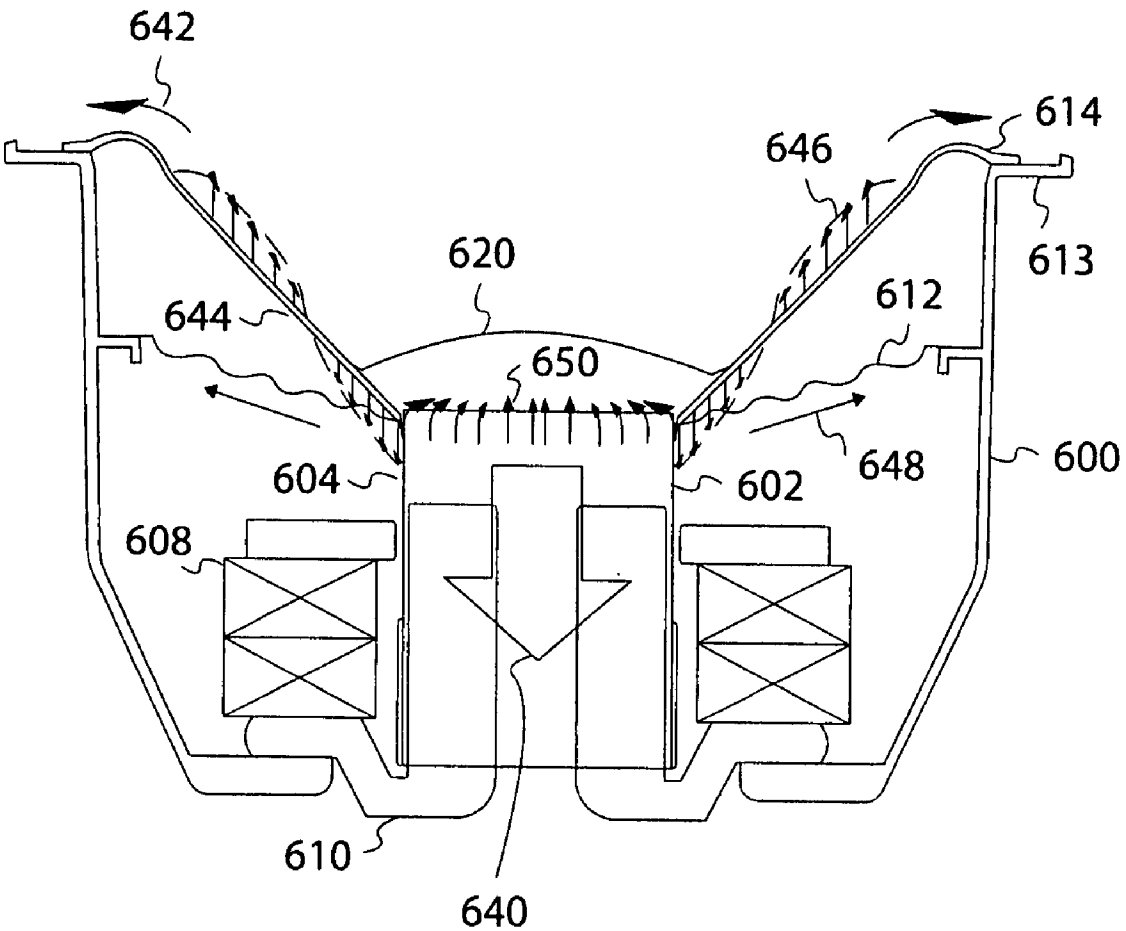
FIG. 49A (PRIOR ART)
FIG. 49A is the conventional speaker of FIG. 47 with the voice coil drawn inward to the position of the maximum stroke with the bending forces shown on the cone and bobbin.

FIG. 49A illustrates the conventional speaker of FIG. 47 with the voice coil bobbin 602 drawn inward by signal force 640 to the position of the maximum inward stroke. As bobbin 602 moves from the unexcited position (at rest), spider 612 applies a tension on the top edge of bobbin 602. In the drawn inward position illustrated here, spider force 648 has a horizontal component that is away from the center of the speaker, as well as an upward vertical component. The resiliency of surround 614 also creates an outward and upward force on the outer edge of cone 616. These forces create bending forces and moments on both bobbin 602 and cone 616.

These forces subject the top portion, or neck, of bobbin 602 to bending forces and moments 650 that tend to collapse the neck of bobbin 602 inward whenever signal force 640 is drawing bobbin 602 inward. These forces and moments increase in proportion to the strength of an inward drawing signal force 640 and are greatest when bobbin 602 is drawn inward to the maximum position as shown in FIG. 49A. Similarly, cone 616 experiences bending forces: outward 646 on the outer portion of cone 616, and inward 644 on the inner portion of cone 616. Rigid dust cap 620 contributes to the cone bending force direction on the inner and outer portions of cone 616. Due to variations in the stiffness of cone 616 at various locations and variations in the thickness and possible internal defects in bobbin 602, the effect of the various forces produce differences in the amount of bending of cone 616 and the upper region of bobbin 602 relative to different signal forces 650 that cause variations in the spacing of the lower portion of bobbin 602 between magnet 608 and center pole piece 610. This results in wobble of bobbin 602 on the in-stroke.

Figure 49B:
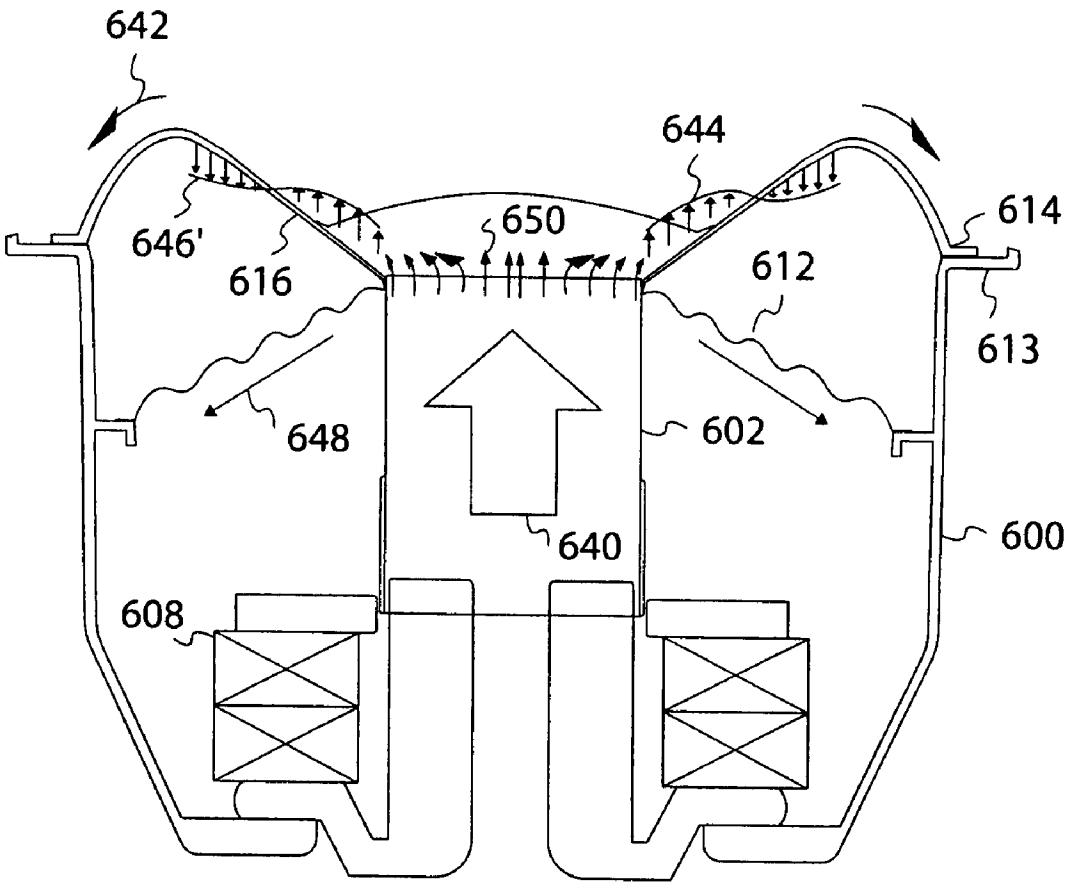
FIG. 49B (PRIOR ART)
FIG. 49B is the conventional speaker of FIG. 47 with the voice coil driven outward to the position of the maximum stroke with the bending forces shown on the cone and bobbin.

FIG. 49B illustrates the conventional speaker of FIG. 47 with the voice coil bobbin 602 driven outward by signal force 640 to the position of an extreme outward stroke. As bobbin 602 moves from the unexcited, the at rest, position spider 612 applies a tension on the top edge of bobbin 602. In the driven outward position illustrated here, spider force 648 has a horizontal component that is away from the center of the speaker, as well as a downward vertical component. The resiliency of surround 614 also creates an outward and downward force on the outer edge of cone 616. These forces create bending forces and moments on both bobbin 602 and cone 616.

These forces subject the top portion, or neck, of bobbin 602 to bending forces and moments 650 that tend to expand, flare outward, the neck of bobbin 602 whenever signal force 640 is driving bobbin 602 outward. These forces and moments increase in proportion to the strength of an outward driving signal force 640 and are greatest when bobbin 602 is driven outward to the extreme position as shown in FIG. 49B. Similarly, cone 616 experiences bending forces as on the in-stroke as in FIG. 49A but in the opposite directions: inward 646' on the outer portion of cone 616, and outward 644' on the inner portion of cone 616. Rigid dust cap 620 contributes to the cone bending force direction on the inner and outer portions of cone 616. Due to variations in the stiffness of cone 616 at various locations and variations in the thickness and possible internal defects in bobbin 602, the effect of the various forces produce differences in the amount of bending of cone 616 and the upper region of bobbin 602 relative to different signal forces 650 that cause variations in the spacing of the lower portion of bobbin 602 between magnet 608 and center pole piece 610. This results in wobble of bobbin 602 on the outstroke.

In each of FIGS. 49A and 49B it can be seen that when cone 616 is not in the at rest position of FIG. 47 there is a harmonic bending wave that travels through the skin of cone 616. As can be seen in FIGS. 49A and 49B, the forces on cone 616 have a bending waveform illustrated by the variation in magnitude of the force vectors along the surface of cone 616 with the direction of the force vectors changing direction at some point on the surface of cone 616. At the point where the force vectors change direction, cone 616 is bent in different directions that can be likened to bending of a thick piece of wire. These force variations during operation of the speaker cause plastic deformation of cone 616 with the material of cone 616 having a cycles per life failure rate. The non linear stiffness in the cone, along with the offset in the spider and in the outer surround will produces a wobble that is harmonically related to the signal. This distortion is audible and is typically ignored in current speaker design. If these differences in these parts are large enough and do not cancel each other, their force will cause voice coil bobbin 602, and perhaps also voice coil 604 to rub somewhere within the magnet assembly and eventually lead to speaker failure.

Figure 50A:
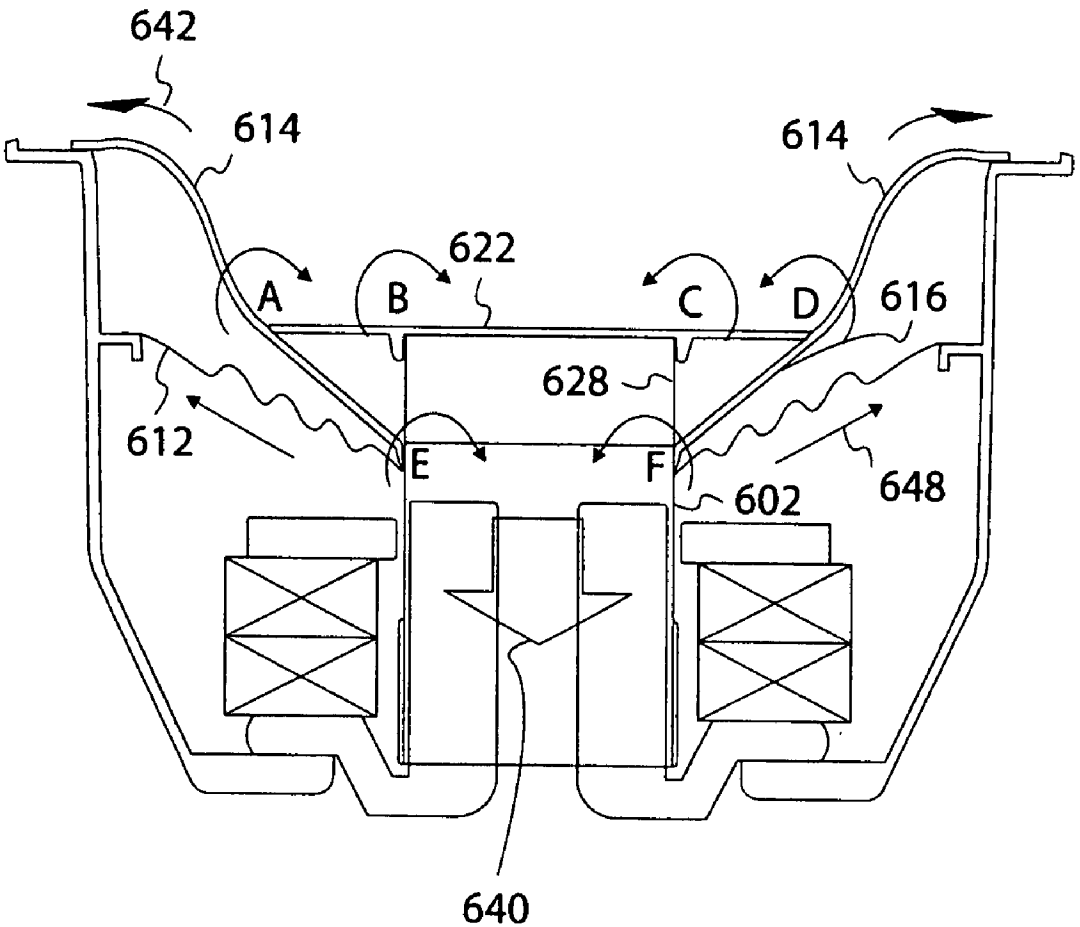
FIG. 50A is the sub-zero speaker of FIG. 48A with the voice coil drawn inward to the position of the maximum stroke illustrating the cancellation of the forces exerted on the various components of the speaker.

FIG. 50A illustrates the sub-zero speaker of FIG. 48A with bobbin 602 drawn inward to the position of the maximum stroke (similar to that of the conventional speaker of FIG. 49A). As in the conventional speaker, in the sub-zero speaker of the present invention as bobbin 602 moves from the unexcited, at rest, position, spider 612 applies a tension on the top edge of bobbin 602 where spider 612 and cone 616 are connected to bobbin 602. In the drawn inward position illustrated here, as in the conventional speaker of FIG. 49A, spider force 648 has a horizontal component that is away from the center of the speaker, as well as an upward vertical component. The resiliency of surround 614 also creates an outward and upward force on the outer edge of cone 616 at the point where the outer edge of lateral support diaphragm 622 is attached. These forces create bending moments at various points in the construction of the sub-zero speaker that result in tension or compression between those points that cause a cancellation of those forces and thus maintains bobbin 602 in substantially the same alignment as when in the at rest position of FIG. 48A as will be seen below.

To illustrate the cancellation of forces, bending moments are shown at various junction points of the components on opposite sides of the speaker. Those various points have been assigned letters that are shown in FIG. 50A as follows:

- A left junction of the outer edge of lateral support diaphragm 622 with the point at which the outer edge of cone 616 is joined to the inner edge of surround 614;
- B left junction of connecting ring 624 of lateral support diaphragm 622 and extension ring 628;
- C right junction of connecting ring 624 of lateral support diaphragm 622 and extension ring 628;
- D right junction of the outer edge of lateral support diaphragm 622 with the point at which the outer edge of cone 616 is joined to the inner edge of surround 614;
- E left junction of inner edges of cone 616 and spider 612, top edge of bobbin 602 and extension ring 628; and
- F right junction of inner edges of cone 616 and spider 612, top edge of bobbin 602 and extension ring 628.

It can be seen that junctions points A, B and E are each at a corner of a right triangle, as are junction points C, D and F. In the position of the components in FIG. 50A, signal force 640, spider force 648 and surround force 642 creates clock-wise bending moments at points A, B and E; and counter clock-wise bending moments at junction points C, D and F. Those bending moments thus generate compression between the following pairs of junction points: A-B, B-C and C-D; and tension between junction points A-E, B-E, C-F and D-F. Since the construction of the sub-zero speaker results in equally sized and shaped triangular areas (A-B-E and C-D-F) each with the right angle with the lateral support diaphragm 622 with the other points of each triangle pointing downward and outward, in combination with diaphragm 622 being rigid, all of the angles at the six junctions points remain the same at each position of an inward stroke that results in bobbin 602 remaining in the same alignment as in the at rest position.

Figure 50B:
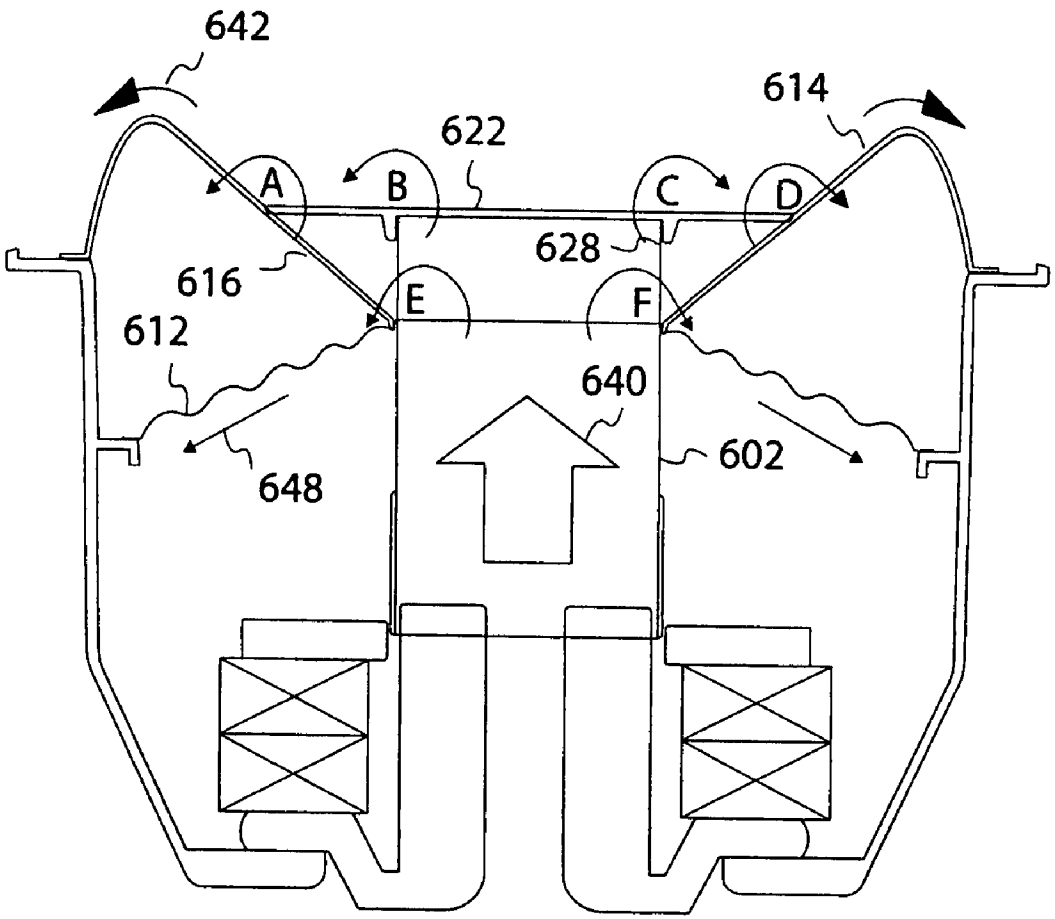
FIG. 50B is the sub-zero speaker of FIG. 48A with the voice coil driven outward to the position of the maximum stroke illustrating the cancellation of the forces exerted on the various components of the speaker.

In FIG. 50B the sub-zero speaker of FIG. 48A has the voice coil bobbin 602 driven outward to the position of the extreme stroke by signal force 640 (similar to the conventional speaker of FIG. 49B). In this position, spider 612 applies a force 648 to junctions E and F. Spider force 648 has a horizontal component that is away from the center of the speaker, as well as a downward vertical component. The resiliency of surround 614 also creates a force 642 that has outward and downward components that are applied to junctions A and D.

These forces create bending moments at junctions points A-F in the opposite direction to those in FIG. 50A: counter-clockwise at A, B and E, and clockwise at C, D and F. The reversal of bending moments results in the reversal of the compression and tension forces between the junction points: here tension between junction points: A-B, B-C and C-D; and compression between junction points A-E, B-E, C-F and D-F. All forces here are also balanced right to left as in FIG. 50A. Given that the construction and shapes of the components of the sub-zero speaker does not change as bobbin 602 is driven outward from that when the speaker is at rest and when bobbin 602 is drawn inward, all of the angles at the six junctions points also remain the same at each position of an outward stroke that results in bobbin 602 remaining in the same alignment as in the at rest position and when drawn inward.

Thus the construction of the sub-zero speaker of the present invention provides balance between the horizontal forces on opposite sides of the top edge of bobbin 602 cancelling the forces that in the prior art speaker of FIG. 47 tend to compress the top of bobbin 602 on the in-stroke and stretch the top of bobbin 602 on the out stroke, each of which can produce wobble of bobbin 602 during operation of the speaker.

By cancelling the forces on bobbin 602 in the sub-zero speaker of the present invention, the potential for wobble of bobbin 602 during operation of the speaker is virtually eliminated.

Therefore, it can be seen that performance of the sub-zero speaker of the present invention is quite different from that of conventional speakers as has been shown by the comparison of FIGS. 50A and 50B with FIGS. 49A and 49B.

Figure 51:
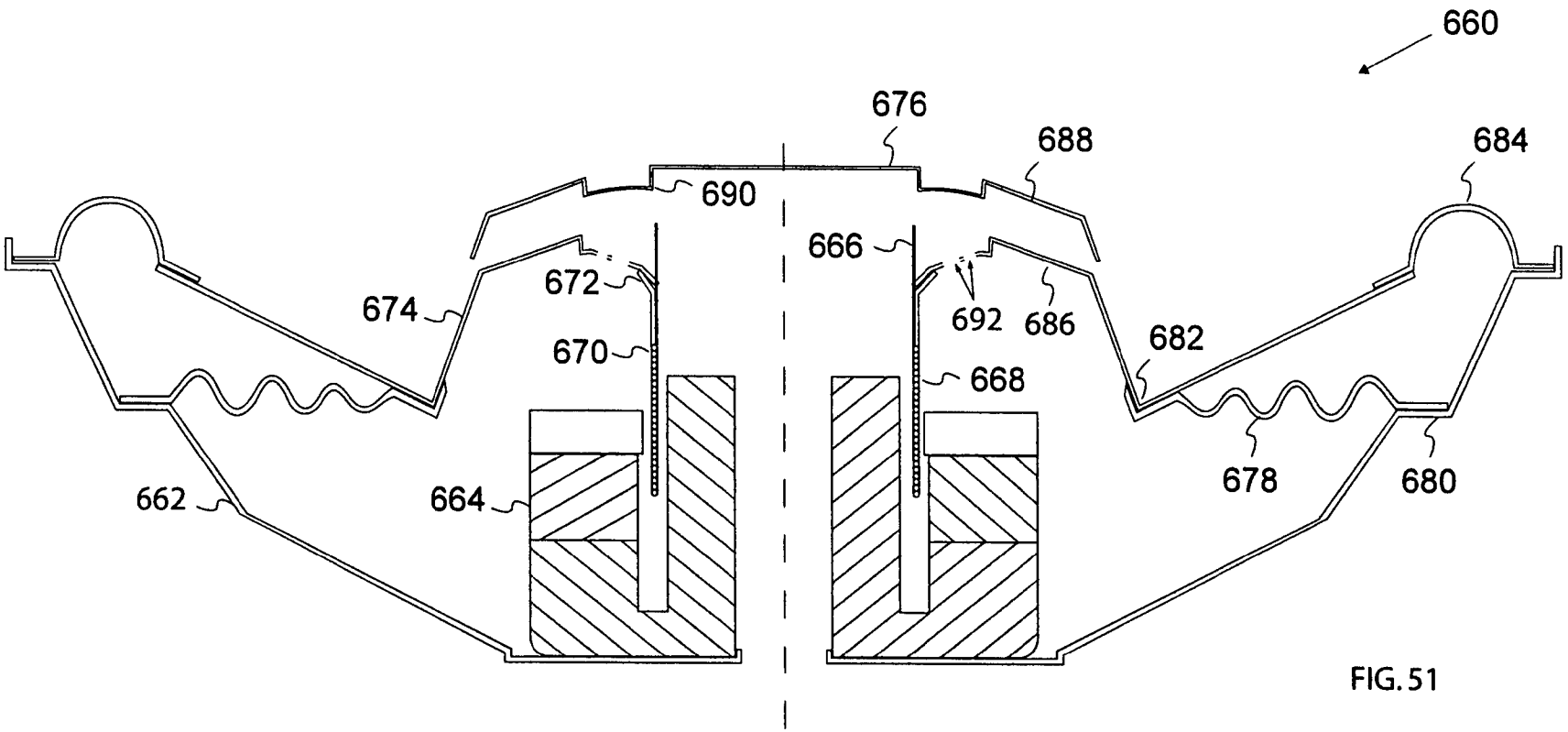
FIG. 51 is low profile version of the speaker of FIG. 48A with the lateral support diaphragm in position just prior to attachment to the top edge of the voice coil bobbin and the cone.

FIG. 51 is low profile version of the anti-wobble speaker of FIG. 48A. Speaker 660 of FIG. 51 includes basket 662 with magnet assembly 664 mounted centrally in the bottom of the basket with the lateral support diaphragm in position just prior to attachment to the top edge of the voice coil bobbin and the cone. In place in magnet assembly 664 is voice coil bobbin 666 and voice coil 668 in the at-rest position when no signal is being applied to the voice coil. Surrounding the bobbin directly above, and preferably in contact with the top winding of, the voice coil is non-electrically and non-magnetically conductive sleeve 670. The inner diameter of sleeve 670 is substantially the same as the outer diameter of bobbin 666 with sleeve 670 glued in place. The top edge of sleeve 670 is flared outward to form a connection lip 672 that surrounds bobbin 666 with a substantial portion of bobbin 666 extending upward beyond connection lip 672. In the view of FIG. 51, voice coil 668 is wound on the lowest ⅜ of the height of voice coil bobbin 666, sleeve 670 about an other ⅜ of the height of the bobbin and the upper portion of the bobbin is about ¼ the height of the bobbin. These dimensions are merely an example of the portions of the different sections of the bobbin and the present invention is not limited to those proportions. The actual proportions will be determined by the overall all design of a low-profile speaker version of the anti-wobble speaker of the present invention, as will the shape and sizes of the other components of such a speaker.

Cone 674 in this embodiment is shown having a circular center hole with the inner edge glued to connection lip 672 entirely around sleeve 670. Cone 674, radiating outward from the inner edge, rises at about 30° as shown here (not critical to the present invention) to a plateau 686 (cone connection plateau) that is flat and sloping downward at a slight angle as cone 674 radiates further from the center. The outer most portion of cone 674 is formed with a deep, downward "V" groove with the outer leg of the "V" extending outward and upward to a point that is approximately half the drop of the inner side of the "V". It can be seen that the point at which the "V" groove begins, measuring from the center of the speaker, has a diameter that is greater than the diameter of magnet assembly 664. That being the case, when voice coil 668 is energized and is drawn inward to the maximum extent, the entire "V" groove portion of cone 674 clears magnet assembly 664 with the bottom point 682 of the "V" extending toward the bottom of basket 662 spaced apart from the outer side of magnet assembly 664.

There are two other elements, in addition to connection lip 672 that supports cone 674 and bobbin 666. One is surround 684 that has an inner edge glued to the outer most edge of cone 674 on the end of the outer leg of the "V" groove with the outer edge of surround 684 mounted on upper edge of basket 662. The other is spider 678 that has the inner edge glued to the underside of bottom point 682 of the "V" groove of cone 674 with the outer edge of spider 678 attached to basket ledge 680 inside basket 662. Basket ledge 680 is located within basket 662 at a point so that when spider 678 is in place and the speaker at rest, spider 678 is substantially level with the bottom of basket 662.

The final component of the speaker of FIG. 51 is rigid lateral support diaphragm 676 shown here just prior to attachment to cone 674 and bobbin 666. Formed in the bottom of lateral support diaphragm 676 is a connection shoulder 690 that has an inner diameter that is substantially the same as the outer diameter of bobbin 666. Around the underside of the outer edge of lateral support diaphragm 676 is a diaphragm connection flat 688 that is sized and shaped to complement the size and shape of cone connection plateau 686. To complete the assembly of the speaker illustrated in FIG. 51, lateral support diaphragm 676 is lowered on to the top edge of bobbin 666 that is glued within connection shoulder 690, and the under side of diaphragm connection flat 688 is glued to the top side of cone connection plateau 686.

Additionally, to provide free flow of air through the anti-wobble triangular region created by the upper portion of bobbin 666, the portion of diaphragm 676 between connection ring 690 and connection flat 688, and the portion of cone 674 between plateau 686 and connection lip 672, air holes can be provided below the top edge of bobbin 666 (typically done for cooling) and air holes 692 through the portion of cone 674 that provides one leg of the anti-wobble triangle. The key here to the present invention, as it is with the speaker of FIG. 48A, is the anti-wobble triangle formed around the upper edge of bobbin 666. It should also be noted that the materials of the various components are those that are typically used. For greater cooling the voice coil bobbin and the diaphragm can be made of a heat conductive material (e.g., aluminum).

Figure 52:
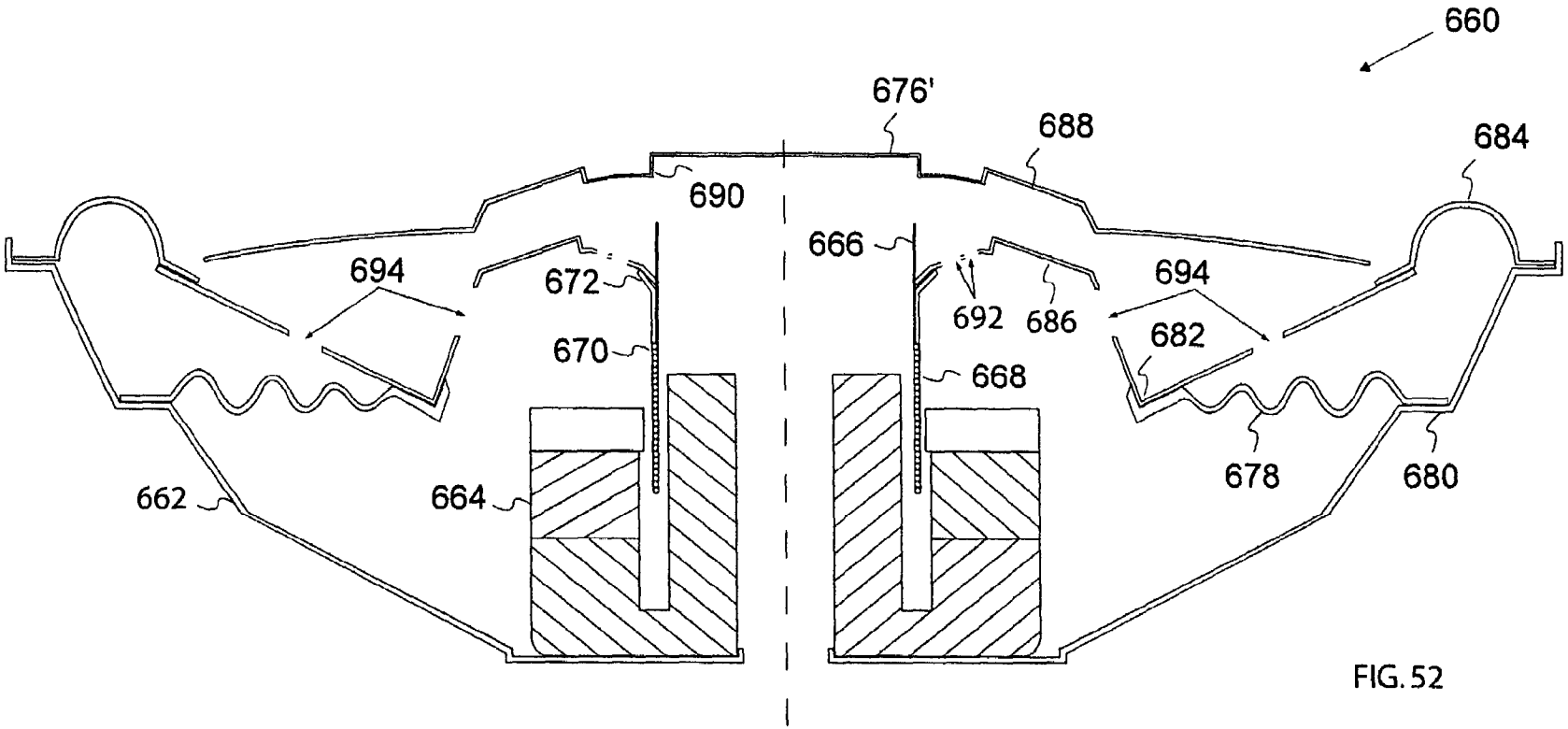
FIG. 52 is the low profile speaker of FIG. 51 with the lateral support diaphragm extending to the inner edge of the surround.

In the speaker of FIG. 51 the "V" groove in cone 674, in addition to lateral support diaphragm 676, radiates sound from this speaker. The low profile speaker of FIG. 52 is the same as that shown in FIG. 51 with one modification. In FIG. 52, lateral support diaphragm 676' is shown extending outward and downward with the outer edge of diaphragm 676' positioned to be glued to the point of connection of cone 674 and the inner edge of surround 684. By doing so, in the speaker of FIG. 52, all of the sound is radiated from diaphragm 676'. With this larger diameter diaphragm 676', air holes 694 are desirable through at least one leg of the "V" in cone 674. For additional cooling, diaphragm 676' can be made of a heat conductive material (e.g., aluminum) to conduct heat from voice coil bobbin 702 and to radiate that heat away from the speaker.

Figure 53B:
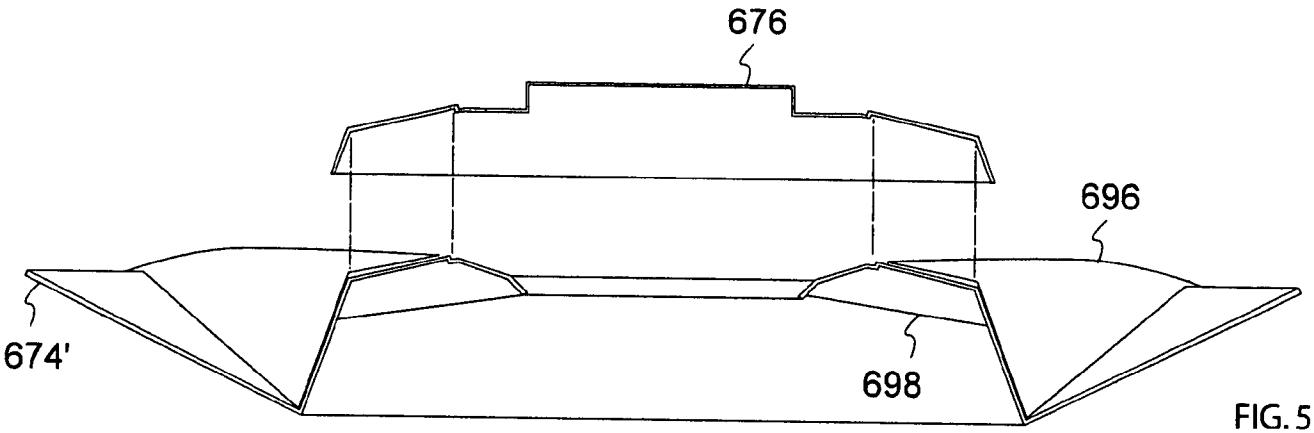
FIG. 53*b* is an exploded view of the cone and dust cap of the low profile speaker of FIG. 53*a* showing their individual shapes and orientation one with the other.
Figure 53A:
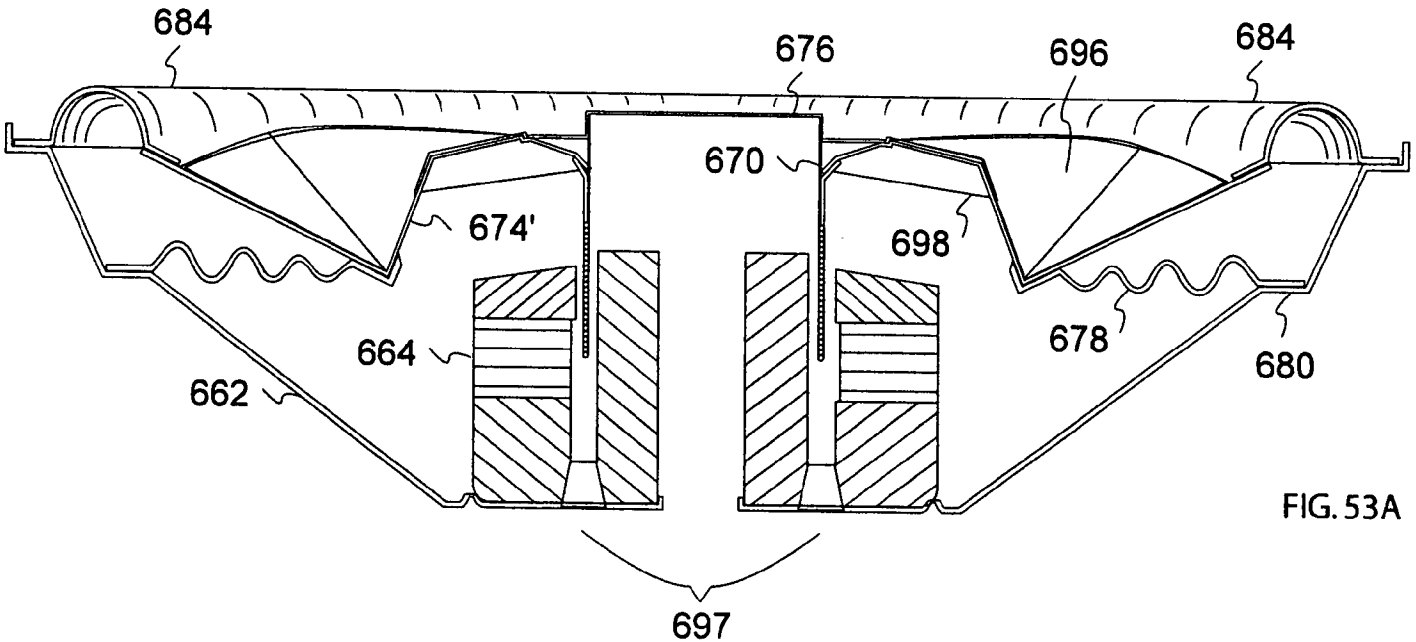
FIG. 53*a* is the low profile speaker of FIG. 51 with the cone having radially positioned ribs on the top and bottom sides thereof.

The low profile speaker of FIG. 53*a* is the same as that shown in FIG. 51 with one modification. In FIG. 53*a*, cone 674' includes radially positioned topside ribs 696 and radially positioned bottom side ribs 698 which have been included to give cone 674' more resistance to flexing than cone 674 of FIG. 51. By reducing the flexibility of the cone and the use of lateral support diaphragm 676, the wobble of voice coil bobbin 670 is further reduced. Also shown in FIG. 53*a*, are cooling holes 697 through the bottom plate of magnet assembly 664.

Figure 53C:
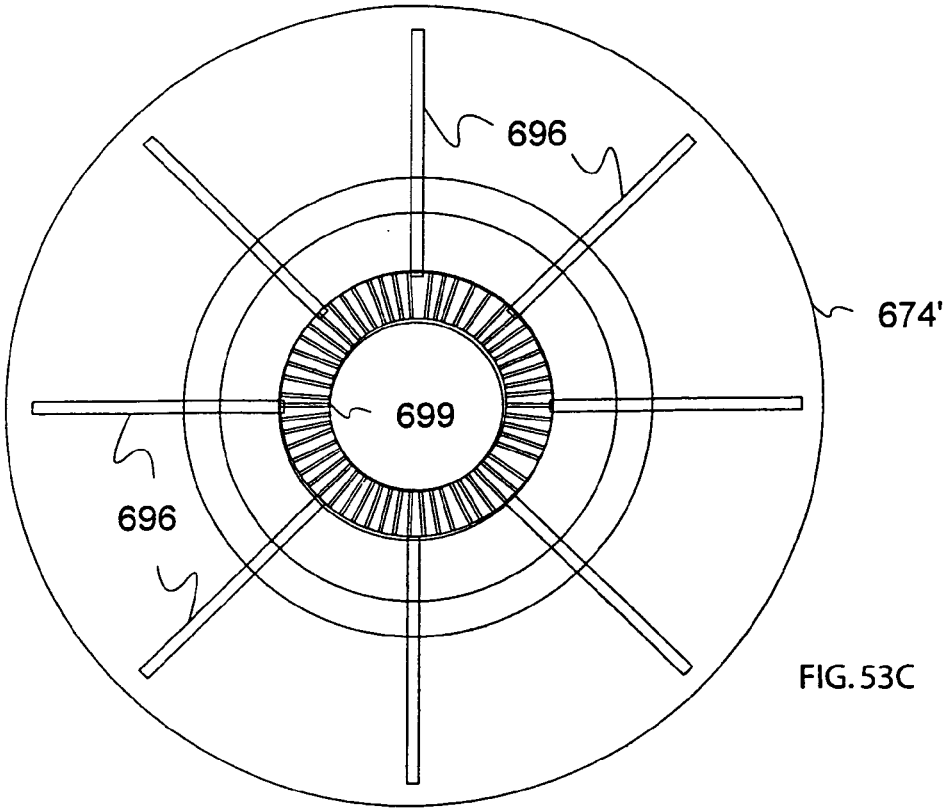
FIGS. 53*c–d* are top and bottom views, respectively, of the cone of the low profile speaker of FIG. 53*a;*
Figure 53D:
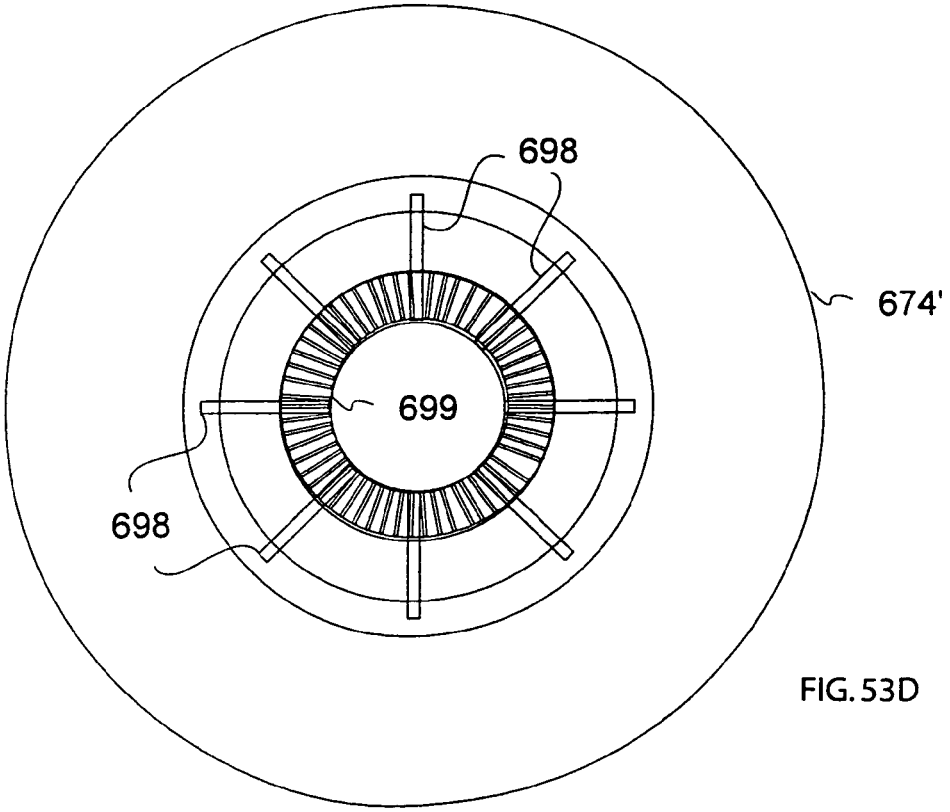

FIG. 53*b* includes a cross-sectional, exploded view of cone 674' and lateral support diaphragm 676 aligned with respect to each other as in the complete assembly of FIG. 53*a*. With FIG. 53*b* above FIG. 53*a* the placement of cone 674' relative to surround 684 and lateral support diaphragm 676 over the central portion of cone 674' and voice coil bobbin 670 can be seen. In the low profile speaker of FIG. 53*a*, lateral support diaphragm 676 attaches to cone 674' and voice coil bobbin 670 as described for the low profile speaker of FIG. 51. To better visualize the construction of cone 674', FIGS. 53*c* and 53*d* show top and bottom views thereof, respectively. In FIG. 53*c* eight topside ribs 696 are shown, and in FIG. 53*d* eight bottom side ribs 698 are shown. While eight top and bottom side ribs are shown in these two views, the number of ribs to include is a matter of design choice with a greater number of ribs being more desirable the larger the dimensions of the cone. Additionally, in FIGS. 53*c* and 53*d*, surrounding the center hole of cone 674' radiating outward from the edge that attaches to voice coil bobbin 670, on both the top and bottom sides of cone 674', are smaller, closely spaced ribs 699 that minimize the flexing of the portion of cone 674' where it attaches to voice coil bobbin 670. The inclusion and number of ribs 699, and whether they are included on both sides, or either side, of cone 674' is also a matter of design choice.

Figure 54:
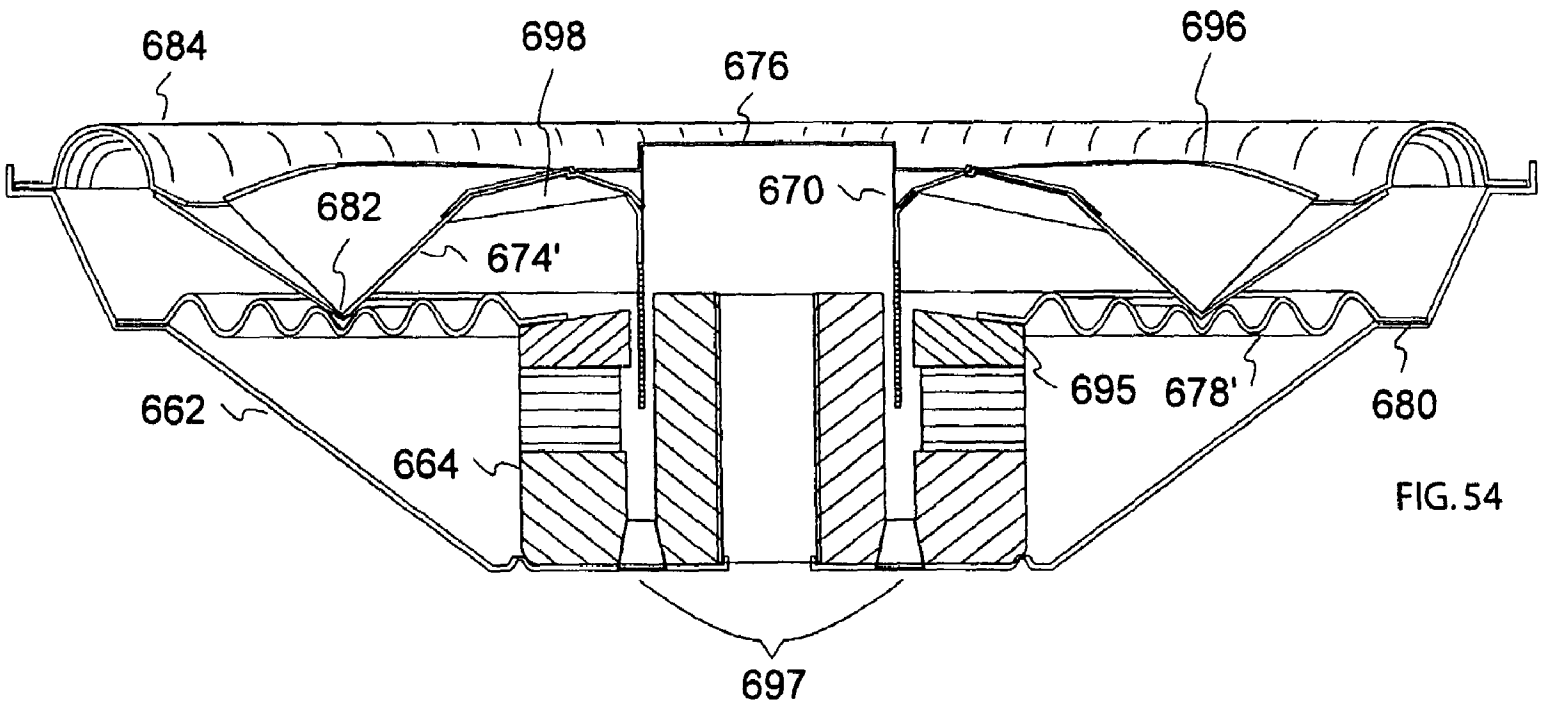
FIG. 54 is the low profile speaker of FIG. 53*a* with the spider extending between the frame and the voice coil bobbin.

The low profile speaker of FIG. 54 is the same as that shown in FIG. 53*a* with one modification. In FIG. 54, spider 678' extends from basket edge 680 to the top of top plate 695 with the point of cone "V" 682 attached centrally to spider 678', whereas in FIG. 53*a* spider 678 extends only between basket edge 680 and the point of cone "V" 682. Spider 678' of the low profile speaker of FIG. 54 provides added anti-wobble stability to the voice coil bobbin 670 as the bobbin travels into and out of magnet assembly 664.

Figure 55A:
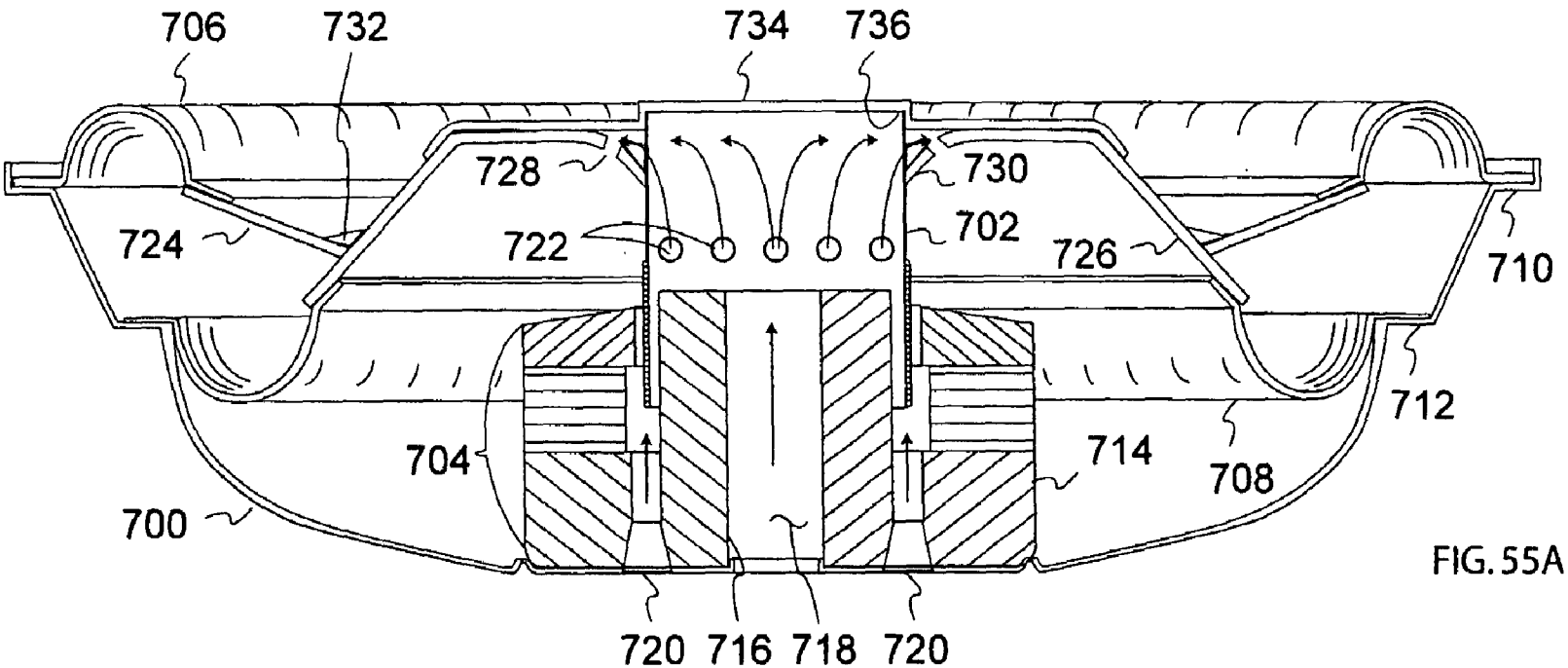
FIG. 55*a* is cross-sectional view of another low profile shallow speaker of the present invention.

FIG. 55*a* is a cross-section of a dual cone, low profile speaker design. This speaker includes a low height basket 700 defining a top rim 710 and an interior ledge 712, both of which encircle the basket and are parallel to each other. Additionally, there is a magnet assembly 704 centrally located in the bottom of the basket. A voice coil bobbin 702, the end on which the voice coil is wound extends into magnet assembly 704 surrounding the center extension 716 of bottom pole piece 714.

An inner cone 726 has a substantially "pie pan" shape with a outwardly flaring side forming an outer edge and a flat bottom through which is formed a central circular opening with the edge around the central opening (e.g., the inner edge) curved slightly inward. Inner cone 726 is mounted face down with the mouth or largest diameter outer edge extending downward into basket 700. The inner edge of inner cone 726 has a diameter that is substantially the same as the outer diameter of bobbin 702 and fitted around bobbin 702. When in place the inner edge of inner cone 726 is below the top edge of bobbin 702 forming a small circular glue well 730 around and in contact with bobbin 702 to hold glue for adhering the inner edge of inner cone 726 to bobbin 702 below the top edge of bobbin 702. When in place, the plane of the flat bottom edge of inner cone 726 is substantially parallel to, and below the top edge of bobbin 702. The outer edge of inner cone 726 forms an opening that is larger than the outer dimensions of magnet assembly 704 so the outer edge of cone 726 does not come into contact with magnet assembly 704 on the in-stroke of the speaker when in operation, and smaller than the inner dimensions of basket 700 for the same reason. Additionally, the outer edge of inner cone 726 is attached to the inner edge of inner surround 708. The outer edge of inner surround 708 is attached to basket inner edge 712 with the shaped portion (shown here as a ½ circle) of inner surround 708 extending toward the bottom of basket 700 below basket inner edge 712 and the outer edge of inner cone 726.

Outer cone 724 has a typical cone shape that extends downward into basket 700. Outer cone 724, unlike typical cones, has a large center hole formed by the inner edge. The dimensions of the outer edge of outer cone 724 are smaller than the dimensions of top rim 710 of the mouth of basket 700 and larger than the outer dimensions of the outer edge of inner cone 726 while the dimensions of the inner edge of outer cone 724 is smaller than the outer dimensions of the outer edge of inner cone 726. When in place, the outer edge of outer cone 724 is attached to the inner edge of outer surround 706 with the outer edge of outer surround 706 attached to top rim 710 of the basket with the shaped portion (shown here as a ½ circle) of outer surround 706 extending outward from the mouth basket 700 between top rim 710 and the outer edge of outer cone 724. The inner edge of outer cone 724 has the same shape as the side of inner cone 726 and contacts the side of inner cone 726 near the outer edge of inner cone 726 at contact point 732. Contact point 732, given the shapes of the two cones, has a "V" shape into which glue is added to attach the two cones, one to the other, at that point.

The final element of the assembly of the shallow speaker of FIG. 55*a* is lateral support diaphragm 734 that has a shape similar to lateral support diaphragm 676 of FIG. 51. Lateral support diaphragm 734 is glued to the top edge of bobbin 702 and the upward facing flat "bottom" portion of inner cone 726, similarly to the assembly of the speaker of FIG. 51.

Also shown in FIG. 55*a* is the air cooling path through the speaker as illustrated with arrows. Air is shown entering the bottom of basket 700 through air vents 720 in bottom pole piece 714 and center air passage 718 through bottom pole piece extension 716. Air through center air passage 718 extends upward into the center of bobbin 702, while air entering air vents 720 can take two different paths: one into the center of bobbin 702 between bobbin 702 and the outside of bottom pole piece extension 716; or, two into the bottom of basket 700 between the outside of bobbin 702 and the upper plate of magnet assembly 704. Since lateral support diaphragm 734 is a solid piece air holes 722 have been provided in the side of bobbin 702 below well 730 so air can pass into the space between the bottom of lateral support diaphragm 734 and inner cone 726 and then through air passage holes 728 in inner cone 726 into the bottom of basket 700. Basket 700 has vent holes (not shown to minimize confusion when viewing FIG. 55*a*) therethrough to permit the air to mix with air outside the basket and to return to the cooling path illustrated. The cooling path illustrated here is that when the voice coil bobbin 702 is on the out-stroke and is just the reverse on the in-stroke.

To maximize cooling, voice coil bobbin 702 and lateral support diaphragm 734 can each be made of a non-magnetic conductive, heat conductive material (e.g. aluminum) so that lateral support diaphragm conducts some of the heat away from bobbin 702 and in turn radiates that heat outward from the mouth of the speaker.

The materials used to make the various components of the speaker are a matter of design choice and can be those typically used. Given the more complex construction of the present invention, the two cones could be made of a lighter weight foam or composite core material.

Figure 55B:
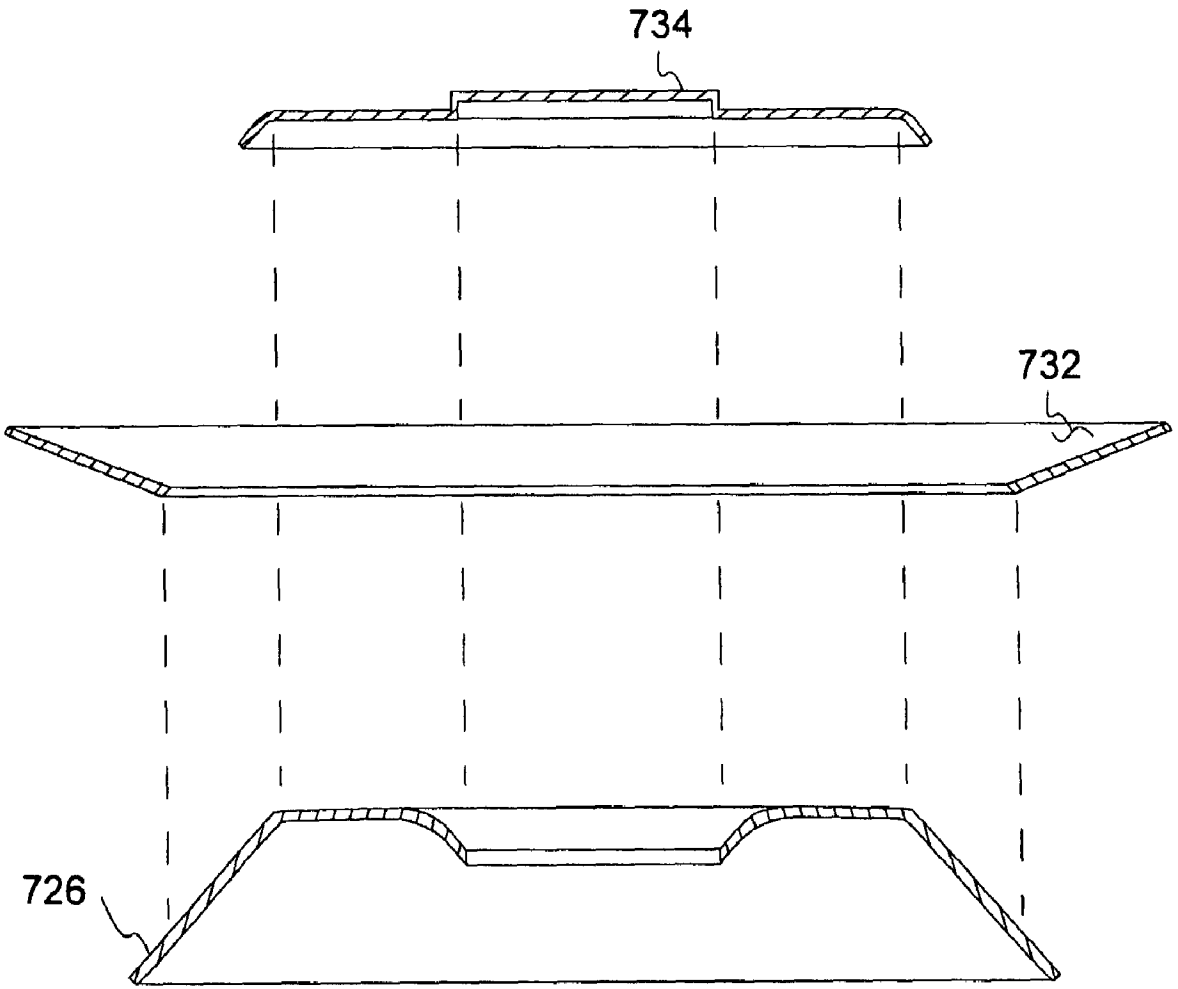
FIG. 55*b* is an exploded view of the inner and outer cones and dust cap of the low profile speaker of FIG. 55*a* showing their individual shapes and orientation one with the other.

FIG. 55*b* includes a cross-sectional, exploded view of the two cones and lateral support diaphragm aligned with respect to each other as in the complete assembly of FIG. 55*a*.

Figure 56A:
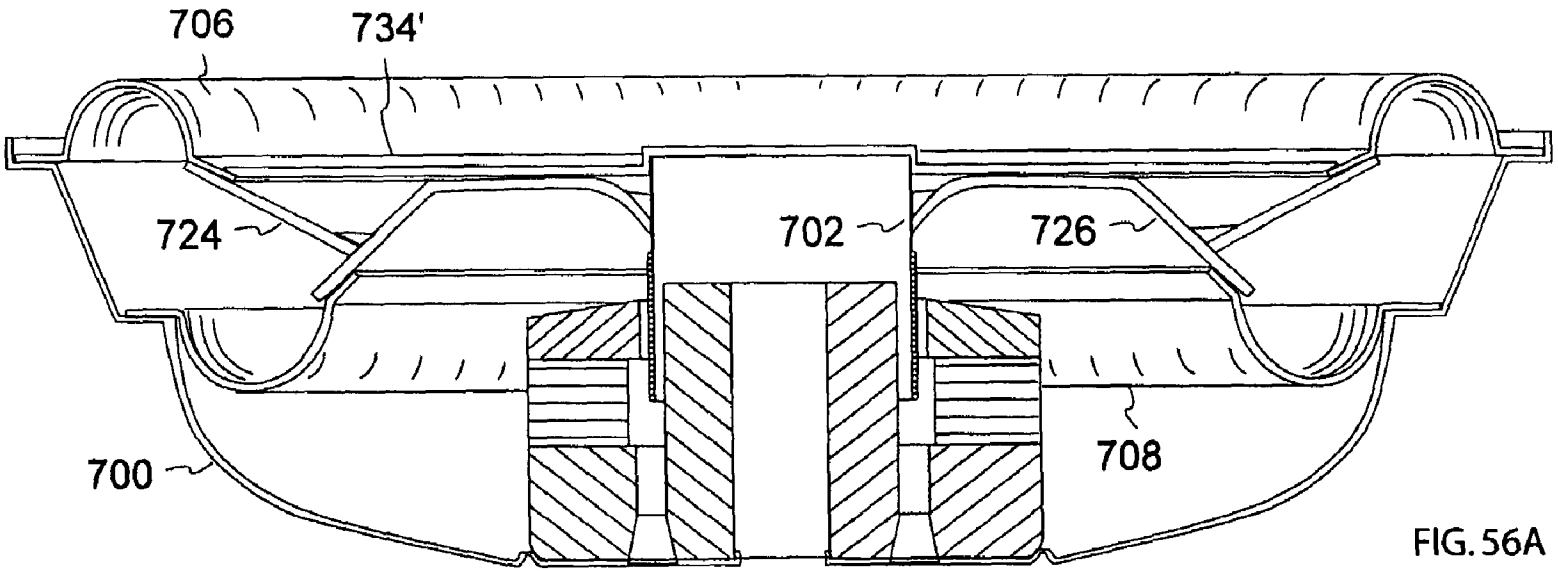
FIG. 56*a* is the low profile speaker of FIG. 55*a* with the dust cover extending completely across the two cones.

The low profile speaker of FIG. 56*a* is the same as that shown in FIG. 55*a* with one modification. In FIG. 56*a*, lateral support diaphragm 734' extends completely across the mouth of the basket to the inner edge of outer surround 706 all around as opposed to only extending across a portion of inner cone 726 as in FIG. 55*a*. With this larger lateral support diaphragm 734', there is added radiant cooling and less potential wobble due to the stiffening of the overall cone and diaphragm construction.

Figure 56B:
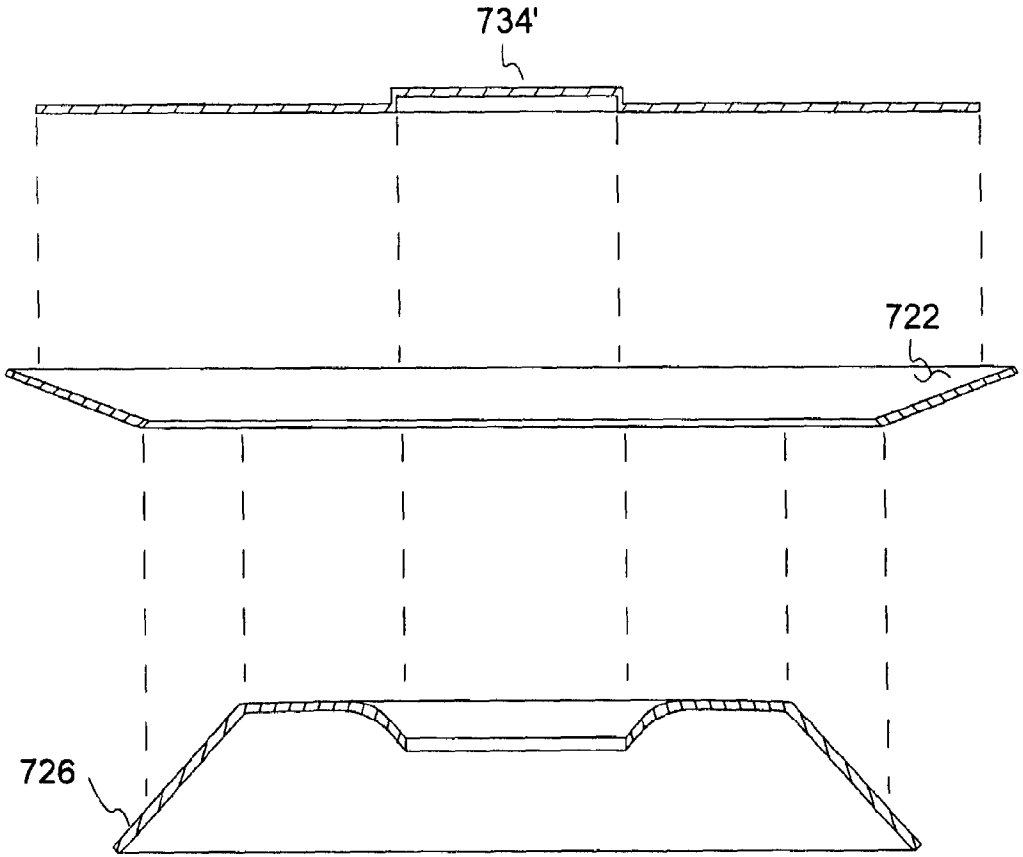
FIG. 56*b* is an exploded view of the two cones and dust cap of the low profile speaker of FIG. 56*a* showing their individual shapes and orientation one with the other.

FIG. 56*b* includes a cross-sectional, exploded view of the two cones and lateral support diaphragm aligned with respect to each other as in the complete assembly of FIG. 56*a*.

Figure 57B:
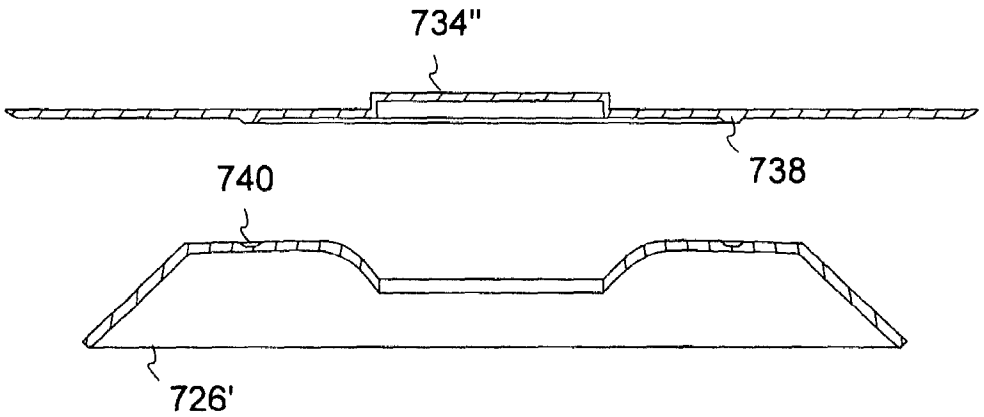
FIG. 57*b* is an exploded view of the inner cone and dust cap of the low profile speaker of FIG. 57*a* showing the interaction of the ring and grove and orientation one with the other.
Figure 57A:
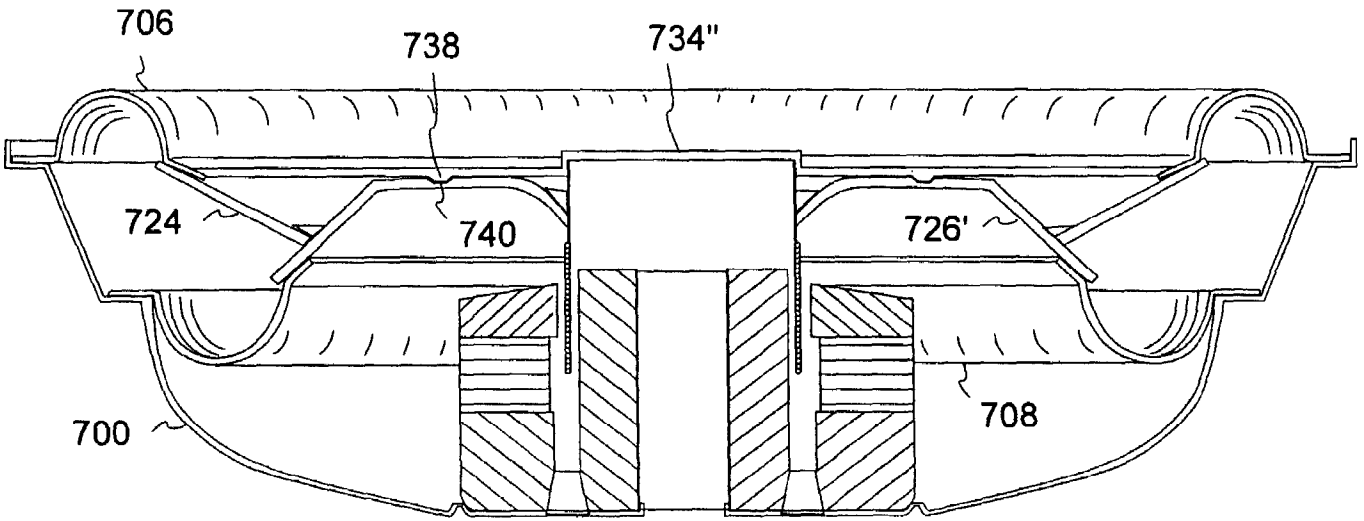
FIG. 57*a* is the low profile speaker of FIG. 56*a* with the dust cover with an alignment ring on the under side and a mating groove formed in the upward facing "bottom" of the inner cone.

The low profile speaker of FIG. 57*a* is the same as that shown in FIG. 56*a* with two modifications. In FIG. 57*a*, the bottom side of lateral support diaphragm 734" includes a outward extending alignment ring 738 having a selected cross-section (shown here as semi-circular, however it could be "V" shaped, square, or any other desired shape). Additionally, inner cone 726' includes alignment ring shaped groove 740 formed in the upward facing side of the "bottom" of inner cone 726' with groove 740 being positioned, sized and shaped to receive alignment ring 738 of the lateral support diaphragm 734". The use of ring 738 and groove 740, the final positioning of lateral support diaphragm 734" is more positively assured and provides an added measure of stiffness to the assembly of cones 724 and 726', and diaphragm 734".

FIG. 57*b* includes a cross-sectional, exploded view of inner cone 726' and lateral support diaphragm 734" aligned with respect to each other as in the complete assembly of FIG. 57*a* to illustrate the placement and interaction of alignment ring 738 with groove 740.

Figure 58A:
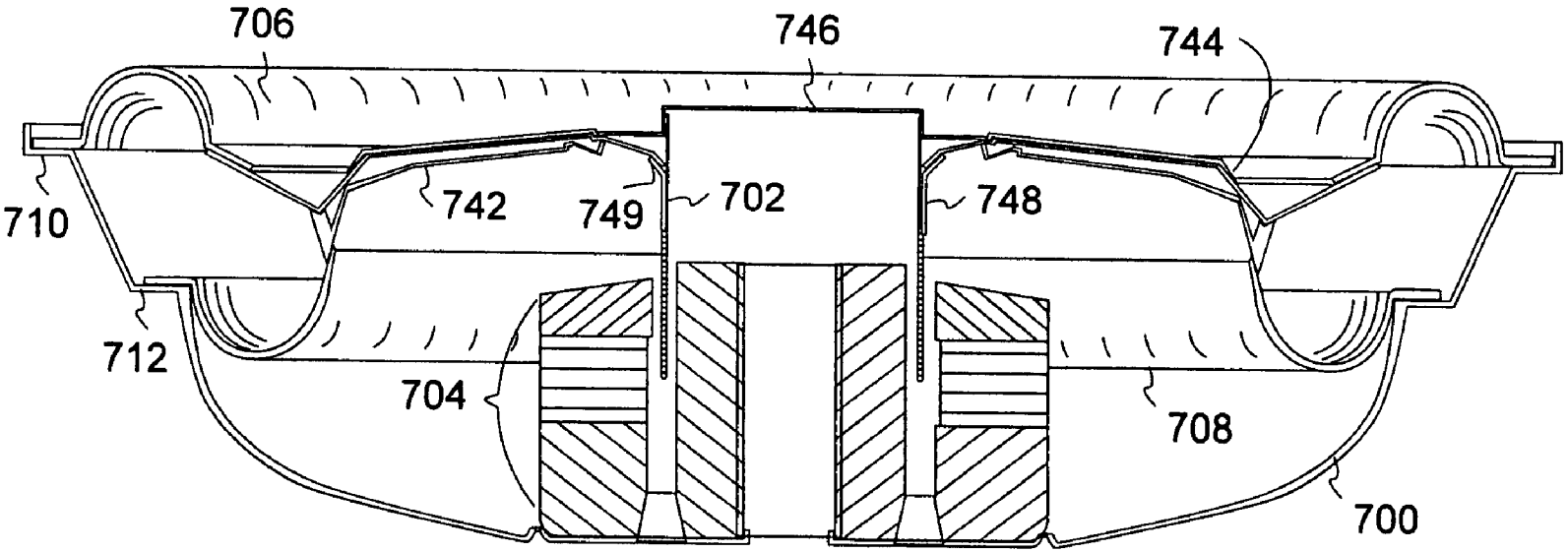
FIG. 58*a* is cross-sectional view of another low profile shallow speaker of the present invention.

FIG. 58*a* is a cross-sectional view of another low profile, shallow speaker of the present invention. Several of the components of this speaker are common to previously discussed low profile speakers of the present invention and oriented here as in those speakers, namely basket 700, voice coil bobbin 702, magnet assembly 704, outer surround 706, and inner surround 708. The outer edge of outer surround 706 is attached to top rim 710 of basket 700, and the outer edge of inner surround 708 is attached to inner edge 712 of basket 700. Additionally there is a sleeve 748 firmly attached around voice coil bobbin 702 above the voice coil with the top edge of sleeve 748 formed in an outward flaring lip 749 that is below the top edge of bobbin 702 that extends a measurable distance above lip 749. This embodiment also includes an inner cone 742, an outer cone 744 and lateral support diaphragm 746.

When assembled, the inner edge of inner surround 708 is attached to the under side of the outer edge of inner cone 742, and the inner edge of outer surround 706 is attached to the top side of the outer edge of outer cone 744. At each of the points of contact between inner and outer cones 742 and 744, the two cones are glued together with each of the small "V" shaped areas in inner cone 742 designed to be wells for glue. Additionally lip 749 of sleeve 748 forms a glue well around bobbin 702 with the inner edge of outer cone 744 glued into that well. The last piece of the assembly is lateral support diaphragm 746 having a center cap like formation that fits around, and is glued to, the top edge of bobbin 702. Additionally, the long straight portions of diaphragm 746 that extend outward from the "cap" are the same length as opposing straight portions of outer cone 744 with those straight portions of the outer cone and diaphragm glued one to the other. When fully assembled, inner and outer cones form several sealed internal spaces that, together with the various bends of the cones adding rigidity to the cone assembly with the diaphragm adding to that rigidity. The rigidity minimizes flexing of the cones while also minimizing wobble of the voice coil bobbin during operation of the speaker.

Here as in other of the speakers of the present invention, the two surrounds are very flexible and typically made of a formed foam material, the two cones are each more rigid than the surrounds and glued together more rigid still with each cone typically made of heavy paper, a composite or a honeycomb structure. The specific material that is used is a matter of design choice. To increase cooling of the voice coil beyond that provided by the typical air flow through the bobbin and magnet assembly 704, bobbin 702 and lateral support diaphragm 746 can be made of a non-magnetic, heat conductive material (e.g., aluminum) so the diaphragm can draw heat from the bobbin by conduction and radiate that heat from the outer surface of the diaphragm outward from the speaker.

Figure 58B:
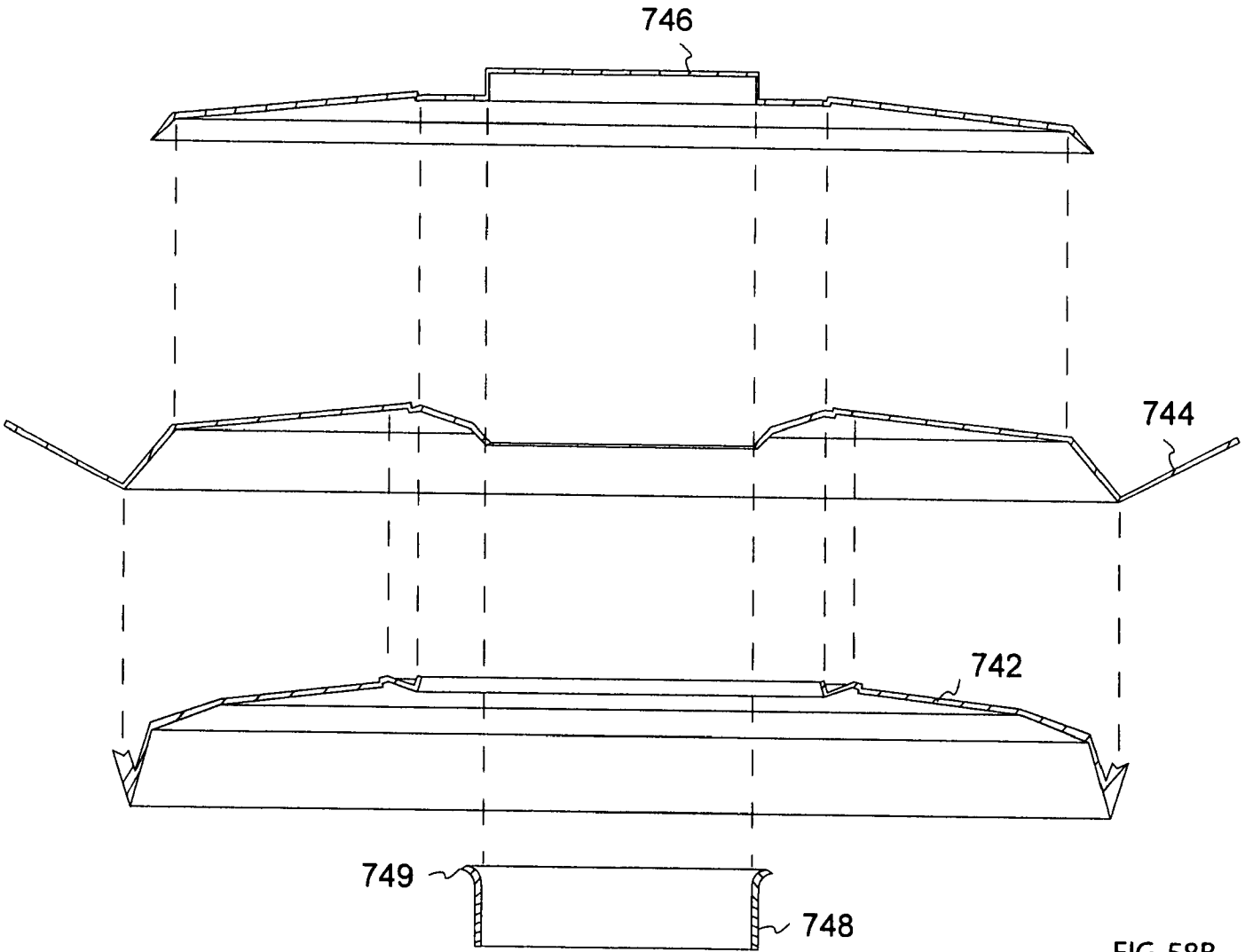
FIG. 58*b* is an exploded view of the two cones, dust cap voice coil bobbin top sleeve of the low profile speaker of FIG. 58*a* showing their orientation one with the other.
Figure 58C:
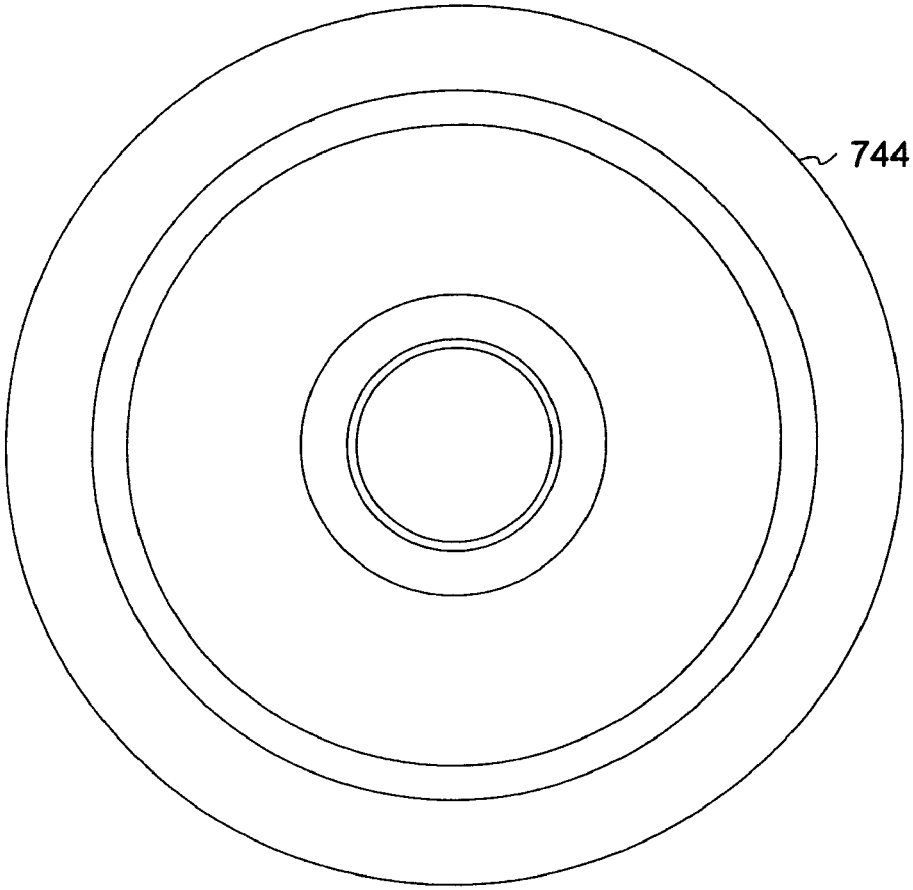
FIG. 58*c* is a top view of the outer cone of the speaker of FIG. 58*a;*
Figure 58D:
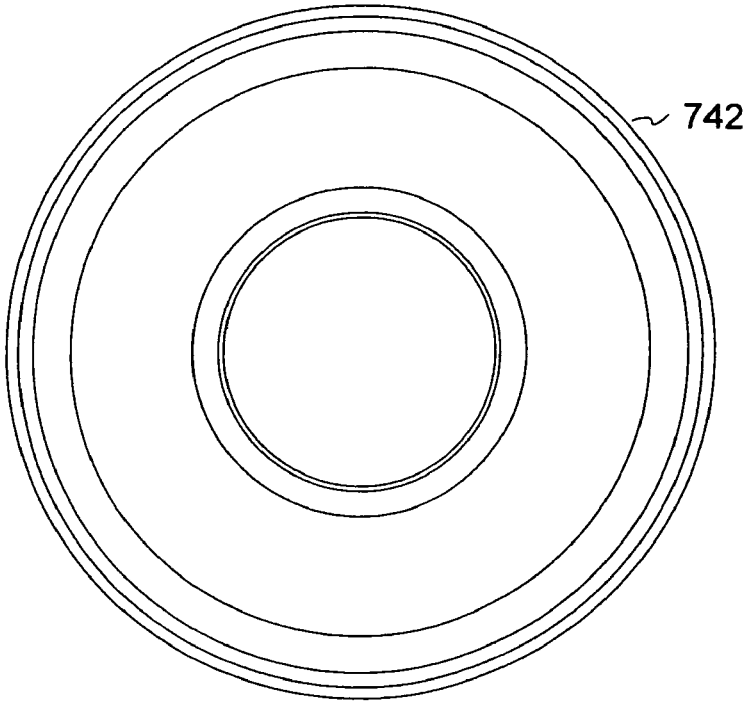
FIG. 58*d* is a top view of the inner cone of the speaker of FIG. 58*a;*

FIG. 58*b* includes a cross-sectional, exploded view of the bobbin sleeve, two cones and lateral support diaphragm aligned with respect to each other as in the complete assembly of FIG. 58*a*. Additionally, FIGS. 58*c* and 58*d* present a top view of outer cone 744 and inner cone 742, respectively.

Figure 59A:
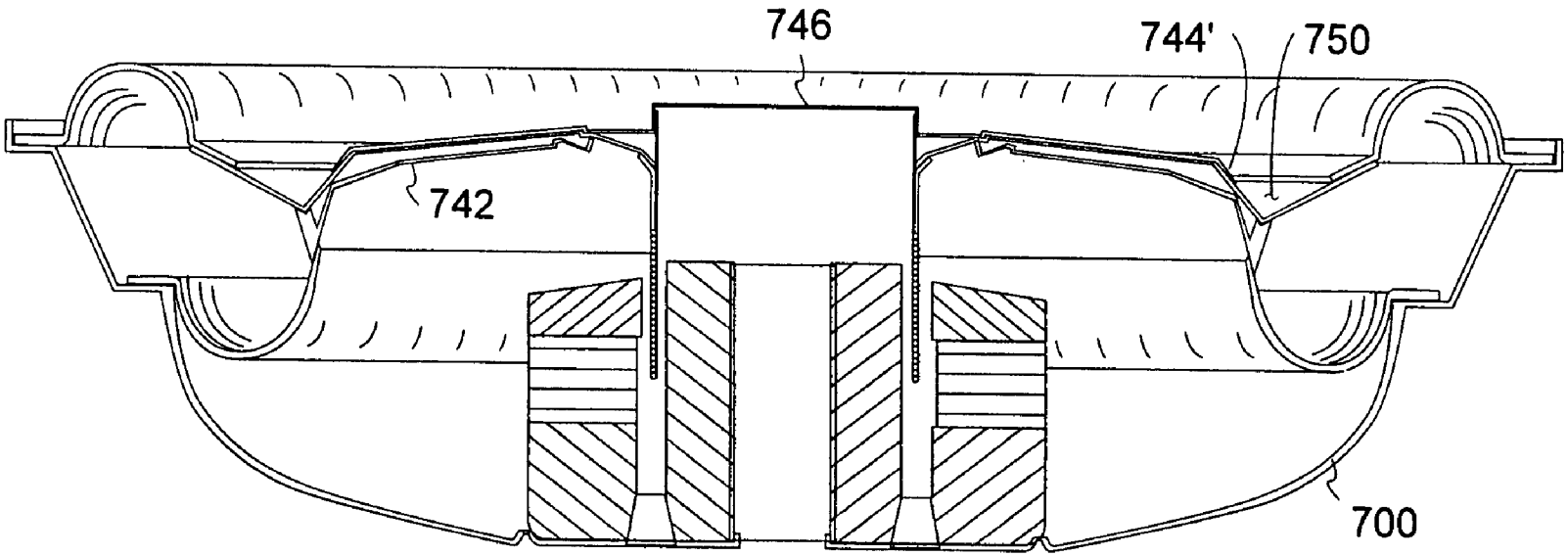
FIG. 59*a* is the low profile speaker of FIG. 58*a* with ribs in the outer cone.
Figure 59B:
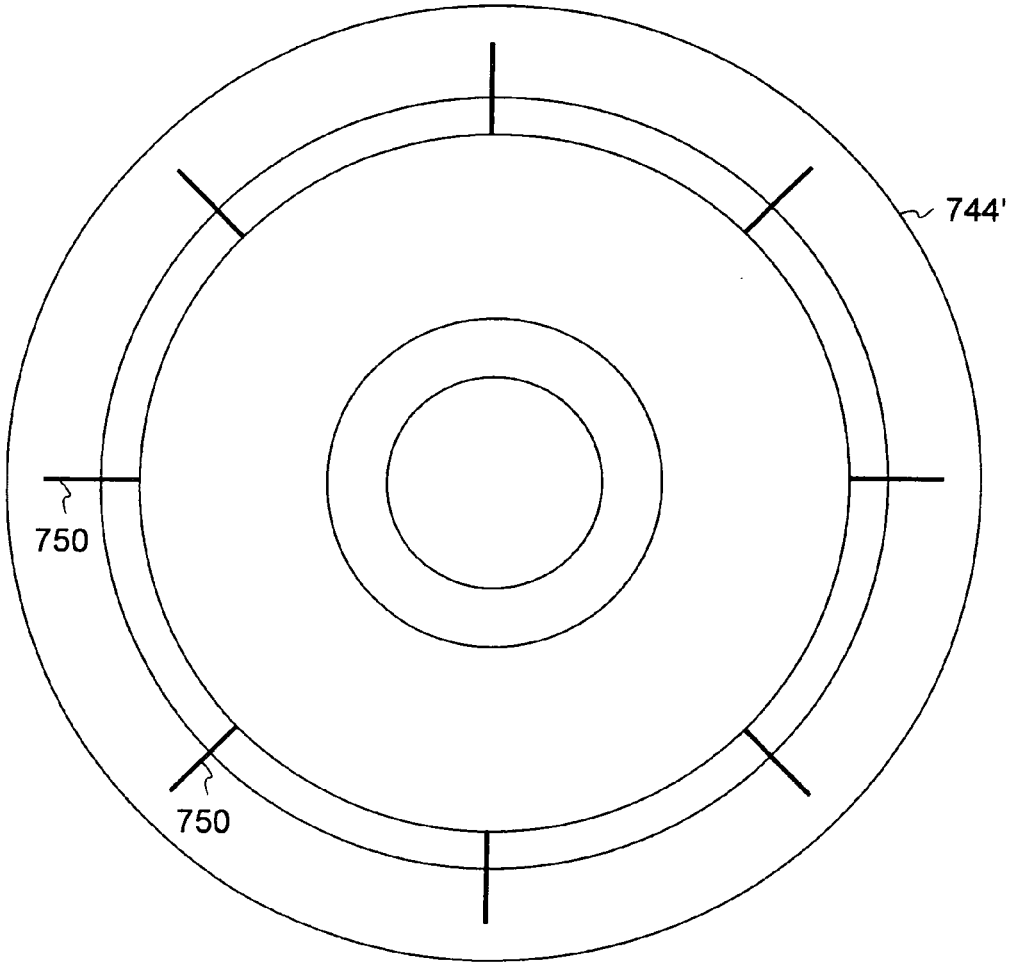
FIG. 59*b* is a top view of the outer cone of the speaker of FIG. 59*a* showing the ribs.

FIG. 59*a* is a cross-sectional view of another low profile speaker that is the same as that of FIG. 58*a* with one modification, ribs 750 have been added to the outer surface of outer cone 744' to add rigidity to the outer edge of cone 744'. FIG. 59*b* is a top view of outer cone 744' to better show the placement of ribs 750. While FIG. 59*b* shows the inclusion of eight ribs 750, the number, shape and size of ribs 750 is a matter of design choice.

Figure 60A:
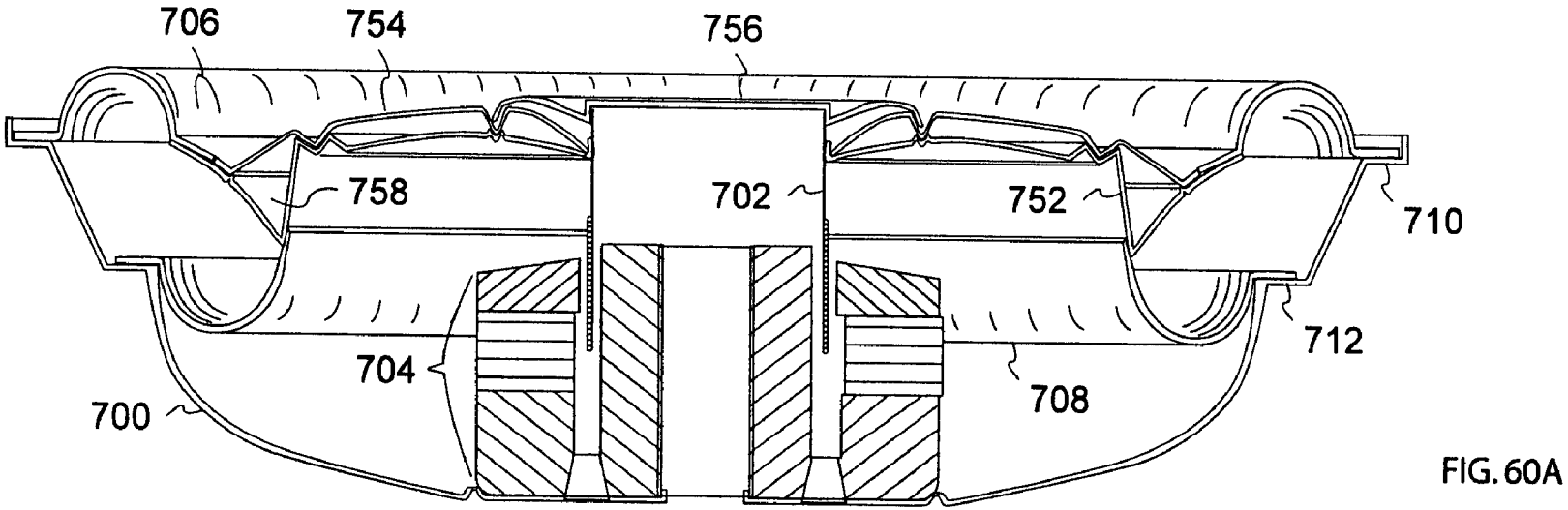
FIG. 60*a* is cross-sectional view of another low profile shallow speaker of the present invention.

FIG. 60*a* is a cross sectional view of another low profile, shallow speaker of the present invention. Several of the components of this speaker are common to previously discussed low profile speakers of the present invention and oriented here as in those speakers, namely basket 700, voice coil bobbin 702, magnet assembly 704, outer surround 706, and inner surround 708. The outer edge of outer surround 706 is attached to top rim 710 of basket 700, and the outer edge of inner surround 708 is attached to inner edge 712 of basket 700. This embodiment also includes a shaped inner cone 752, a shaped outer cone 754 and a shaped lateral support diaphragm 756.

Figure 60C:
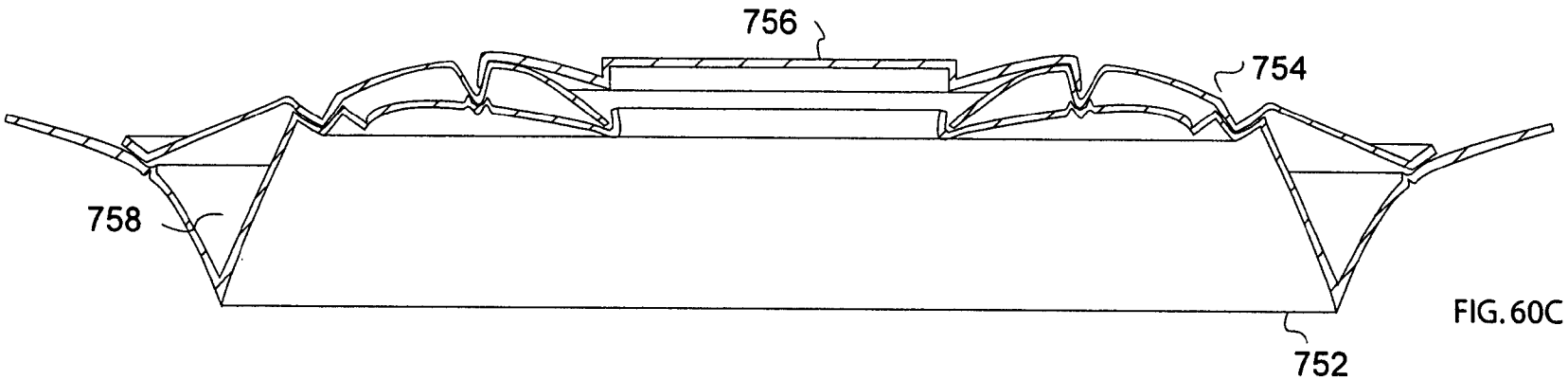
FIG. 60*c* is a cross-section of the assembled two cones and dust cap of the speaker of FIG. 60*a;*
Figure 60B:
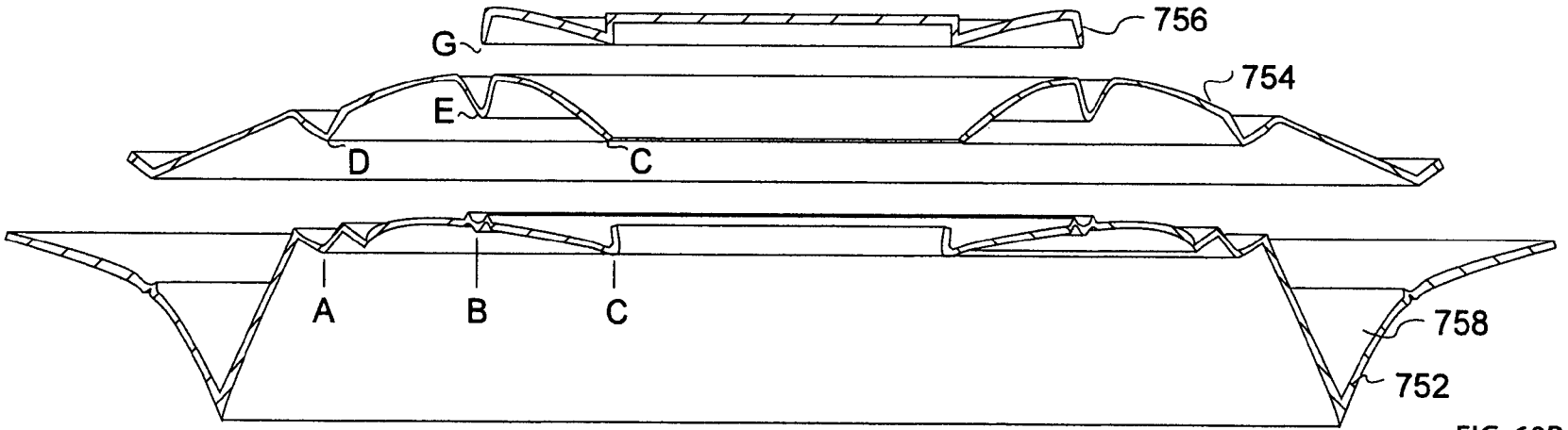
FIG. 60*b* is an exploded view of the two cones and dust cap of the low profile speaker of FIG. 60*a* showing their orientation one with the other.

FIGS. 60*b* and 60*c* are cross-sectional views of the two cones and the diaphragm separated from the complete assemble of FIG. 60*a*. FIG. 60*b* shows the two cones and the diaphragm separated from, and aligned with, each other, while FIG. 60*c* shows the same components assembled one to the other.

Figure 60D:
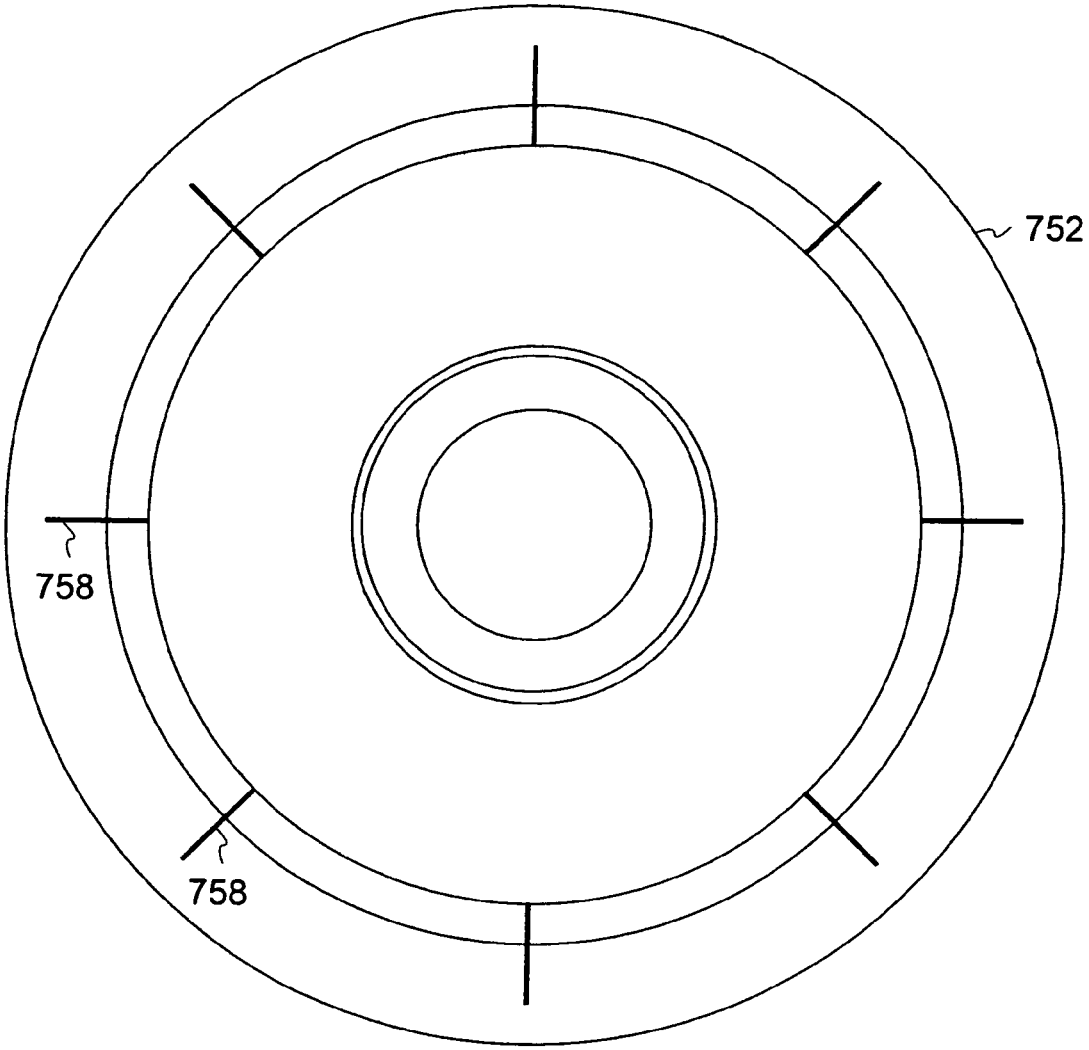
FIG. 60*d* is a top view of the lower cone of the speaker of FIG. 60*a;*

From the various views it can be seen that the inner edge of inner cone 752 is turned upward to form a substantially vertical side wall forming a circular opening that has a diameter that is substantially the same as the outer diameter of bobbin 702. In the assembled position, the circular opening is fit around, and glued to, bobbin 702 at a position similar to the location of lip 749 in FIG. 58*a* below the top edge of bobbin 702. From FIGS. 60*b* and 60*c* it can be seen that inner cone 752 is shaped to include three glue wells in the substantially horizontal portion thereof at points A, B and C, that are disposed to receive points D, E and F of outer cone 754. Outer cone 754 at point E on the top side defines a "V" shaped channel that is disposed to receive the outer edge G of lateral support diaphragm 756. Additionally, inner cone 752 is shown with optional ribs 752 that extend half way up the outer most "V" shaped region. The positioning of optional ribs 758 can be seen more clearly in the top view of inner cone 752 of FIG. 60*d*.

From FIGS. 60*a* and 60*c* it can be seen that when the two cones are glued one to the other three sealed, air filled regions that encircle the center of the speaker are formed that add rigidity to the two cones if not glued together.

Here as in other of the speakers of the present invention, the two surrounds are very flexible and typically made of a formed foam material, the two cones are each more rigid than the surrounds and glued together more rigid still with each cone typically made of heavy paper, a composite or a honeycomb structure. The specific material that is used is a matter of design choice. To increase cooling of the voice coil beyond that provided by the typical air flow through the bobbin and magnet assembly 704, bobbin 702 and lateral support diaphragm 756 can be made of a non-magnetic, heat conductive material (e.g., aluminum) so the diaphragm can draw heat from the bobbin by conduction and radiate that heat from the outer surface of the diaphragm outward from the speaker. This construction with diaphragm 756 attached to the top edge of bobbin 702 and the inner edge of both cones attached to the side of the bobbin below the top edge also provides a construction that minimizes the wobble of bobbin 702 when the speaker is in operation.

Figure 61:
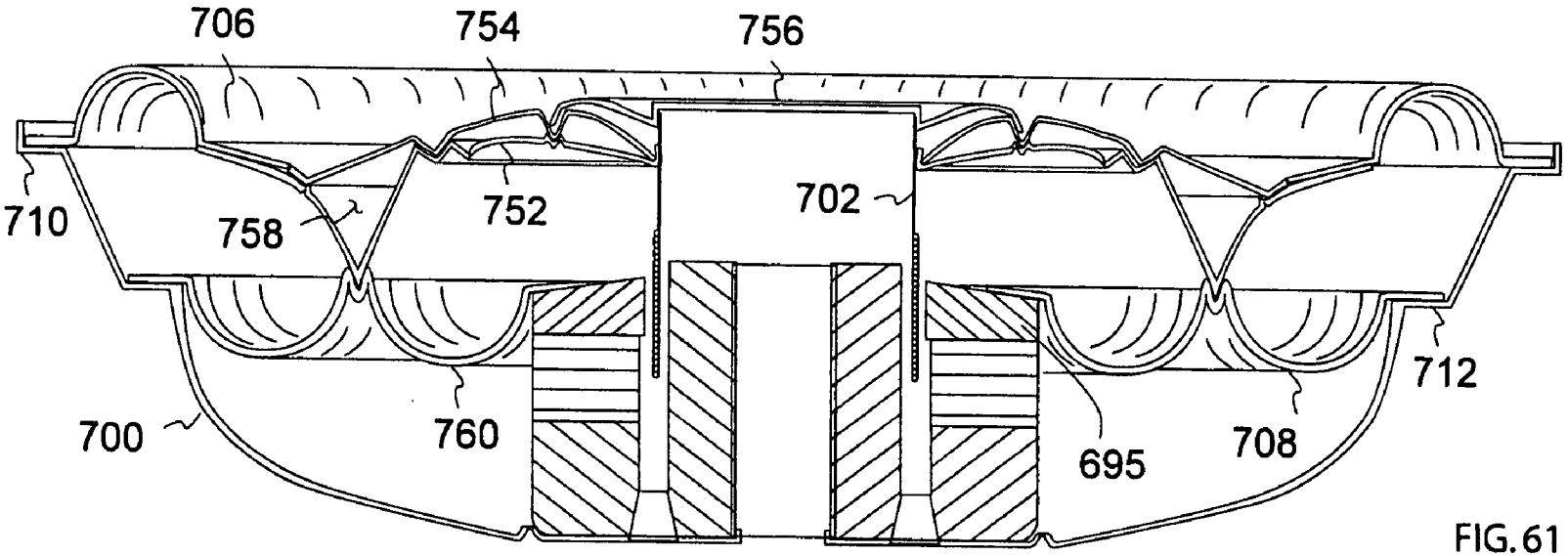
FIG. 61 is the low profile speaker of FIG. 60*a* with a second inner surround supporting the inner cone.

FIG. 61 is the low profile speaker of FIG. 60*a* with one addition, namely a second inner surround 760 to further stabilize inner cone 752 by further minimizing flexing thereof with a surround on each side of the "V" outer edge of inner cone 752. Second inner surround 760 has the inner edge attached to the top of top plate 695 of the magnet assembly and the outer edge of second inner surround is attached to the side closest to the center of the speaker of the "V" shaped outer edge of inner cone 752 with the shaped portion (shown here as a ½ circle) of second inner surround 760 extending toward the bottom of basket 700 below basket inner edge 712. The inner edge of first inner surround 708 in this configuration is attached to the side closest to basket of the "V" shaped outer edge of inner cone 752.

Figure 62A:
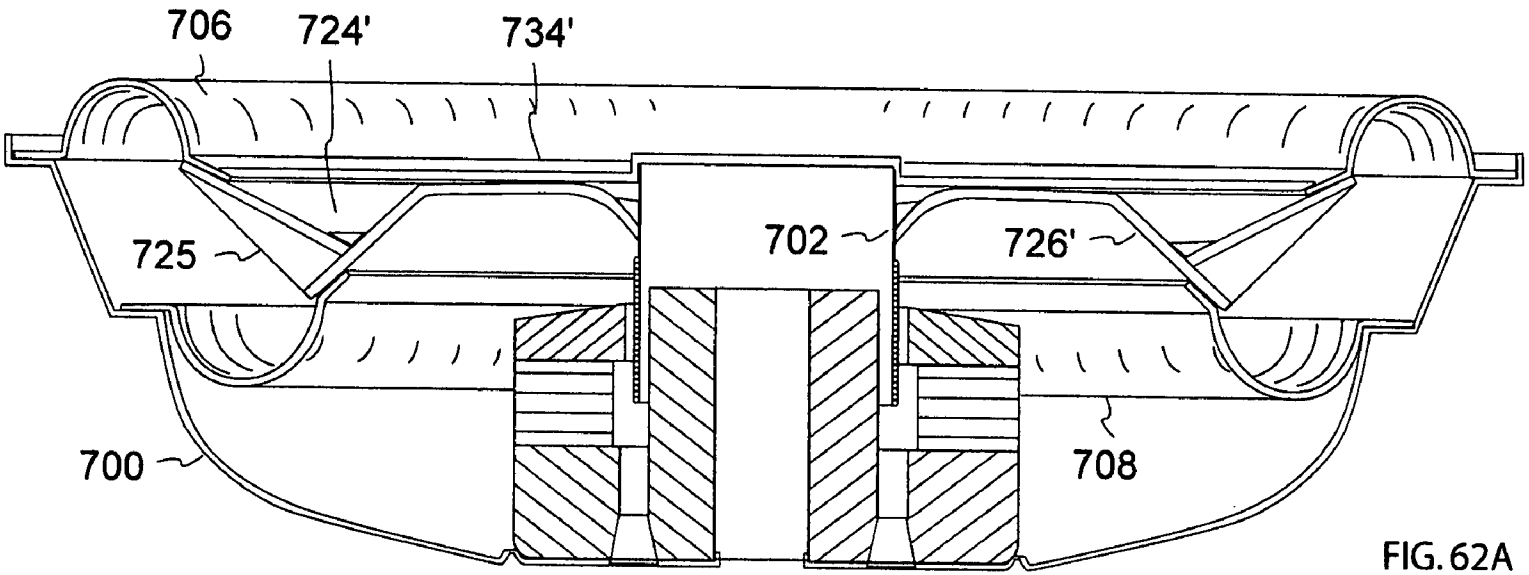
FIG. 62*a* is a cross-sectional view of a low profile speaker of the present invention that is the speaker of FIG. 56*a* with two additional features.

The low profile speaker of FIG. 62*a* is the same as FIG. 56*a* with one addition and one optional addition thereto. In FIG. 62*a*, ribs 725 have been added to the underside of outer cone 724' with the free end of each of ribs 725 glued to the outer surface of the side of inner cone 726'. Ribs 725 provide additional rigidity to the assembled two cones.

Figure 62B:
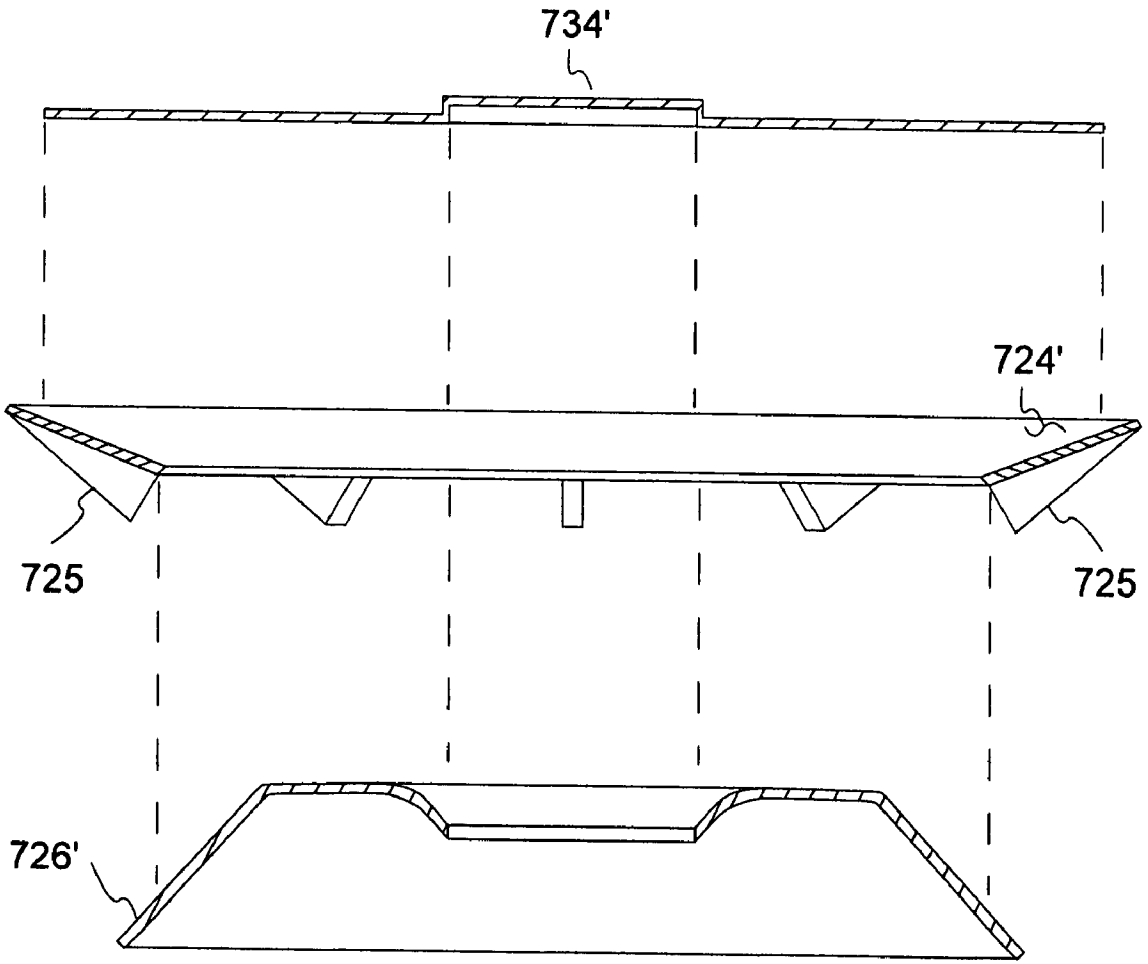
FIG. 62*b* is an exploded view of the cone and dust cap of the low profile speaker of FIG. 62*a* showing their individual shapes and orientation one with the other.

FIG. 62*b* is the same as FIG. 56*b* with ribs 725 added to the cross-sectional view of outer cone 724'.

Figure 62C:
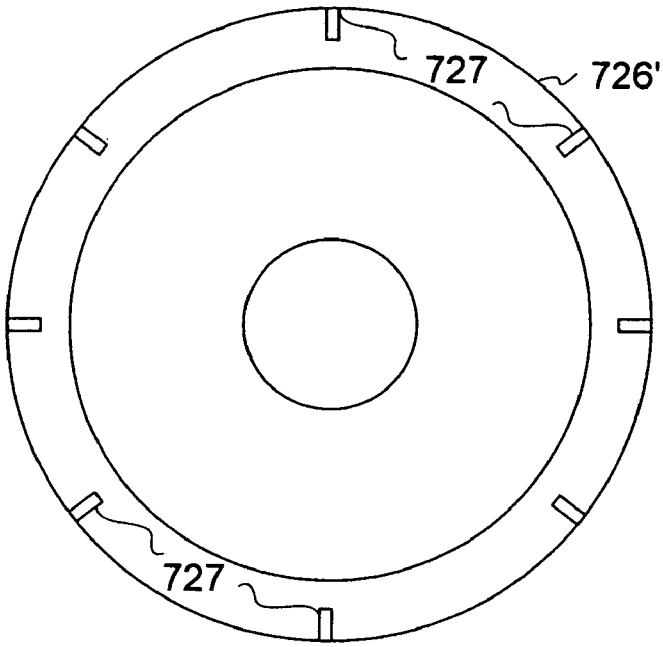
FIGS. 62*c–d* are top and bottom views, respectively, of the cones of the low profile speaker of FIG. 62*a;*
Figure 62D:
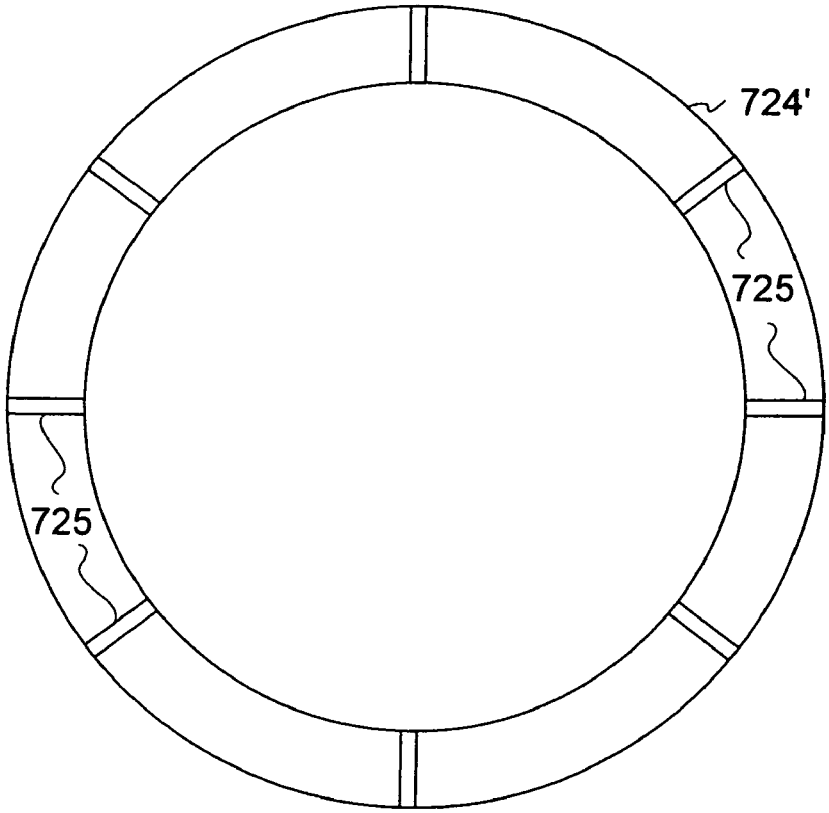

FIG. 62*c* is a top view of inner cone 726' showing optional slots 727 for receiving the free end of ribs 725 on the under side of outer cone 724'. If slots 727 are used, the free end of ribs 725 are individually glued in the slots. Without the slots, the free end of the ribs are glued where they meet the surface of inner cone 726'.

FIG. 62 *d* is a top view of outer cone 724' showing ribs 725. While in this view eight ribs 725 are shown, the actual number of ribs and their spacing is a mater of design choice.

Since the speaker of FIG. 57*a* is also a modification of the speaker of FIG. 56*a*, the additions provided by the design of FIGS. 62*a–d* could also be included with the design of FIG. 57*a* without interfering with the features added therein.

Figure 63:
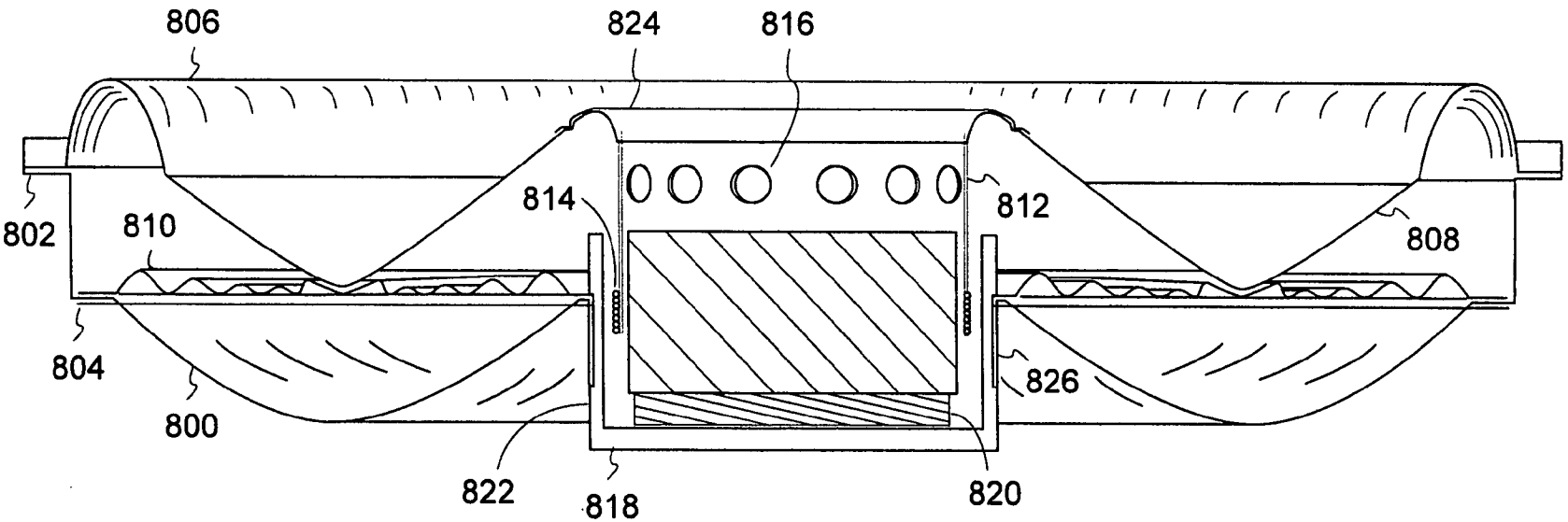
FIG. 63 is a cross-sectional view of a low profile, under hung, speaker of the present invention.

FIG. 63 is a cross-section of another low profile speaker of the present invention, with this design being low hung. The speaker of FIG. 63 includes basket 800 that has a half-doughnut shaped bottom defining a round center hole. The outer edge of the half-doughnut shape extends outward perpendicular to the center axis of basket 800 forming inner ledge 804. Then from the outer most extent of ledge 804, the side of basket 800 extends upward, substantially perpendicularly in this view, to ledge 804 and then outward forming basket mouth edge 802 that is perpendicular to the center axis of basket 800. The center hole of basket 800 is formed with a downward extending flange 826, the inner surface of which is substantially parallel to the center axis of the speaker, with the highest point of the center of basket 800 being substantially the same height above the bottom most point of the basket as is ledge 804. To minimize confusion when viewing FIG. 63 the typical air passages through basket 800 are not shown.

Additionally there is a semi-circular surround 806 extending outward from the mouth of basket 800 with the outer edge of surround 806 attached to mouth edge 802. The inner edge of surround 806 is attached to the outer edge of "V" shaped cone 808. The outer edge of cone 808 has substantially the same shape as the mouth of the basket and a smaller size to accommodate surround 806 between the mouth of basket 800 and the outer edge of cone 808. The inner edge of cone 808 defines a circular center hole that is describe further below.

Mounted to the inner side of flange 826 of the center hole of basket 800 is the magnet assembly of the audio motor of the speaker with approximately three-quarters of the height of the magnet assembly extending below the highest portion of the center of basket 800. The magnet assemble includes a circular cup shaped steel bottom plate 818, a thin magnet 820 placed centrally on the inner bottom surface of bottom plate 818 leaving a space between the side of magnet 820 and the upward extending side of lower plate 818, and a thick steel top plate 822 placed centrally on top of magnet 820 with the top surface of top plate 822 being substantially even with the top edge of the side of bottom plate 818 leaving a space between the side of top plate 822 and the upward extending side of lower plate 818. To retain the magnet assembly in the center of the speaker, downward extending flange 826 of the basket is attached centrally to the outside vertical surface of bottom plate 818.

The lower end of cylindrically shaped voice coil bobbin 812 with voice coil 814 wound on the lower end portion thereof extends into the space between the inner diameter of the side of lower plate 818 and the outer dimensions of magnet 820 and top plate 822. In this speaker design, magnet 820 is very thin and top plate 822 is very thick, and the height of voice coil 814 is very short relative to the height of top plate 822, e.g., 20–25% of the height of top plate 822. Near the top edge of bobbin 812, air holes are shown to permit cooling of voice coil 814.

A spider 810 extends between inner ledge 804 and the highest point in the center of the basket, with the lowest point of "V" shaped cone 808 attached centrally to the top of spider 810. The inner edge of cone 808 is attached to the outside of bobbin 812 near the top edge thereof with the top edge of bobbin 812 always being above the top edge of bottom plate 818 even when voice coil 814 draws bobbin 812 into the magnet assembly to the maximum extent during operation of the speaker.

The inner edge of cone 808 is formed with an upward extending rolled portion 824 to extend the inner edge of cone 808 downward to attach to the outside, near the top edge, of bobbin 812.

Figure 64A:
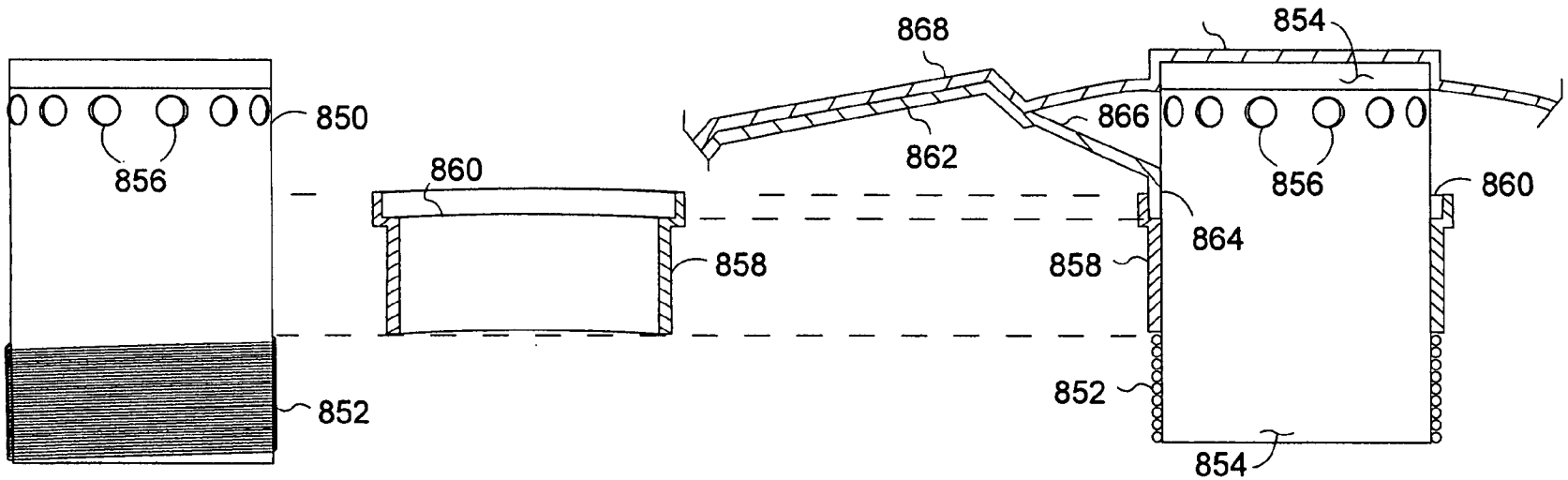
FIG. 64*a* is a partial cross-section of a low profile speaker illustrating another technique for connecting the cone to the voice coil bobbin.

Referring next to FIG. 64*a* there is shown a partial cross-section of a low profile speaker illustrating another technique for connecting the cone to the voice coil bobbin. On the left is shown a plan view of voice coil bobbin 850 with voice coil 852 wound on thereon at the lower end. The top edge outer edge 854 of bobbin 850 is shown as being bare to permit gluing thereto with the rest of the outer surface of bobbin 850 wrapped with an electrically insulating material. If bobbin 850 is made of a non-metallic material, then the wrap is not necessary. Near the top edge of bobbin 850, and below top edge 854, there are a series of air holes 856 through the side of the bobbin to provide cooling to the voice coil during operation of a speaker with such a bobbin.

In the center of FIG. 64*a* is a cross-section of a sleeve 858 with the smallest inner diameter substantially equal to the outer diameter of bobbin 850. Sleeve 858, the top edge has a larger diameter than the lower part of sleeve 850 forming square bottom trough 860.

In the right portion of FIG. 64*a* there is a partial cross-sectional view that illustrates a cone 862—sleeve 858—bobbin 850 interconnection technique. Sleeve 858 is shown placed around bobbin 850 and glued in place with the lower end of sleeve 858 in contact with the top most coil of voice coil 852 with the top edge square bottom trough 860 opening toward, and lower than, air holes 856. Cone 862 has cone inner edge 864 that has a diameter that is substantially to same as the outer diameter of bobbin 850 with edge 864 fit within, seated and glued in place in trough 860 of sleeve 858. Also shown lateral support diaphragm 868 with a portion of the underside thereof glued to a portion of the top surface of cone 862. Additionally, the inner surface of center circular shoulder 870 of lateral support diaphragm 868 is glued to top edge outer edge 854 of bobbin 850 with the inner diameter of circular shoulder 870 being substantially the same as the outer diameter of bobbin 850. Further, to permit coiling of voice coil 852 a series of spaced apart holes 866 are defined by cone 862 around bobbin 850 in the triangle formed by cone 862, diaphragm 868 and bobbin 850 to allow air to flow through air holes 856 in bobbin 850 into the triangular area described above and out though air holes 866 into the vented basket (not shown) of the speaker.

With the three views in FIG. 64*a* aligned with each other side by side the positioning of the various parts, one with respect to another, can be easily seen by following the dashed lines.

Figure 64B:
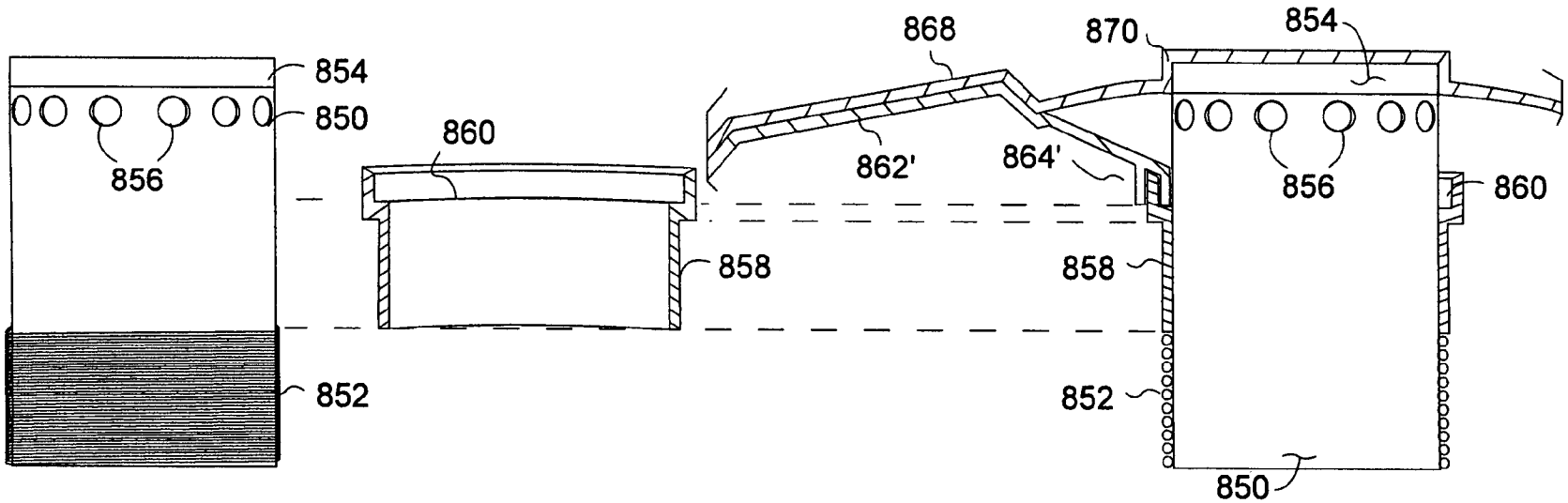
FIG. 64*b* is a variation of FIG. 64*a* with a bifurcated inner edge of the cone.

FIG. 64*b* is the same as FIG. 64*a* with only one difference. Here cone 862' has a bifurcated inner edge 864' with one tine in trough 860 as is the inner edge of cone 862 in FIG. 64*a*. The second tine here extends down the outer side of the top edge of sleeve 858 with the spacing between the two tines being substantially equal to the width of the upper edge of sleeve 858. As in the embodiment of FIG. 64*a*, the bifurcated inner edge of cone 862' is glued in trough 860 and to the outer side of the top edge of sleeve 858.

Figure 65:
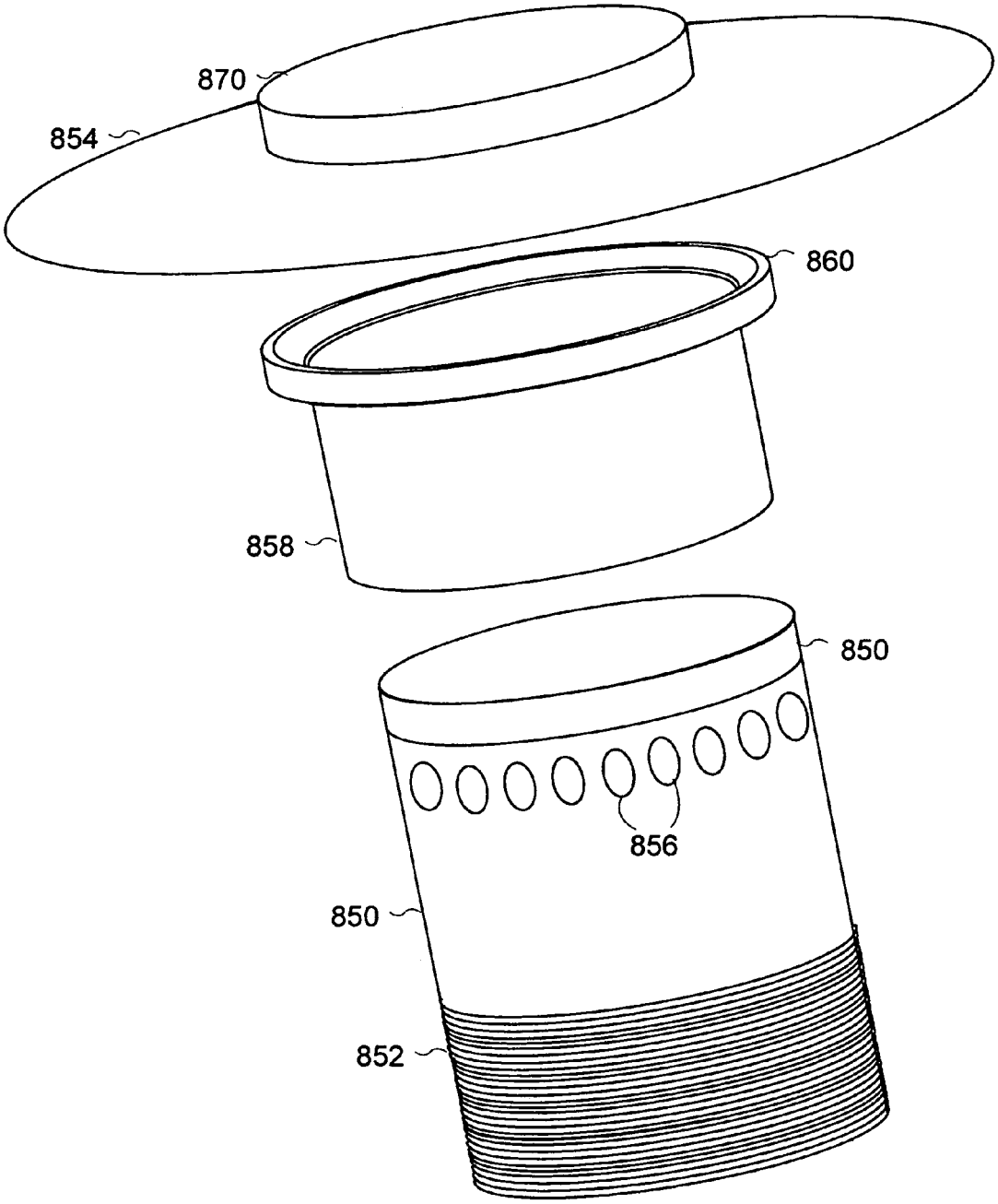
FIG. 65 is an exploded perspective view of the voice coil bobbin, bobbin sleeve and lateral support diaphragm of the low profile speaker of FIGS. 64*a* and 64*b*.

FIG. 65 is an exploded perspective view of voice coil bobbin 850, bobbin sleeve 858 and lateral support diaphragm 854 of the low profile speaker of FIGS. 64*a* and 64*b*. In FIG. 65 the three shown components are in alignment to show their relative sizes with respect to each other.

While the invention has been described with regard to several specific embodiments. Those skilled in the art will recognize that changes can be made in form and detail without departing from the spirit and scope of the invention. One skilled in the art will also find it obvious to extend the techniques discussed with respect to a passive radiator to and active speaker, and to also extend the techniques discussed relative to an active speaker to a passive radiator. This is true since a passive radiator is basically the same as a speaker without the electromagnetic engine for moving the diaphragm of the passive radiator. Thus, the protection afforded hereby is as stated in the accompanying claims and equivalents thereof.

What is claimed is:

1. A loudspeaker comprising:

a frame having an interior bottom surface with a side portion extending upward from, and surrounding, said interior bottom surface, said side portion terminating in an exterior edge of a uniform first height above said interior bottom surface with said exterior edge defining an opening into the frame having a first predetermined size and shape;

an audio motor including a magnet assembly having an air gap mounted to the bottom surface of the frame and a thin walled bobbin having an outer surface of a first diameter with a first end with a voice coil wound thereon and located in said air gap, and a second end extending out of said air gap;

a cone having an outer edge and an inner edge, and a top surface and a bottom surface with said outer edge being substantially the same shape as, and a second size that is smaller than said first size defined by the exterior edge of the frame, with said inner edge defined by a centrally located circular hole of a second diameter through the cone, said second diameter having a third size that is smaller than said second size; the cone from the inner edge radiates outward and upward at a first selected angle to a flat plateau, from said plateau downward into a deep groove with an outer side of said groove extending outward and upward to said outer edge; wherein the outer most end of said plateau defines a circle of a third diameter that is larger than an outer most extent of said audio motor relative to said interior bottom surface of said frame with a bottom most point of said groove defining a circle of a fourth diameter that is larger than said third diameter;

a ring shaped sleeve having a bottom edge and a top edge attached to the outer surface of said bobbin with said top edge spaced apart from said second end of the bobbin, wherein said sleeve defines an inner shoulder of a selected width a selected distance from said top edge creating a circular outward extending ring at the top edge of the sleeve, said outward extending ring having an inner diameter that is greater than said first diameter with the balance of the sleeve having an inner diameter that is substantially the same as said first diameter to provide a snug fit with the outer surface of the bobbin, wherein said inner edge of said cone is affixed between the outer surface of the bobbin and an inner side of outward extending ring in contact with said shoulder of the sleeve;

a first flexible suspension connected between the exterior edge of the frame and the outer edge of the cone; and a stiff diaphragm having an outer edge, a top surface and a bottom surface; said stiff diaphragm having a fifth diameter that is equal to, or somewhat greater than said third diameter, the bottom surface of an outer portion of said diaphragm is affixed to said plateau of the cone, and the bottom surface of a center portion of said diaphragm is affixed to said second end of the bobbin;

wherein an inner most portion of said cone, a portion of said bottom surface of said diaphragm and a portion of said outer surface of said bobbin nearest said second end define an enclosed substantially triangular area that encircles a center portion of said loudspeaker; and wherein when audio motor is energized and said voice coil drawn inward the groove portion of said cone moves inward toward said bottom of said frame and clears the outer most extend of said audio motor.

2. A loudspeaker as in claim 1:

wherein said frame defines an interior mounting surface therearound spaced apart from said exterior edge and adjacent a bottom portion of said deep grove when said audio motor is unenergized; and further comprising a second flexible suspension having an outer edge and an inner edge with the outer edge affixed to said interior mounting surface therearound and said inner edge affixed to said bottom portion of said deep groove.

3. A loudspeaker as in claim 1 wherein said diaphragm includes a centrally defined circularly shape connection shoulder having a sixth diameter that is substantially equal to said first diameter, said connection shoulder affixed to said second end of said bobbin.

4. A loudspeaker as in claim 1 wherein vent holes are defined by, through, and spaced around each of said bobbin near said second end and a portion of said cone nearest said bobbin to facilitate cooling of the loudspeaker.

5. A loudspeaker as in claim 1 wherein said inner edge of said cone is bifurcated forming two spaced apart tines, one of said tines affixed between the outer surface of the bobbin and an inner side of outward extending ring in contact with said shoulder of the sleeve and the other of said tines affixed to an outer surface of said outward extending ring of said sleeve.

6. A loudspeaker comprising:

a frame having a vertical walled ring forming a center hole of a first diameter with a top edge of said ring attached to an inner side of an upward opening arcuate bottom portion in the shape of a half-doughnut with an outer edge of said arcuate bottom portion coupled to an outward extending inner ledge with an outer end of said ledge coupled to upward extending portion and then extending outward forming a mouth portion having a first size and shape; wherein an inner surface of said ring is substantially parallel to a center axis of said frame, and a highest point closest to the center of the frame being substantially the same height above a bottom most point of said arcuate portion as the inner ledge;

an audio motor including a magnet assembly having an air gap mounted within said ring of the frame and a thin walled bobbin having an outer surface of a second diameter with a first end with a voice coil wound thereon and located in said air gap, and a second end extending out of said air gap with said first diameter being larger than said second diameter;

a cone having an outer edge and an inner edge, said cone having a top surface and a bottom surface with said outer edge being substantially the same shape as, and a second size that is smaller than said first size defined by the mouth of the frame, with said inner edge defined by centrally located circular hole of a third diameter through the cone with said third diameter being substantially equal to said second diameter;

wherein the cone extends downward from the outer edge to a point that substantially aligned with the bottom point of said arcuate portion of the frame and the extending upward to a downward curling lip to the inner edge of the cone; the inner edge of said cone being attached to said second end of the bobbin;

a first flexible suspension connected between the exterior edge of the frame and the outer edge of the cone; and a second flexible suspension connected between said inner ledge and said top edge of said ring of the frame with the bottom most point of the bottom surface of said cone affixed to substantially a center point of said second flexible suspension.

* * * * *